US011814891B2

(12) United States Patent
Cumbo et al.

(10) Patent No.: US 11,814,891 B2
(45) Date of Patent: Nov. 14, 2023

(54) DOOR SYSTEM WITH DOOR PRESENTER CONTROL

(71) Applicant: MAGNA CLOSURES INC., Newmarket (CA)

(72) Inventors: Francesco Cumbo, Pisa (IT); Arthur J. W. Henes, Etobicoke (CA)

(73) Assignee: MAGNA CLOSURES INC., Newmarket (CA)

( * ) Notice: Subject to any disclaimer, the term of this patent is extended or adjusted under 35 U.S.C. 154(b) by 194 days.

(21) Appl. No.: 17/198,263

(22) Filed: Mar. 11, 2021

(65) Prior Publication Data

US 2021/0301561 A1 Sep. 30, 2021

Related U.S. Application Data

(60) Provisional application No. 63/033,079, filed on Jun. 1, 2020, provisional application No. 62/993,981, filed on Mar. 24, 2020.

(51) Int. Cl.

| | |
|---|---|
| ***E05F 15/622*** | (2015.01) |
| ***E05B 81/20*** | (2014.01) |
| *E05B 81/54* | (2014.01) |

(52) U.S. Cl.

CPC ..... *E05F 15/622* (2015.01); *E05B 81/20* (2013.01); *E05B 81/54* (2013.01);

(Continued)

(58) Field of Classification Search

CPC . E05B 81/20; E05F 15/622; E05F 15/611–63; E05F 15/40–41; E05F 15/71

See application file for complete search history.

(56) References Cited

U.S. PATENT DOCUMENTS 3,605,459 A * 9/1971 Van Dalen ..... E05B 47/0038 292/144
9,174,517 B2 * 11/2015 Scheuring ..... E05F 15/614

(Continued)

FOREIGN PATENT DOCUMENTS

CN 104975781 A 10/2015
CN 105089383 A 11/2015

(Continued)

*Primary Examiner* — Catherine A Kelly
*Assistant Examiner* — Patrick B. Ponciano
(74) *Attorney, Agent, or Firm* — Dickinson Wright PLLC

(57) ABSTRACT

A door system presenter assembly and method for controlling movement of a motor vehicle closure panel between a closed position, a presented position and an open position. Presenter assembly includes an electric motor and a clutch assembly having an engaged state when electric motor is energized and a disengaged state when electric motor is de-energized. A presenter unit has a presenter lead screw and an extensible member moveable between a retracted position corresponding to the closed position and an extended position corresponding to the presented position. Presenter lead screw is rotatably driven when electric motor is energized and when clutch assembly is in the engaged state to move the extensible member to the extended position. Extensible member is automatically biased to the retracted position by a presenter biasing member when the electric motor is de-energized and when the clutch assembly is in the disengaged state.

11 Claims, 30 Drawing Sheets

(52) U.S. Cl.
CPC ... *E05Y 2201/434* (2013.01); *E05Y 2800/113* (2013.01); *E05Y 2900/531* (2013.01)

(56) References Cited

U.S. PATENT DOCUMENTS

| | | | | |
|---|---|---|---|---|
| 9,330,552 | B2 | 5/2016 | Gotz et al. | |
| 9,995,066 | B1 * | 6/2018 | Ottolini | E05F 15/619 |
| 10,047,554 | B2 | 8/2018 | Dudar et al. | |
| 10,087,671 | B2 * | 10/2018 | Linden | E05B 81/56 |
| 10,435,924 | B1 | 10/2019 | Salter et al. | |
| 11,180,943 | B2 * | 11/2021 | Khan | E05F 15/42 |
| 2016/0369551 | A1 * | 12/2016 | Suzuki | E05F 15/611 |
| 2018/0038146 | A1 | 2/2018 | Linden et al. | |
| 2018/0179788 | A1 * | 6/2018 | Oxley | E05B 81/13 |
| 2018/0238099 | A1 * | 8/2018 | Schatz | E05F 15/622 |
| 2019/0003214 | A1 | 1/2019 | Cumbo et al. | |
| 2019/0203508 | A1 | 7/2019 | Harajli et al. | |
| 2019/0292817 | A1 | 9/2019 | Tomaszewski | |
| 2019/0292818 | A1 * | 9/2019 | Cumbo | E05C 17/003 |
| 2019/0389608 | A1 * | 12/2019 | He | B65B 13/187 |
| 2020/0131836 | A1 | 4/2020 | Ottino | |
| 2020/0270928 | A1 | 8/2020 | Cumbo | |
| 2020/0284068 | A1 | 9/2020 | Cumbo et al. | |

FOREIGN PATENT DOCUMENTS

| | | | |
|---|---|---|---|
| CN | 108240146 | A | 7/2018 |
| CN | 110029905 | A | 7/2019 |
| CN | 110234827 | A | 9/2019 |
| CN | 111356817 | A | 6/2020 |

* cited by examiner

FIG. 1C
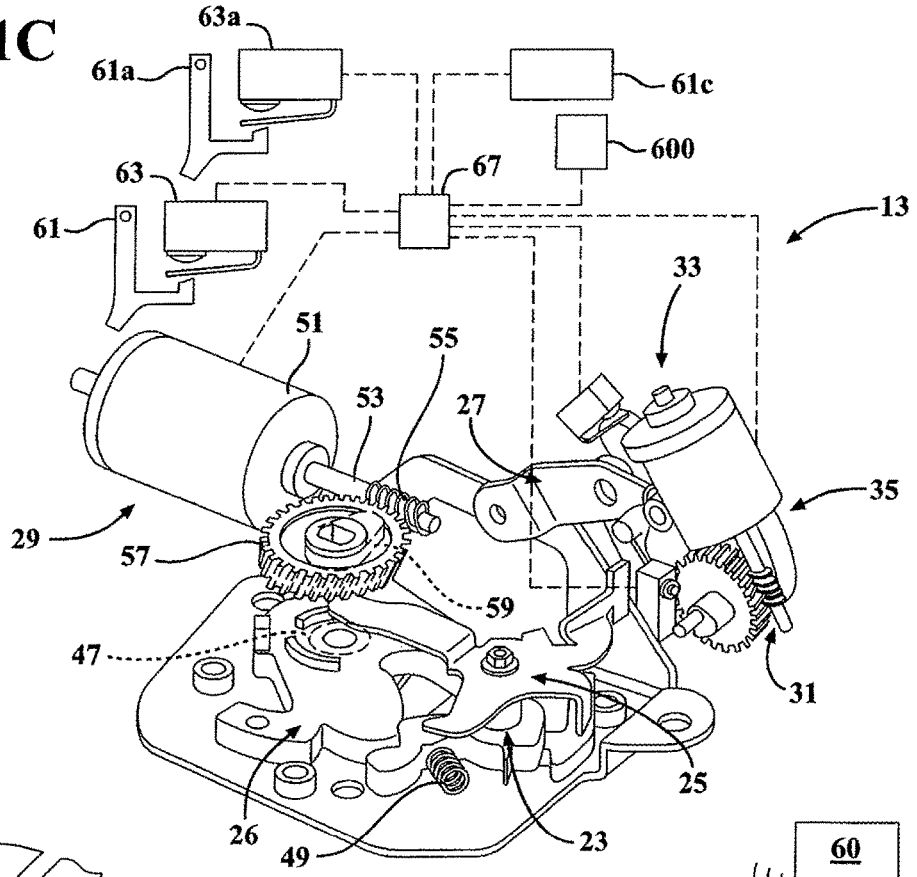
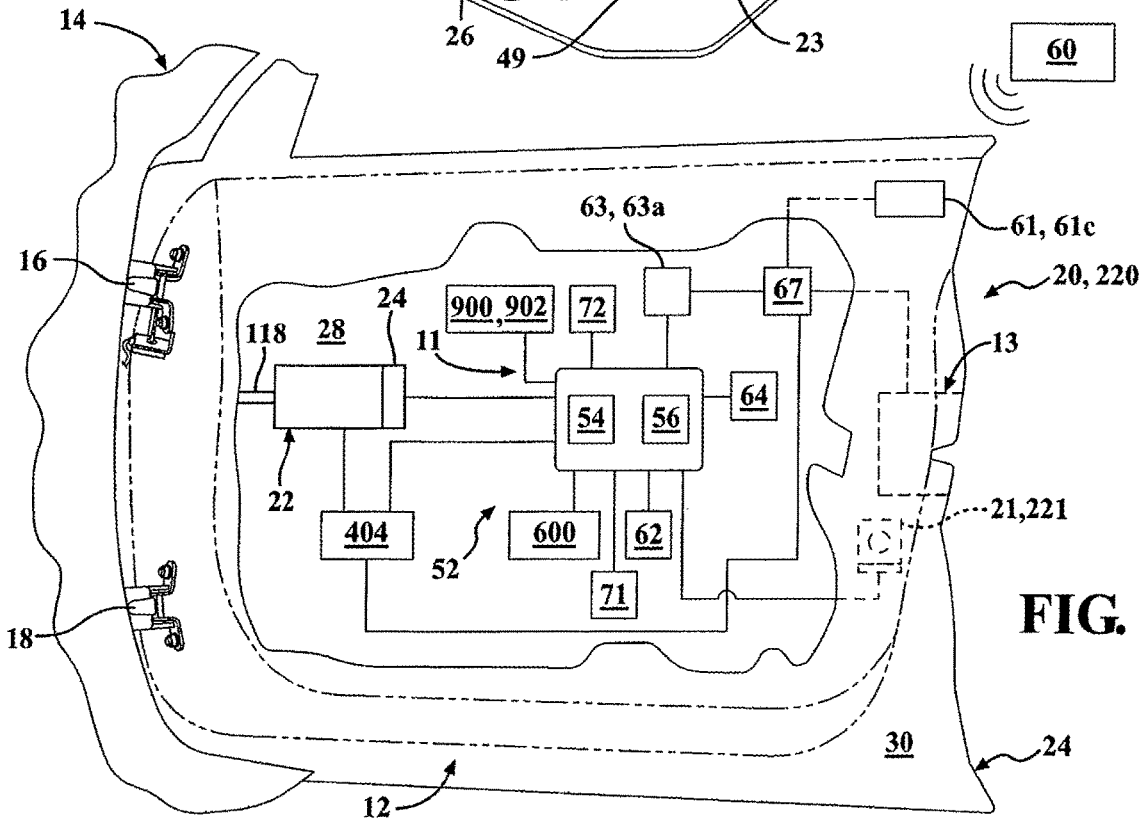
FIG. 2

DOOR SYSTEM WITH DOOR PRESENTER CONTROL

CROSS-REFERENCE TO RELATED APPLICATION

This application claims the benefit of U.S. Provisional Application Ser. No. 63/033,079, filed Jun. 1, 2020, and of U.S. Provisional Application Ser. No. 62/993,981, filed Mar. 24, 2020, which are both incorporated herein by reference in their entirety.

FIELD

The present disclosure relates generally to power door systems for motor vehicles. More particularly, the present disclosure is directed to a power door actuation system equipped with a power door presenter assembly operable for powered movement of a vehicle door relative to a vehicle body from a closed position toward an open position.

BACKGROUND

This section provides background information related to the present disclosure which is not necessarily prior art.

In view of increased consumer demand for motor vehicles equipped with advanced comfort and convenience features, many current vehicles are now provided with passive keyless entry systems to permit locking and release of the passenger doors without the use of traditional key-type manual entry systems. As a further advancement, power door actuation systems have been developed which function to swing the passenger door about its pivot axis between its open and closed positions without any manual intervention by a user with the door. As a result, vehicle manufacturers are foregoing the integration of traditional door handles on the exterior of the vehicle door resulting in cost and weight savings, as well as styling and aerodynamic benefits. In lieu thereof, door handles are being replaced with wireless key fobs and/or electronic sensors, i.e. touch/touchless sensors. For example, a capacitive touch pad may be provided to replace an external handle, or an unlock switch may be configured in communication with an electronic latch to command the unlocking of the latch and the operation of the power door actuation system(s) to open the door.

Typically, such power door actuation systems include a power-operated device such as, for example, a power swing door actuator having an electric motor and a rotary-to-linear conversion device that are operable for converting the rotary output of the electric motor into translational movement of an extensible member. In many power door actuator arrangements, the power swing door actuator is mounted to the passenger door and the distal end of the extensible member is fixedly secured to the vehicle body. One example of a door-mounted power door actuation system is shown in commonly-owned U.S. Pat. No. 9,174,517 with a power swing door actuator having a rotary-to-linear conversion device configured to include an externally-threaded leadscrew rotatively driven by the electric motor and an internally-threaded drive nut meshingly engaged with the leadscrew and to which the extensible member is attached. Accordingly, control over the speed and direction of rotation of the leadscrew results in control over the speed and direction of translational movement of the drive nut and the extensible member for controlling swinging movement of the passenger door between its open and closed positions.

Some other door actuation systems, known as door presenter systems, are configured to include a power-operated door presenter assembly, commonly referred to as presenter assembly, or simply presenter, operable to "present" the door by opening it only a predetermined amount, or distance, from a closed position to a partially-open position so as to allow subsequent manual movement of the door to its fully-open position. In some instances, environmental factors, such as an accumulation of ice or a vehicle crash, for example, may cause the presenter to break, or attempt to break, ice or overcome, or attempt to overcome, a force imparted by a damaged vehicle panel upon being actuated. Having to overcome such forces imparted by ice, a damaged vehicle panel or the like, may damage the presenter and/or adversely affect the useful life span of the presenter.

Such presenters typically include a bidirectional motor and gear assembly operable to rotatably drive a leadscrew in a first direction upon energizing the motor, which in turn causes a nut, with nut tube (extensible member) fixed thereto, to translate along the leadscrew to operably push and move the vehicle closure panel with the extensible member to the presented position. Upon reaching the presented position, the motor can be energized with an opposite polarity to reverse the direction of rotation of the leadscrew in a second direction opposite the first direction to retract the nut and extensible member, thereby returning the presenter to a stowed, retracted and non-deployed position. Although such presenter assemblies above can prove effective in moving a vehicle closure panel to the presented position, they come with some potential drawbacks.

One further drawback of the known presenter assemblies relates to the incorporation of high reduction gears needed to generate enough force to move the vehicle closure panel to the presented position, particularly in regions where ice is expected to restrict the vehicle closure panel from being moved from its fully closed position. High reduction gears, although generally effective at generating the high force needed to move the vehicle closure panel to the presented position, are unable to be back driven quickly. As such, in a case where the vehicle closure panel is moved suddenly and quickly from the presented position back toward the fully closed position, such as via the user slamming the door or under a high wind condition, while the presenter is still in the presented position or not fully returned to its non-deployed position, the high reduction gears and components associated therewith can be subjected to high stress and damage.

In view of the above, there remains a need to develop optimized closure panel assemblies and power door presenter systems therefor, as well as methods of operation, which address and overcome limitations associated with known power door actuation systems as well as to provide increased applicability, while reducing cost and complexity.

SUMMARY

This section provides a general summary of some of the objects, advantages, aspects and features provided by the inventive concepts associated with the present disclosure. However, this section is not intended to be considered an exhaustive and comprehensive listing of all such objects, advantages, aspects and features of the present disclosure.

In accordance one aspect, the present disclosure is directed to a vehicle closure panel and a presenter assembly for the vehicle closure panel which advances the art and improves upon currently known vehicle closure panels and presenter assemblies for such vehicle closure panels.

In another aspect, the present disclosure is directed to a vehicle closure panel and a method of presenting the vehicle closure panel which advances the art and improves upon currently known vehicle closure panels and methods of presenting vehicle closure panels.

In another aspect, the present disclosure is directed to a vehicle closure panel system including a vehicle door, a closure latch assembly and a power-operated presenter actuator with an electronic control unit coupled in operable communication with the closure latch assembly and power-operated presenter actuator to facilitate moving the vehicle door from a fully closed position to a presented position in response to a command from the electronic control unit.

It is an aspect of the present disclosure to provide a door system for a motor vehicle having a vehicle door moveable relative to a vehicle body between a closed position, a presented position, and a fully-open position. The door system includes a closure latch assembly configured to fixedly maintain the vehicle door in the closed position in a latched state and release the vehicle door for movement to one of the presented position and/or fully-open position in an unlatched state. The system also includes a power-operated presenter actuator mounted to one of the vehicle body and the vehicle door and configured to move the vehicle door between the closed position and the presented position while the closure latch assembly is in the unlatched state. The system further includes an electronic control unit coupled in operable communication with the closure latch assembly and the power-operated presenter actuator, wherein the electronic control unit is configured to receive a latch release command and send a command to actuate the power-operated presenter actuator in response to the latch release command.

In accordance with another aspect, the electronic control unit is configured to send a command to actuate the power-operated presenter actuator in response a state of the vehicle.

In accordance with another aspect, a method of controlling movement of a vehicle door between a closed position, a presented position, and a fully-open position is provided. The method includes a step of receiving a latch release command and a step of operating a power-operated presenter actuator, mounted to one of the vehicle body and the vehicle door, to move the vehicle door between the closed position and the presented position in response to the latch release command.

In accordance with another aspect, the method of controlling movement of a vehicle door can further include operating the power-operated presenter actuator to move the vehicle door between the closed position and the presented position in response to a state of the vehicle.

It is a related aspect to provide a presenter assembly with a clutch assembly that is engaged and disengaged in response to an electric motor being energized and de-energized, respectively, in reliable, economical fashion.

It is a related aspect to provide a presenter assembly that is both extendable to move a vehicle closure panel to a presented position in response to energizing an electric motor and automatically retractable, to prevent inadvertent damage to the presenter assembly while the vehicle closure panel is moving toward its closed position, upon de-energizing the electric motor.

In accordance with these and other aspects, a presenter assembly for moving a motor vehicle closure panel from a closed position to a partially open includes a housing and an electric motor supported by the housing. The electric motor has a drive shaft extending along a drive shaft axis. An output member is operably coupled to the drive shaft and is driven by the electric motor when the electric motor is energized. A presenter unit has a presenter lead screw and an extensible member configured for movement between a retracted position corresponding to the closed position of the vehicle door and an extended position corresponding to the partially open, presented position of the vehicle door. The extensible member is biased toward the retracted position by a presenter biasing member. A clutch assembly is provided in operable communication with the electric motor, wherein the clutch assembly has an engaged state when the electric motor is energized and a disengaged state when the electric motor is de-energized. The presenter lead screw is rotatably driven by the output member when the clutch assembly is in the engaged state and when the electric motor is energized to move the extensible member against the bias of the presenter biasing member from the retracted position to the extended position. The extensible member is automatically biased from the extended position to the retracted position by the presenter biasing member when the electric motor is de-energized and when the clutch assembly is in the disengaged state.

In accordance with another aspect of the disclosure, the output member can be coupled with the drive shaft when the electric motor is energized and when the clutch assembly is in the engaged state and can be decoupled from drive shaft when the electric motor is de-energized and when the clutch assembly is in the disengaged state.

In accordance with another aspect of the disclosure, the clutch assembly can be disposed between the output member and the drive shaft of the electric motor.

In accordance with another aspect of the disclosure, the clutch assembly can be disposed between the output member and the presenter lead screw.

In accordance with another aspect of the disclosure, a clutch lead screw of the clutch assembly extends along the drive shaft axis in fixed relation to the drive shaft for rotation about the drive shaft axis in a first direction in response to energization of the electric motor. A nut is disposed about the clutch lead screw. The nut has an end face and is configured for selective translation along the clutch lead screw in response to rotation of the clutch lead screw. A clutch plate having a clutch face is configured for selective rotation about the axis. A clutch biasing member imparts a bias between the nut and the clutch plate, with the bias tending to space the end face out of driving engagement with the clutch face. A carrier member is supported by the housing in coupled engagement with the nut. The carrier member is configured to impart a torsional bias on the nut sufficient to cause selective relative rotation between the nut and the clutch lead screw to cause the nut to translate along the clutch lead screw in response to rotation of the clutch lead screw when the end face of the nut and the clutch face of the clutch plate are biased out of driving engagement with one another. The torsion bias is overcome upon the end face of the nut and the clutch face of the clutch plate being brought into driving engagement with one another, thereby allowing the nut and the carrier member to rotate conjointly with the clutch leadscrew. The presenter lead screw is rotatably driven by the output gear when the end face of the nut and the clutch face of the clutch plate are brought into driving engagement with one another to move the extensible member against the bias of the presenter biasing member from the retracted position to the extended position. The extensible member is automatically biased from the extended position to the retracted position by the presenter biasing member when the electric motor is de-energized and when clutch biasing member imparts a bias to space the end face of the nut out of driving engagement with the clutch face of the clutch plate.

In accordance with another aspect of the disclosure, the end face of the nut and the clutch face of the clutch plate are maintained in driving engagement with one another when electrical energy is supplied to the electric motor, thereby inhibiting back driving of the nut in a stall condition.

In accordance with another aspect of the disclosure, a rotary damper member is configured to impart a torsional bias on the carrier, the torsional bias fixing the carrier and the nut against rotation with the clutch lead screw when the end face of the nut and the clutch face of the clutch plate are biased out of driving engagement with one another and allowing the carrier and the nut to rotate with the clutch lead screw when the end face of the nut and the clutch face of the clutch plate are in driving engagement with one another.

In accordance with another aspect of the disclosure, the rotary damper can be provided as a spring member configured to impart a frictional bias on an outer surface of the carrier member.

In accordance with another aspect of the disclosure, the drive shaft of the motor can be configured to rotate relative to the output shaft having the drive member when the end face of the nut and the clutch face of the clutch plate are biased out of driving engagement with one another.

In accordance with another aspect of the disclosure, the drive shaft of the motor and the output shaft can be configured to co-rotate with one another when the end face of the nut and the clutch face of the clutch plate are in driving engagement with one another.

In accordance with another aspect of the disclosure, the clutch plate and the drive member can be permanently fixed to one another, and further yet, can be provided as a single component.

In accordance with another aspect of the disclosure, the clutch plate and the drive member can be supported by the drive shaft of the motor wherein the drive shaft can be configured to rotate relative to the clutch plate and the drive member when the end face of the nut and the clutch face of the clutch plate are biased out of driving engagement with one another.

In accordance with another aspect of the disclosure, the clutch plate and the drive member can be supported by the drive shaft of the motor wherein the clutch plate and the drive member can be configured to co-rotate with the drive shaft when the end face of the nut and the clutch face of the clutch plate are in driving engagement with one another.

In accordance with another aspect of the disclosure, one of the nut and the clutch plate can be provided having at least one drive lug and the other of the nut and the clutch plate having at least one recessed channel configured for sliding receipt of the at least one drive lug therein, the at least one drive lug being configured to translate within the at least one recessed channel when the electric motor is energized and when the end face of the nut and the clutch face of the clutch plate are biased out of driving engagement with one another, with the at least one drive lug and the at least one recessed being further being configured to prevent relative rotation between the carrier member and the nut when the end face of the nut and the clutch face of the clutch plate are in driving engagement with one another.

In accordance with a further aspect of the disclosure, a motor vehicle door assembly is provided. The motor vehicle door assembly includes an outer panel and an inner panel defining an internal cavity. A presenter assembly is supported in the internal cavity, with the presenter assembly including: a housing; an electric motor supported by the housing, with the electric motor having a drive shaft extending along an axis; a clutch assembly having an engaged state when the electric motor is energized and a disengaged state when the electric motor is de-energized; an output gear operably coupled to the drive shaft by the clutch assembly, the output member being driven by the electric motor when the electric motor is energized and when the clutch assembly is in the engaged state and being decoupled from the electric motor when the electric motor is de-energized and when the clutch assembly is in the disengaged state; and a presenter unit having a presenter lead screw and an extensible member configured for movement between a retracted position corresponding to the closed position of the vehicle closure panel and an extended position corresponding to the partially open presented position of the vehicle closure panel, the extensible member being biased toward the retracted position by a biasing member, the presenter lead screw being rotatably driven by the output member when the clutch assembly is in the engaged state and when the electric motor is energized to move the extensible member against the bias of the biasing member from the retracted position to the extended position, the extensible member being automatically biased from the extended position to the retracted position by the biasing member when the electric motor is de-energized and when the clutch assembly is in the disengaged state.

In accordance with another aspect, a presenter assembly for moving a motor vehicle closure panel from a closed position to a partially open includes a housing and an electric motor supported by the housing. The electric motor has a drive shaft extending along an axis, with an output member being operably coupled to the drive shaft and being driven by the electric motor when the electric motor is energized. Further, a presenter unit having an extensible member is configured for movement between a retracted position corresponding to the closed position of the vehicle closure panel and an extended position corresponding to the partially open presented position of the vehicle closure panel. The extensible member is biased toward the retracted position by a biasing member and is operably driven by the output member when the electric motor is energized to move the extensible member against the bias of the biasing member from the retracted position to the extended position, wherein the extensible member is automatically biased from the extended position to the retracted position by the biasing member when the electric motor is de-energized.

In accordance with another aspect, a presenter assembly for moving a motor vehicle closure panel from a closed position to a partially open includes a housing and an electric motor supported by the housing. The electric motor has a drive shaft extending along an axis, with an output member being operably coupled to the drive shaft and being driven by the electric motor when the electric motor is energized. Further, a presenter unit having an extensible member is configured for movement between a retracted position corresponding to the closed position of the vehicle closure panel and an extended position corresponding to the partially open presented position of the vehicle closure panel. The extensible member is biased toward the retracted position by a biasing member. A clutch assembly is operably positioned between the presenter unit and the electric motor, with the clutch assembly having an engaged state to operably couple the motor and the presenter unit when the electric motor is energized and a disengaged state to operably decouple the motor and the presenter unit when the electric motor is de-energized.

In accordance with a further aspect of the disclosure, a method for presenting a vehicle closure panel from a closed position to a partially open, presented position includes providing a presenter unit having a presenter lead screw and an extensible member configured for movement between a retracted position, corresponding to the closed position of the vehicle closure panel, and an extended position, corresponding to the partially open presented position of the vehicle closure panel, with the extensible member being biased toward the retracted position by a biasing member. Further, providing an electric motor having a drive shaft extending along an axis for rotation about the axis in response to energization of the electric motor. Further yet, operably coupling the presenter lead screw of the presenter unit to the drive shaft of the electric motor with a clutch assembly. And, configuring the clutch assembly to cause the presenter lead screw to be rotatably driven in response to rotation of the drive shaft upon the electric motor being energized, whereat the extensible member is caused to move against the bias of the biasing member to its extended position, thereby moving the vehicle closure panel to the partially open, presented position, and to decouple the presenter lead screw from the drive shaft upon the electric motor being de-energized, whereat the extensible member is caused to move under the bias of the biasing member to its retracted position.

The method can further include a step of maintaining the end face of the nut and the clutch face of the clutch plate in driving engagement with one another when the electric motor is energized.

The method can further include a step of imparting a torsional bias on the carrier member with a rotary dampener member to fix the carrier member and ultimately bias the nut against rotation about the axis with the clutch lead screw when the end face of the nut and the clutch face of the clutch plate are biased out of driving engagement with one another and overcoming the torsional bias when the end face of the nut and the clutch face of the clutch plate are in driving engagement with one another to cause the carrier member and the nut to rotate about the axis with the clutch lead screw.

In accordance with a further aspect of the disclosure, a method for presenting a vehicle closure panel from a closed position to a partially open, presented position includes providing a presenter unit having an extensible member configured for movement between a retracted position corresponding to the closed position of the vehicle closure panel and an extended position corresponding to the partially open presented position of the vehicle closure panel. Further, providing an electric motor having a drive shaft for rotation about an axis in response to energization of the electric motor. Operably coupling the presenter unit to the drive shaft, and providing a bias for moving the presenter unit from the extended position to the retracted position when the bias transitions from a loaded state to an unloaded state. Further yet, causing the bias to transition from the unloaded state to the loaded state when the motor is energized to cause the extensible member to move from the retracted position to the extended position, and causing the bias to transition from the loaded state to the unloaded state when the motor is de-energized for moving the presenter unit from the extended position to the retracted position.

In accordance with a further aspect of the disclosure, a method for causing a vehicle closure panel to be moved from a closed position to a partially open, presented position includes providing a presenter unit having an extensible member configured for movement between a retracted position corresponding to the closed position of the vehicle closure panel and an extended position corresponding to the partially open presented position of the vehicle closure panel. Providing the extensible member to be biased toward the retracted position with a biasing member. Further, providing an electric motor having a drive shaft configured for rotation about an axis in response to energization of the electric motor, with a clutch assembly being configured to operably couple the presenter unit with the electric motor. Providing the clutch assembly to transition from a disengaged state to an engaged state to operably couple the motor and the presenter unit in response to the electric motor being energized, and to transition from the engaged state to the disengaged state to operably decouple the motor and the presenter unit in response to the electric motor being de-energized.

In accordance with a further aspect, a power-operated presenter actuator mounted to one of the vehicle body and the vehicle door and configured to move the vehicle door between the closed position and the presented position, wherein the power-operated presenter actuator is operated with respect to a function of the state of the motor vehicle.

Further areas of applicability will become apparent from the description provided herein. As noted, the description and any specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

FIG. 1C illustrates an example embodiment of the primary latch assembly shown in FIG. 1B;

FIG. 2 is a diagrammatic view of the front passenger door shown in FIG. 1A, with various components removed for clarity purposes only, in relation to a portion of the vehicle body and which is equipped with the power door actuation system of the present disclosure;

DETAILED DESCRIPTION OF EXAMPLE EMBODIMENTS

Figure 1A:
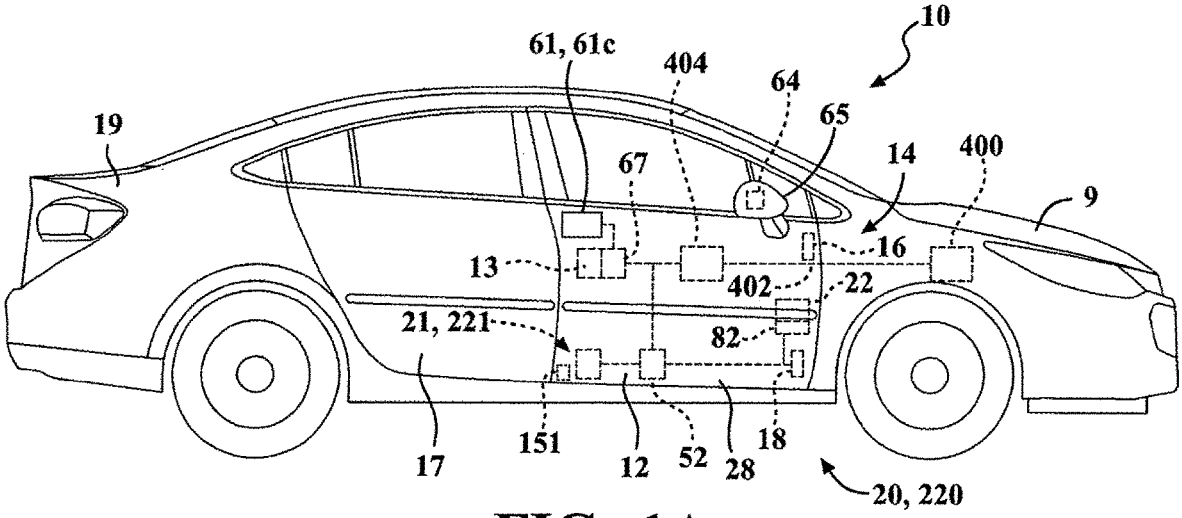
FIG. 1A illustrates an example motor vehicle equipped with a power door actuation system situated between a front passenger swing door and a vehicle body and which is configured to include a compact power door presenter assembly.

In the following description, details are set forth to provide an understanding of the present disclosure. In some instances, certain circuits, structures and techniques have not been described or shown in detail in order not to obscure the disclosure.

In general, example embodiments of a power door actuation system, a closure panel, illustrated as a door module, for a vehicle door and a power-operated door presenter assembly, also referred to as presenter assembly, having a clutch unit, also referred to as clutch assembly, constructed in accordance with the teachings of the present disclosure will now be described more fully with reference to the accompanying drawings.

One or more example embodiments of are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring initially to FIG. 1A, an example motor vehicle 10 is shown to include a first passenger door 12 pivotally mounted to a vehicle body 14 via an upper door hinge 16 and a lower door hinge 18 which are shown in phantom lines. In accordance with the present disclosure, a power vehicle door system, also referred to as door system or power door actuation system 20, is associated with the pivotal connection between first passenger door 12 and vehicle body 14. In accordance with a preferred configuration, power door actuation system 20 includes a power door presenter system including a presenter actuator, also referred to as a presenter assembly 21, a vehicle door ECU 52, a primary latch assembly 13, and can also be configured with a power-operated swing door actuator 22 secured within an internal cavity of passenger door 12 for coordinated control of the opening and closing of the door 12. The motor vehicle 10 is illustrated in FIG. 1A may be provided as not including outside vehicle door handles on the vehicle door 12, and also in an alternate embodiment, outside door handles may be provided, an example of which is described herein below and illustrated in FIG. 1C. A weather seal 3 is provided around the perimeter opening into the cabin 7 along the body 14 for engaging with the door 12 when the door 12 is in the fully closed position, to compress the seal 3 (see FIGS. 13 and 14) there between and provide a weather tight seal against ingress of external environmental conditions, such as road noise and rain and wind. Such a seal 3 generates a seal load on the striker 37 tending to urge the striker 37 out of the fishmouth of the latch assembly 13.

Each of upper door hinge 16 and lower door hinge 18 include a door-mounting hinge component and a body-mounted hinge component that are pivotably interconnected by a hinge pin or post. While power door actuation system 20 is only shown in FIG. 1A in association with front passenger door 12, those skilled in the art will recognize that the power door actuation system 20 can also be associated with any other door, such as rear passenger doors 17 as shown in FIG. 1A, or also be associated with a liftgate (not shown), a hood 9, or a decklid 19. Also, while the door 12 is illustrated herein as being pivotally mounted to the vehicle body 14 for rotation relative to a vertical axis, it may be configured for rotation about a horizontal axis as would be the case for a liftgate, or other offset axis, or the like. For greater clarity, the vehicle body 14 is intended to include the 'non-moving' structural elements of the vehicle 10 such as the vehicle frame, structural support pillars and members, and body panels.

Figure 1B:
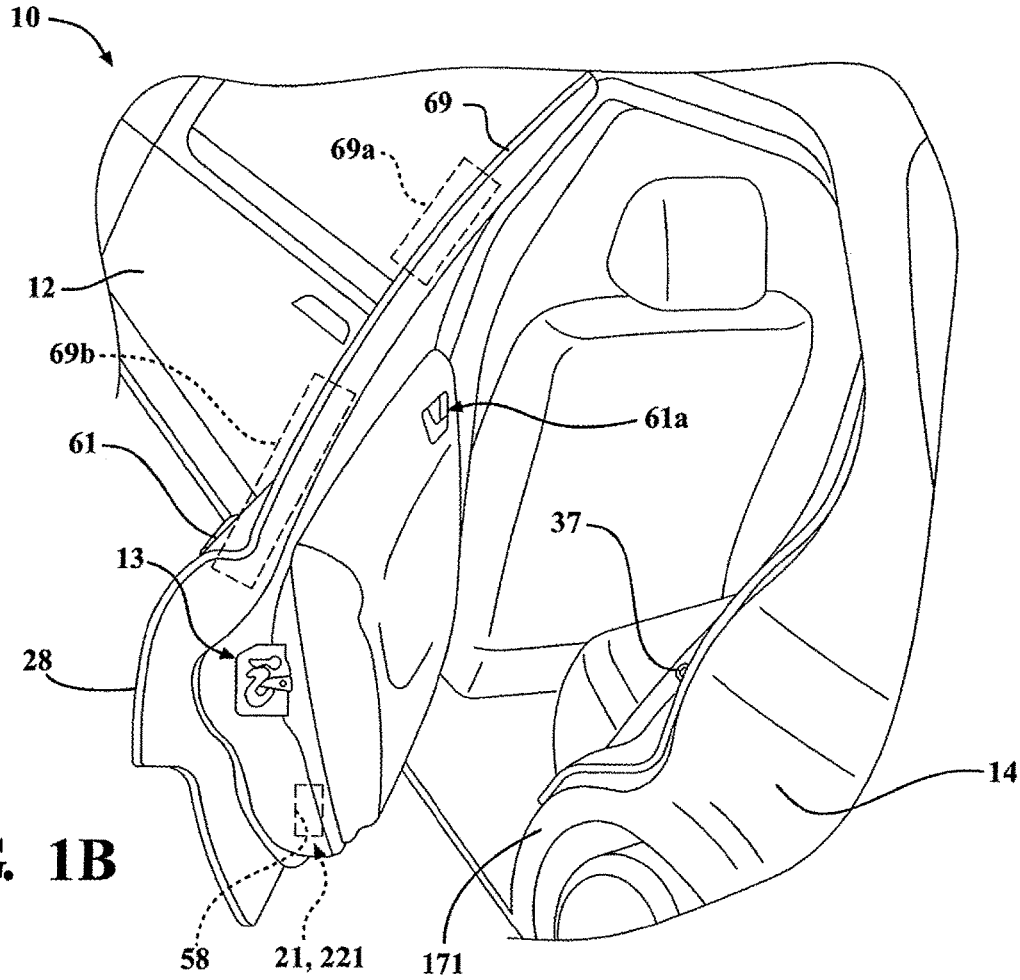
FIG. 1B is a view showing a primary latch assembly and a compact power door presenter installed in a passenger swing door associated with the vehicle shown in FIG. 1A.

Referring to FIGS. 1B and 1C, shown is a non-limiting embodiment of a primary closure latch assembly 13 for vehicle doors 12, 17 of vehicle 10. Closure latch assembly 13 can be positioned on vehicle door 12, 17 and arranged in a suitable orientation to engage a striker 37, mounted on vehicle body 14, when door 12, 17 is closed. Closure latch assembly 13 includes a latch mechanism having a ratchet 26 and a pawl 23, a latch release mechanism having a pawl release lever 25, an inside door release mechanism having an inside release lever 27, a power release actuator 29 for controlling powered actuation of the latch release mechanism, and a power lock actuator 31 having a lock mechanism 33 and an electric lock motor 35. Ratchet 26 is movable between two striker capture positions including primary or fully closed position (shown in FIG. 1C) and secondary or partially closed position (not shown) whereat ratchet 26 retains striker 37, and a striker release position (FIG. 1B) whereat ratchet 26 permits release of striker 37 from a fishmouth provided by a latch housing of primary latch assembly 13. Referring to FIG. 1C, a ratchet biasing member 47, such as a spring, is provided to normally bias ratchet 26 toward its striker release position. Pawl 23 is movable between a ratchet holding position (FIG. 1C) whereat pawl 23 holds ratchet 26 in its striker capture position, and a ratchet releasing position whereat pawl 23 permits ratchet 26 to move to its striker release position. A pawl biasing member 49, such as a suitable spring, is provided to normally bias pawl 23 toward its ratchet holding position.

Pawl release lever 25 is operatively connected to pawl 23 and is movable between a pawl release position whereat pawl release lever 25 moves pawl 23 to its ratchet releasing position, and a home position whereat pawl release lever 25 permits pawl 23 to be in its ratchet holding position. A release lever biasing member (not shown), such as a suitable spring, is provided to normally bias pawl release lever 25 toward its home position. Pawl release lever 25 can be moved to its pawl release position by several components, such as, for example, by power release actuator 29 and by inside door release lever 27. Power release actuator 29 includes a power release motor 51 having an output shaft 53, a power release worm gear 55 mounted on output shaft 53, and a power release gear 57. A power release cam 59 is connected for rotation with power release gear 57 and is rotatable between a pawl release range of positions and a pawl non-release range of positions. In FIG. 1C, power release cam 59 is located in a position that is within the pawl non-release range. Power release gear 57 is driven by worm gear 55 for driving cam 59 which, in turn, drives pawl release lever 25 from its home position into its pawl release position.

Figure 2A:
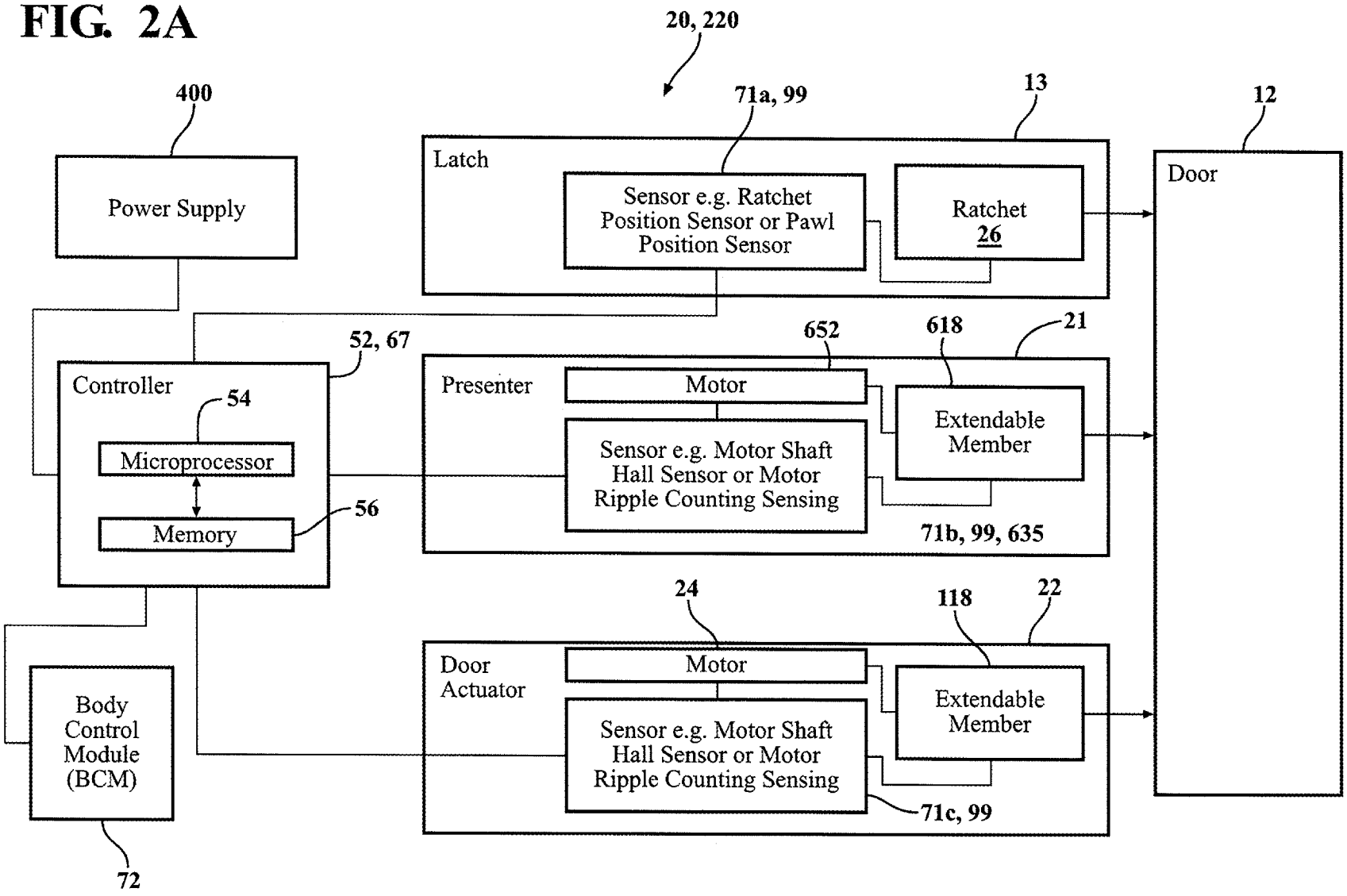
FIG. 2A is a block diagram of the various components of the front passenger door according to aspects of the disclosure.

Power release actuator 29 can be used as part of a conventional passive keyless entry feature. When a person approaches vehicle 10 with an electronic key fob 60 (FIG. 2) and actuates an outside door handle 61, for example, sensing both the presence of key fob 60 and that door handle 61 has been actuated (e.g. via communication between a switch 63 (FIG. 1C) and an electronic latch control unit (ECU) shown at 67 (FIG. 1C) that at least partially controls the operation of closure latch assembly 13). In turn, latch ECU 67 actuates power release actuator 29 to cause the latch release mechanism to release the latch mechanism and shift primary closure latch assembly 13 into an unlatched operating state so as to facilitate subsequent opening of vehicle door 12. Power release actuator 29 can be alternatively activated as part of a proximity sensor based entry feature (radar based proximity detection for example), for example when a person approaches vehicle 10 with an electronic key fob 60 (FIG. 2) and actuates a proximity sensor 61*c*, such as a capacitive sensor, or other touch/touchless based sensor (based on a recognition of the proximity of an object, such as the touch/swipe/hover/gesture or a hand or finger, or the like), (e.g. via communication between the proximity sensor 61*c* (FIG. 1C) and an electronic latch control unit (ECU) shown at 67 (FIG. 1C) that at least partially controls the operation of closure latch assembly 13). In turn, latch ECU 67 actuates power release actuator 29 to cause the latch release mechanism to release the latch mechanism and shift primary closure latch assembly 13 into an unlatched operating state so as to facilitate subsequent opening of vehicle door 12. Also, power release actuator 29 can be used in coordinated operation with power power-operated swing door actuator 22 and presenter assembly 21 of power door presenter system, as further described below.

Figure 3A:
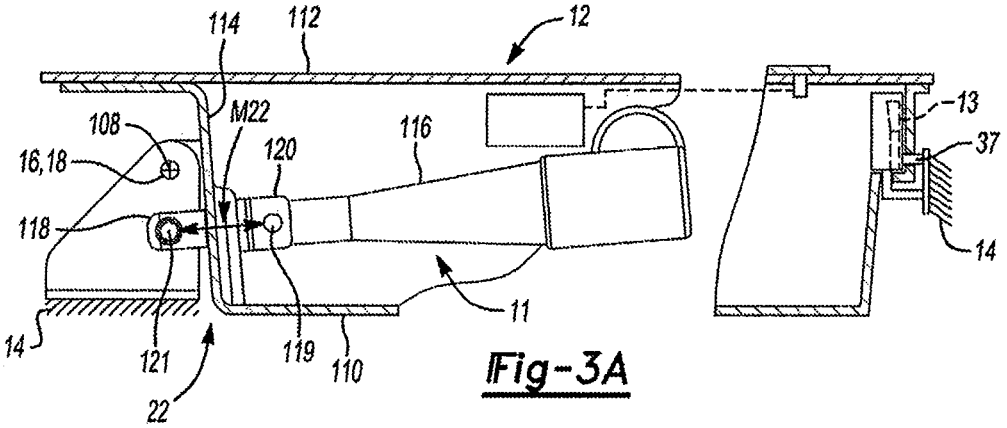
FIGS. 3A, 3B and 3C are schematic views of a power swing door actuator according to a first embodiment of the present disclosure and which is operably arranged between the vehicle body and the swing door for moving the swing door between a closed position, one or more partially-open positions, and a fully-open position, respectively.
Figure 3B:
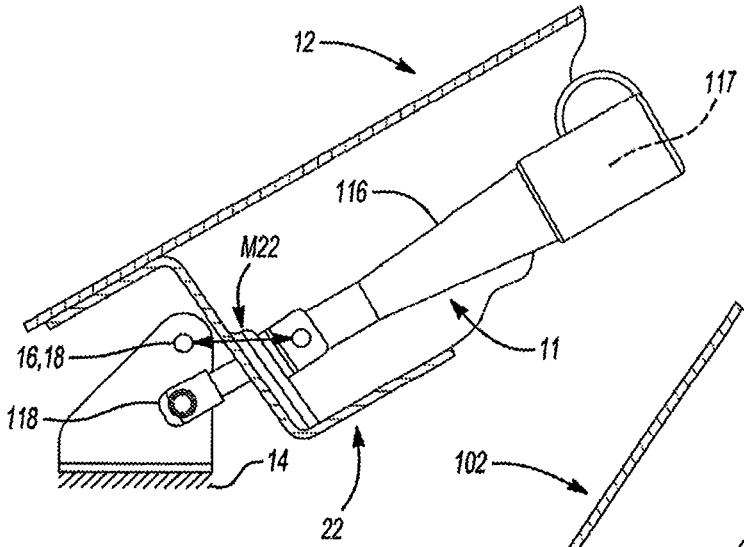
Figure 3C:
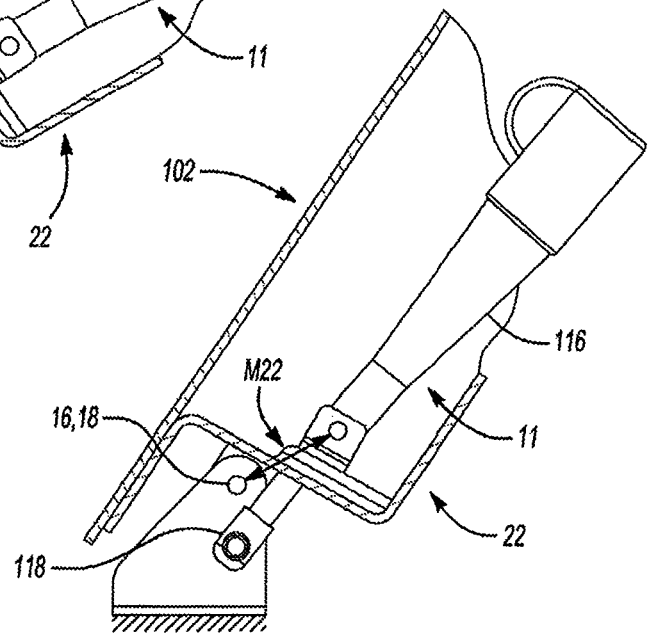
Figure 4:
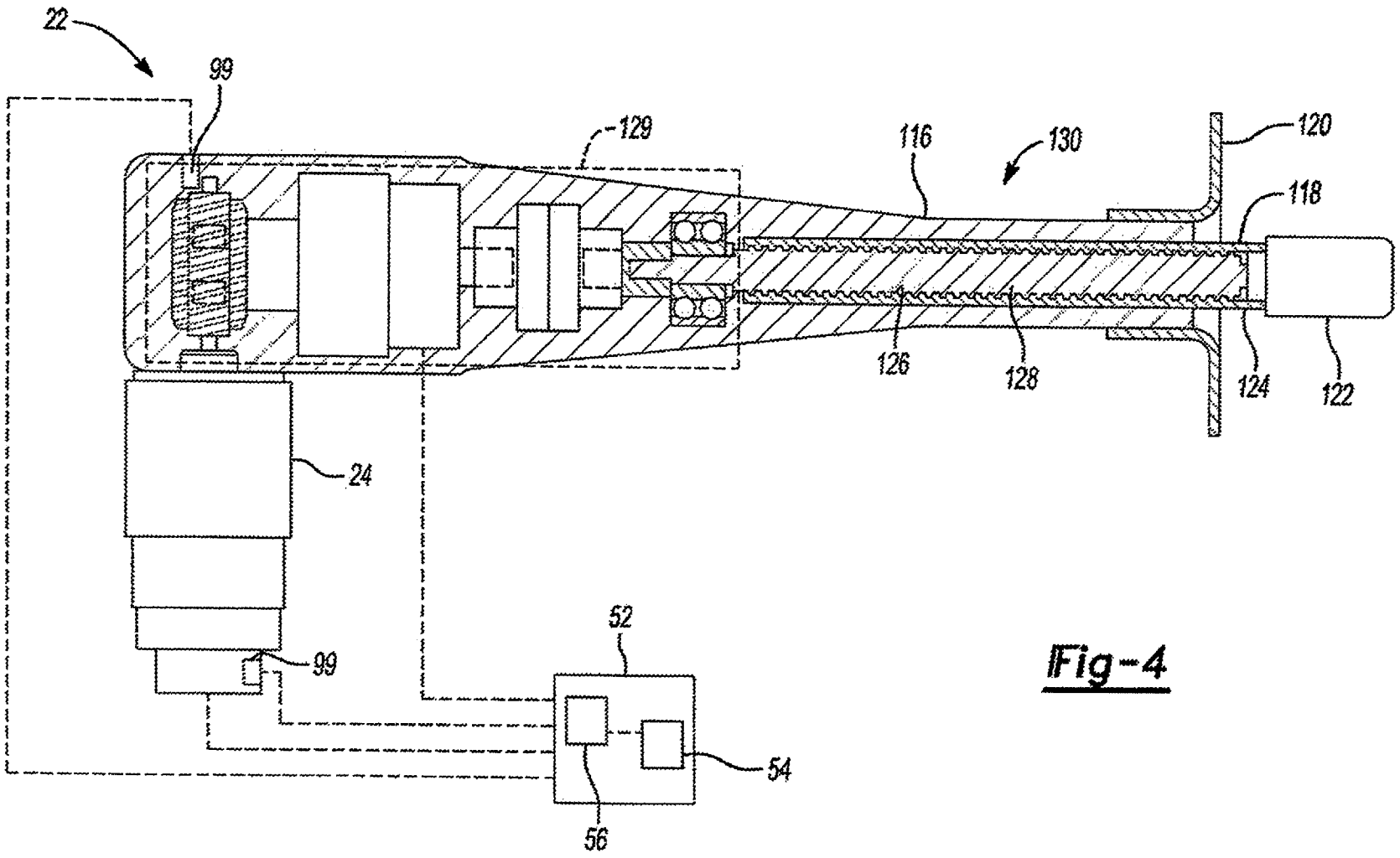
FIG. 4 is a sectional view of the power swing door actuator shown in FIGS. 3A, 3B and 3C.

With reference to FIGS. 3A to 4, power door actuation system 20 can include a power-operated swing door actuator 22 having the features of being typically mounted in door 12 and located near door hinges 16, 18; providing for full or partial open/close movement of door 12 under actuation; providing an infinite door check function; and providing for manual override (via a slip clutch) of power-operated swing door actuator 22, as desired. Power operated swing door actuator 22 can function to automatically swing passenger door 12 about its pivot axis between its open and closed positions. Typically, power-operated swing door actuator 22 can include a power-operated device such as, for example, an electric motor 24 and a rotary-to-linear conversion device 130 that are operable for converting the rotary output of the electric motor 24 into translational movement of an extensible member 118. In many power door actuation arrangements, the electric motor 24 and the conversion device 130 are mounted to passenger door 12 and a distal end of an extensible member 118 is fixedly secured to vehicle body 14 proximal the door hinges 16, 18. Driven rotation of the electric motor 24 causes translational movement of the extensible component 118 which, in turn, controls pivotal movement of passenger door 12 relative to vehicle body 14. As also shown, an electronic control module, or referred herein to as swing door ECU 52, is in communication with electric motor 24 for providing electric control signals thereto for control thereof. Swing door ECU 52 can include hardware such as a microprocessor 54 and a memory 56 having executable computer readable instructions stored thereon for implementing the control logic stored as a set of computer readable instructions in memory 56 for operating the power door actuation system 20.

The distance between the door hinges 16, 18 centerlines 108 and the axis 121 of the power-operated swing door actuator 22 is called the "Moment Arm". Due to the kinematics there may be an inherent increase and decrease of the moment arm during the door swing depending on the geometry of the door hinges 16, 18 centerlines and the axis of the power-operated swing door actuator 22. As a result of the illustrative configuration of the extensible member 118 relative to the door hinges 16, 18, the initial opening of the door 12 from a closed position requires a high torque output by the motor 24 on the extensible member 118 due to the small moment arm M22 between the force applied by the extensible member 118 on the door 12 and the door hinges 16, 18. As the door 12 swings open, the required torque output decreases as the moment arm M22 increases.

FIGS. 3A, 3B and 3C show an embodiment of the power-operated swing door actuator 22 in operation to move the door 12 between a closed position, a mid-position, and an open position, respectively. In the context of the present disclosure, the power-operated swing door actuator 22 may be operated to move the door 12 from a presented position, or assist with the presentment of the door 12 by the presenter assembly 21 of power door presenter system, as will be discussed further herein below. The door 12 includes inner and outer sheet metal panels 110 and 112 with a connecting portion 114 between the inner and outer sheet metal panels 110 and 112. The power-operated swing door actuator 22 has a housing 116 and an extensible member 118. The extensible member 118 is moveable between extended and retracted positions relative to housing 116. The power-operated swing door actuator 22 may be mounted between the inner and outer sheet metal panels 110, 112, in a lengthwise orientation, where the actuator housing 116 is fixed (e.g. permanently fixed, for example using bolts or other fastener types) to the swing door 12 via a bracket 120 mounted to the connecting door portion 114. The extensible member 118 is mounted (e.g. permanently fixed, for example using bolts or other fastener types) to the vehicle body 14 via bracket 123. The power-operated swing door actuator 22 shown in FIGS. 3A-3C includes the extensible member 118 that has a longitudinal axis that is coaxial or concentric with longitudinal axis of the motor 117, and it is recognized as having a footprint of a large lengthwise L packaging dimension requiring to be positioned lengthwise LW within the vehicle door 12.

Referring additionally to the cross-sectional view of the power-operated swing door actuator 22 in FIG. 4, the housing 116 defines a cylindrical chamber in which the extensible member 118 slides. The extensible member 118 has a ball socket 122 at an external end thereof for attachment (e.g. permanent attachment) to the vehicle body 14. The ball socket 122 is connected to a cylindrical tube 124 which has an internal thread 126 proximate an internal end of the extensible shaft 118. The internal thread 126 is engageble with a lead screw 128 driven by the electric motor 24 via a drive train 129 including various gear, clutch and transmission mechanisms, as generally known in the art. The power-operated swing door actuator 22 shown in FIG. 4 includes the extensible member 118 that has a longitudinal axis LE that is non-coaxial and non-adjacent with longitudinal axis LM of the motor 117, and it is recognized as having a smaller lengthwise LW footprint than the power-operated swing door actuator 22 FIG. 3A, however having of a larger widthwise WW packaging dimension requiring a wider width of the door 12 to be packaged within.

Of course, other power-operated swing door actuator configurations may be employed.

Now referring back to FIGS. 1B and 1C, the door 12 may have a conventional opening lever or inside door handle 61*a* located on an interior facing side of the door 12 facing the inside of the passenger compartment for opening the door 12 (e.g. including unlocking and opening the door latch 13, as well as commanding operation of the presenter assembly 21 and/or the power-operated swing door actuator 22). This opening lever or inside door handle 61*a* can trigger a switch 63*a* connected to the latch ECU 67 such that, when the switch 63*a* is actuated, the latch ECU 67 facilitates that the presenter assembly 21 is activated (i.e. the extension member 618 is deployed or extended and thus facilitates powered presentment or movement of the door 12. Subsequent such presentment, the latch ECU 67 may facilitate that the power-operated swing door actuator 22 is activated (i.e. the extension member 118 is deployed or extended) to continue the automatic opening of the door 12. In the alternative, the power-operated swing door actuator 22 may be powered on at a point before the final presentment position is reached so as to provide a seamless transition between the two stages of door opening (i.e. both motors are overlapping in operation for a short time period). Alternatively, the latch ECU 67 may facilitate that the power-operated swing door actuator 22 is operated as a door check (i.e. the extension member 118 is deployed or extended and maintained at such a deployed or extended condition) until the user manually takes control of the door 12 to further open it to a fully opened position.

Now referring back to FIG. 1A, the power door actuation system 20 and the primary closure latch assembly 13 are electrically connected to a main power source 400 of the motor vehicle 10, for example a main battery providing a battery voltage Vbatt of 12 V, through an electrical connection element 402, for example a power cable (the main power source 400 may equally include a different source of electrical energy within the motor vehicle 10, for example an alternator). The electronic latch ECU 67 and/or swing door ECU 52 are also coupled to the main power source 400 of the motor vehicle 10, so as to receive the battery voltage Vbatt; the electronic latch ECU 67 and/or swing door ECU 52 are thus able to check if the value of the battery voltage Vbatt decreases below a predetermined threshold value, to promptly determine if an emergency condition (when a backup energy source may be needed) occurs.

As shown in the schematic illustrations of FIG. 1A and FIG. 2, a backup energy source 404, which may be integrated forming part of an electronic control circuit of the electronic latch ECU 67 and/or swing door ECU 52, or may be separate therefrom, is configured to supply electrical energy to the power door actuation system 20 and/or the primary closure latch assembly 13, and to the same electronic control circuit of the electronic latch ECU 67 and/or swing door ECU 52, in case of failure or interruption of the main power supply from the main power source 400 of the motor vehicle 10. In an illustrative embodiment, electronic control circuit of the electronic latch ECU 67 and backup energy source 404 may be integrated into latch assembly 13. In the event of a failure in a main power supply from the main power source 400, electronic latch ECU 67 and/or swing door ECU 52 may be configured to supply power from the backup energy source 404 to power-operate door presenter assembly 21 for a presentment of the vehicle door 12 to the presented position.

In an illustrative example, the backup energy source 404 includes a group of low voltage supercapacitors (not shown) as an energy supply unit (or energy tank) to provide power backup to the power door actuation system 20 and/or the primary closure latch assembly 13, even in case of power failures. Supercapacitors may include electrolytic double layer capacitors, pseudocapacitors or a combination thereof. Other electronic components and interconnections of a backup energy source 404, such as a boost module to increase the voltage from the backup energy source 404 to an actuator, such as the presenter assembly 21 for example, are disclosed in co-owned U.S. Patent Publication US 2015/0330116, which is incorporated herein by way of reference in its entirety.

Figure 5:
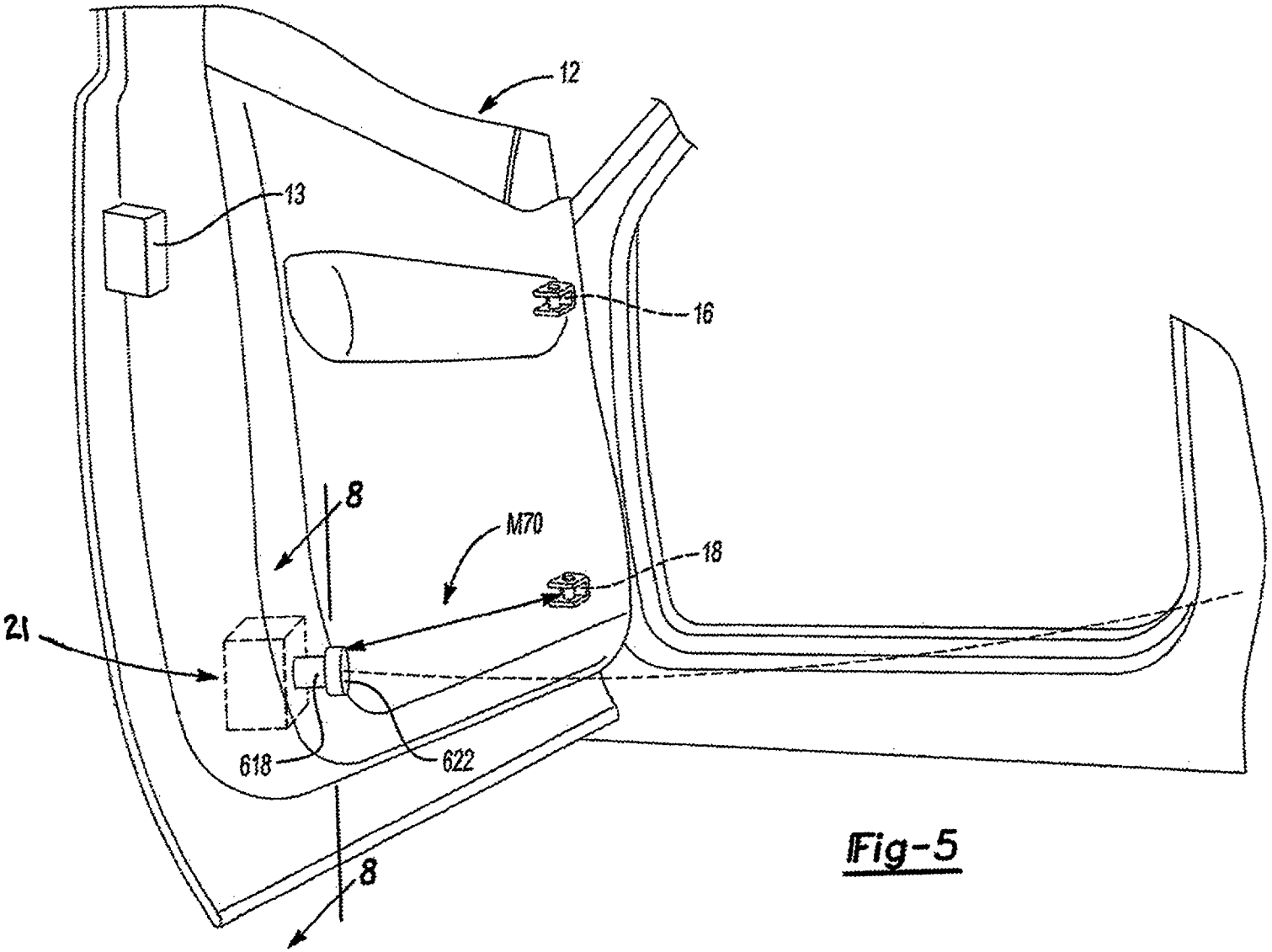
FIG. 5 illustrates the power door actuation system having a compact power door presenter assembly mounted to the vehicle door, in accordance with an illustrative embodiment.
Figure 6:
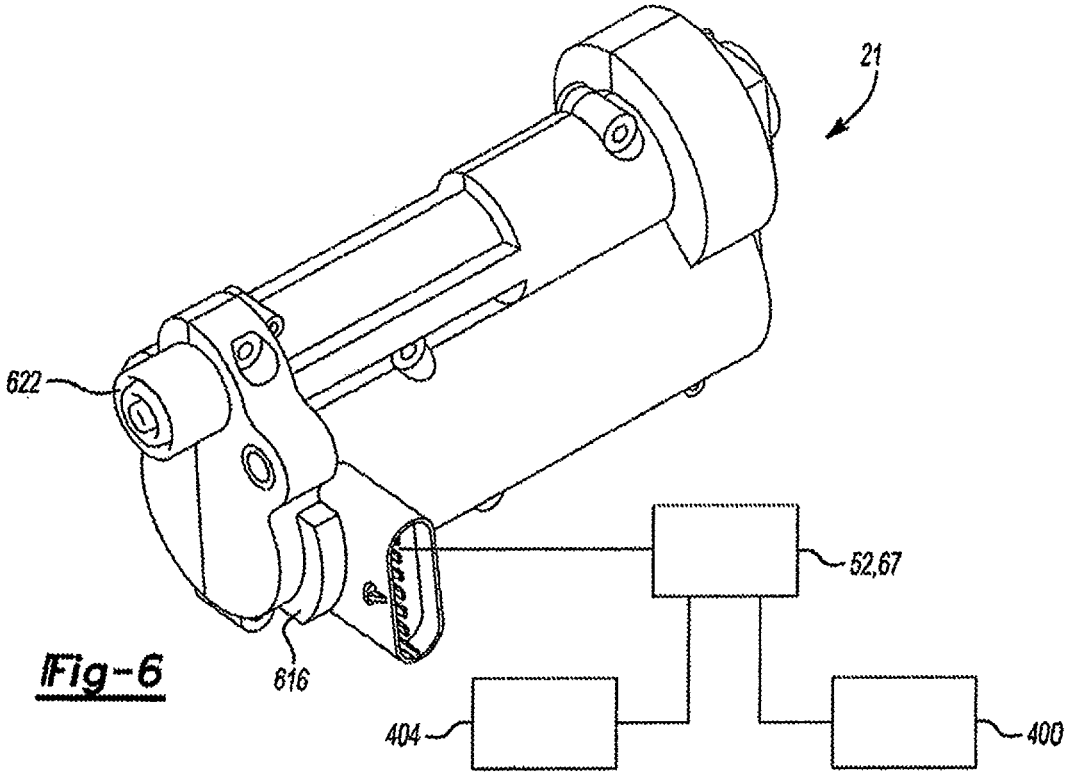
FIG. 6 is a perspective view of the presenter assembly of FIG. 5 in accordance with an illustrative embodiment.
Figure 7:
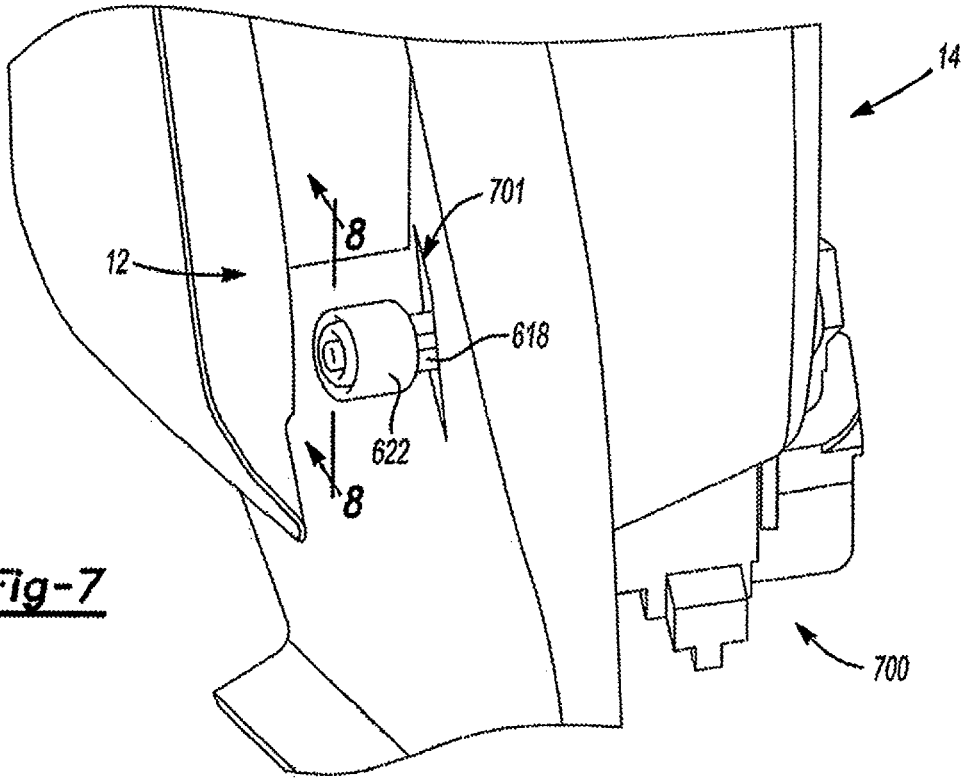
FIG. 7 illustrates the power door actuation system having a presenter assembly mounted to the vehicle body, in accordance with an illustrative embodiment.
Figure 8A:
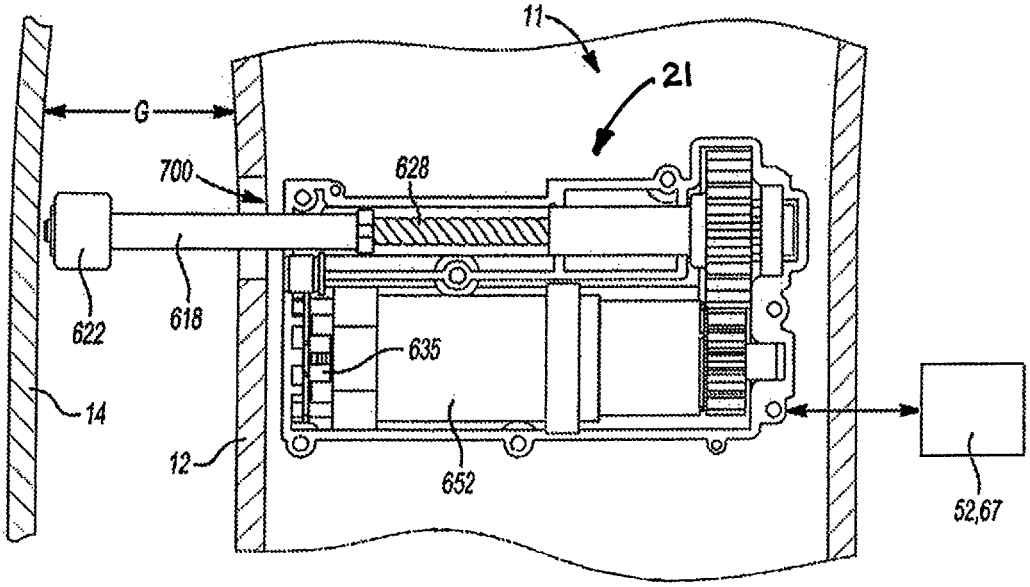
FIGS. 8A and 8B are cross-sectional views of the presenter assembly of the power door actuation system shown in FIG. 5 taken along the line 8-8 of FIG. 5, illustrating the door presenter assembly in a deployed or extended state, and a retracted state, respectively.
Figure 8B:
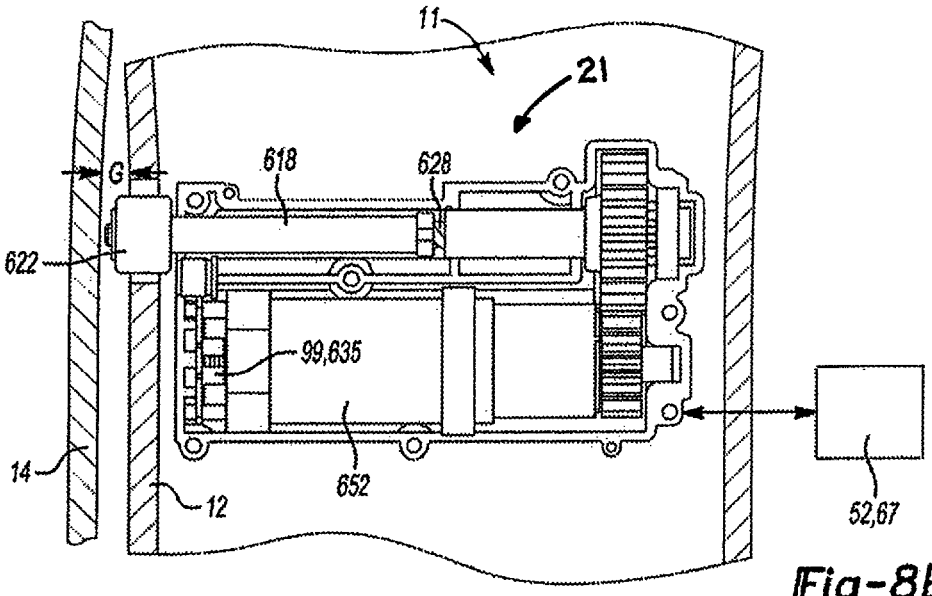
Figure 9:
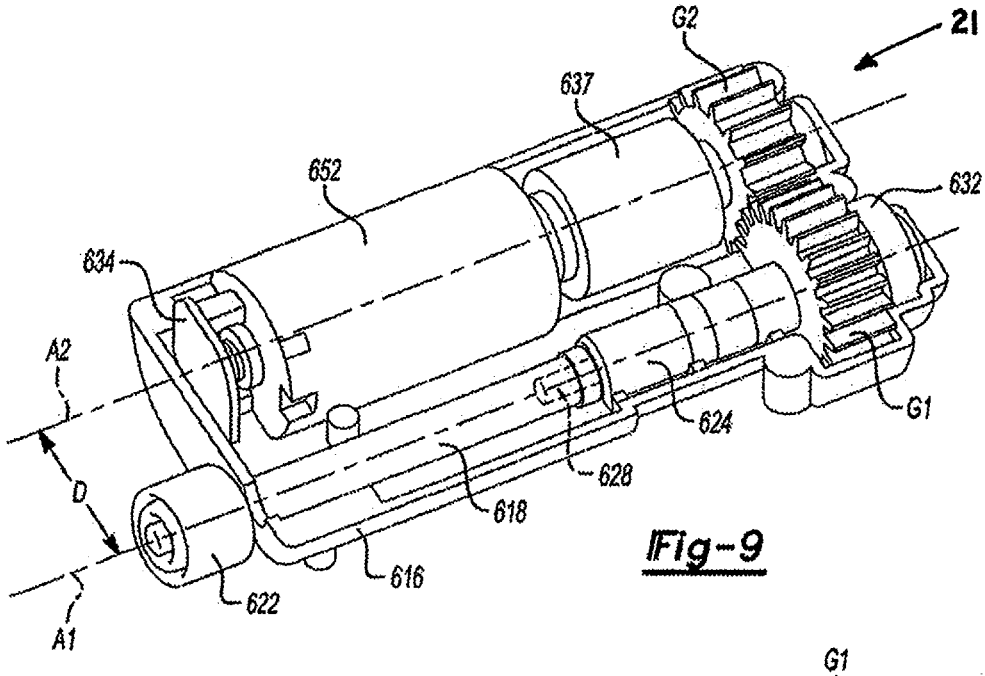
FIGS. 9 and 10 are perspective views of the presenter assembly of FIG. 6, having a housing cover removed to illustrate the various internal components.

Now referring to FIGS. 5, 7 and 9, in addition to FIGS. 1A and 2, in accordance with preferred configurations, a presenter assembly 21 of power door presenter system (which can be configured for door 12 in conjunction with operation of the power-operated swing door actuator 22, or can be configured independently of the operation of power operated swing door actuator 22) generally includes a power-operated door presenter assembly 21 secured within an internal cavity 11 (e.g. for example within or adjacent a pillar 700 of vehicle body 14 as shown in FIG. 7 and therefore associated with vehicle body 14, or alternatively associated with passenger door 12 as illustrated in FIG. 5) and including an electric motor driving 652, and a drive mechanism having an extensible component 618 extendable through a port 701. Driven rotation of the drive mechanism causes controlled translation of the extensible component 618 which, in turn, controls pivotal movement of passenger door 12 relative to vehicle body 14 as the extensible component 618 abuts against the vehicle body 14 in the exemplary configuration of the power-operated door presenter assembly 21 being mounted to the vehicle door 12 as shown in FIG. 5, (or alternatively, the extensible component 618 abuts against the vehicle door 12 in the exemplary configuration illustrated in FIG. 7 showing the power operated door presenter assembly 21 mounted within the vehicle body 14). As such, it is recognized that location of the power-operated door presenter assembly 21 between vehicle body 14 and vehicle door 12 can be at any position, as shown by example or otherwise, as desired.

The power-operated door presenter assembly 21 of power door presenter system 20, as further explained below and as illustrated in FIG. 5, can be located at the bottom of door 12 below primary latch assembly 13 opposite to door hinges 16, 18. Alternatively, the presenter assembly 21 of power door presenter system 20 can be mounted to vehicle body 14 as illustrated in FIG. 7. Preferably, the power-operated door presenter assembly 21 can be located on the vehicle door 12 (or vehicle body 14) at a position away and opposite from the door hinges 16, 18 so as to gain mechanical advantage relative to the hinges 16, 18 thus requiring less force to open the vehicle door 12 from the closed position as would be required if the vehicle door 12 was acted upon at a position nearer the door hinges 16, 18, as is the case for the power-operated swing door actuator 22. Such mechanical advantage can be represented by a moment arm M70, where M70 may be greater than moment arm M22 depending on the location of the power door presenter system 20 relative to the hinges 16, 18.

Figure 11A:
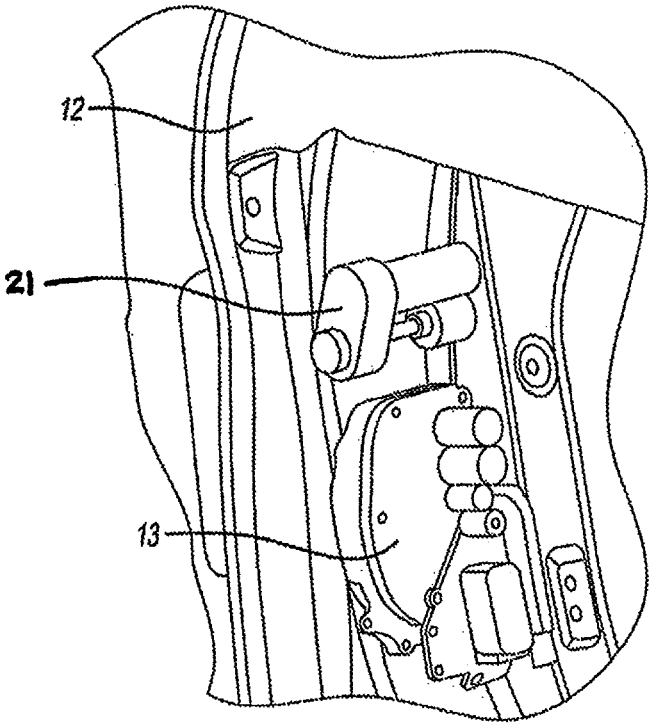
FIGS. 11A and 11B are transparent perspective views of the exterior of a vehicle door and the interior of the vehicle door, respectively, illustrating the positioning of the door presenter of FIG. 6 within the vehicle door, in accordance with an illustrative embodiment.
Figure 11B:
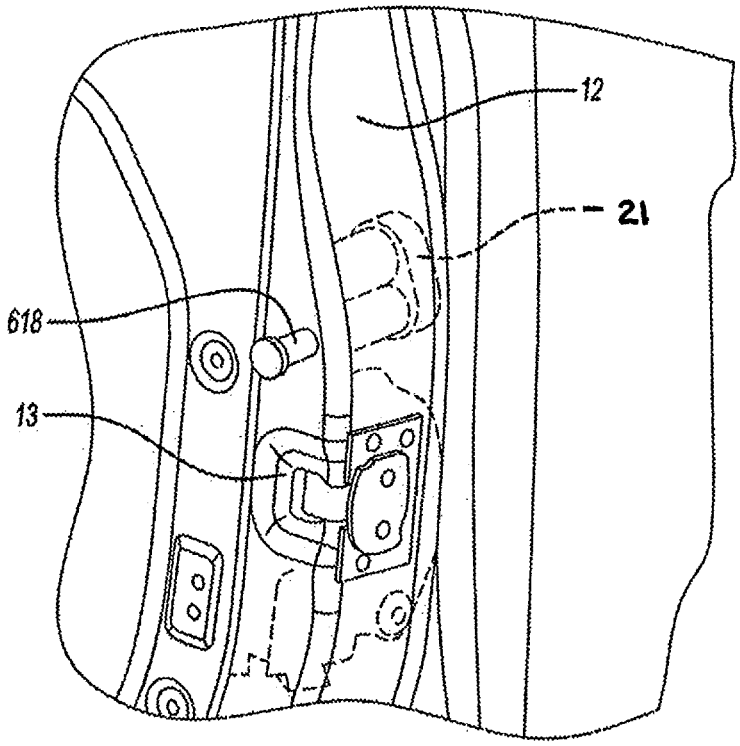

As shown in FIGS. 11A and 11B, an embodiment of power door presenter system 20 is positioned adjacent to a distal end of door 12 near the hem flange at a position above the primary latch assembly 13. Positioning the power door presenter system 20 opposite hinges 16, 18 provides a greater mechanical advantage for a door-moving action and allows exertion of a more effective moving force (e.g. 250 Newtons) or a greater moment arm on the door 12 as compared to the power swing actuator 22. Due to this mechanical advantage, a smaller motor 652 may be employed requiring less power to operate, and correspondingly a smaller back up energy source 404 may therefore be provided to operate the power door presenter system 20 to present the door 12 in the event of a power failure of the main power source 400. Further, due to this increase in mechanical advantage, the power operated door presenter assembly 21 can provide ice breaking functionality as well as assist with the movement of the door 12 in a post-crash condition, where for example the door 12 may be damaged and thus seized or jammed relative to the vehicle body 14 and thus requiring a greater than normal opening force to overcome this state. FIG. 11B illustratively shows extensible member 618 projecting away from the inner sheet metal panel 110 in a perpendicular configuration, it is further recognized that extensible member 618 may project at an angle relative to the inner sheet metal panel 110.

As a result, a smaller more compact and lower energy consuming electric motor 652 can be provided, as well as a more compact, less costly, lower weight, back-up energy source 404 due to the lower energy requirements of the power-operated door presenter assembly 21 required to effectuate a movement of the door 12 from a closed position to a presented position. Also, the power door actuation system 20 can now be operated as follows: since power door presenter system 20 can provide for a partial open/close movement, or presentment, of door 12, the power-operated swing door actuator 22 can be deactivated during such movement of the door, and activated after the presentment for either continued movement or door checking functionality. Since the power door presenter system 20 now assumes the task of overcoming the initial high torque movement the power-operated swing door actuator 22 would normally assume if operating without coordination with the power door presenter system 20, the motor 24 can be reduced in size providing cost and weight savings. As a result, a less powerful electric motor 24 can be provided with the power-operated swing door actuator 22 as the power-operated swing door actuator 22 may be controlled to subsequently operate to move the door 12 from the presented position to other partially opened or fully opened positions whereat the mechanical advantage for the power-operated swing door actuator 22 is greater than when the door 12 is in its closed position. Alternatively, the power-operated swing door actuator 22 and the power door presenter system 20 can be operated in conjunction to present the door 12. As such, actuation of power door presenter system 20 can provide for coordinated and controlled presentment and opening of door 12 in conjunction with power-operated swing door actuator 22.

While the door 12 can be employed as part of a door system including an outside door handle 61, the power door presenter system 20 can be employed for coordinated and controlled presentment of door 12 to a user requesting opening of the door 12 in the configuration of the door 12 without a door handle, for example having a proximity sensor 61*c* in lieu of an outside door handle 61. In such a configuration, the presentment of door 12 would be sufficient to move the door 12 away from the vehicle body 14 so that the fingers of the user exterior the vehicle 14 can be slipped between the vehicle body 14 and the door 12 to grasp, for example about door edge 69 as illustratively shown at possible handle regions 69*a* and 69*b* in FIG. 1B, and to subsequently pull the door 12 to open it. The power door presenter system 20 can also be employed for coordinated and controlled presentment of door 12 to a user requesting opening of the door 12 using inside door handle 61*a*. In all configurations, the presentment of door 12 may be sufficient to move the door 12 away from the vehicle body 14 to break through any ice build-up 89 on door 12 and vehicle body 14 tending to prevent a door 12 from easily opening i.e. acting as an ice breaker function. In all configurations, the presentment of door 12 would be sufficient to move the door 12 away from the vehicle body 14 overcoming the larger force moments required to move the door 12 from the closed position to the presented position as would be required to be overcome by the power-operated swing door actuator 22 operating without the coordination of power door presenter system 20.

Now referring back to FIGS. 2 and 2A, illustrated are one or more sensors 71 communicating with swing door ECU 52 for providing requisite information. It is recognized that sensors 71 can be any number of sensor types (e.g. Hall sensor, presence sensors such as anti-pinch strips, capacitive, ultrasonic, radar, mechanical switches, location sensors, etc.). For example, the latch 13 can include sensor 71*a* (FIG. 2A) coupled to the ratchet 26 and/or pawl 23 (e.g., a ratchet position sensor or pawl position sensor). The electric motor 24 of power-operated swing door actuator 22 can include a sensor 71*b* (FIG. 2A) coupled thereto (e.g., a motor shaft Hall sensor or motor ripple count sensing) for monitoring a position of vehicle door 12 during movement between its open and closed positions. Similarly, the power-operated swing door actuator 22 can also include sensor 71*c* (FIG. 2A) coupled to the motor 24 and/or extensible member 118 (e.g., a motor shaft Hall sensor or motor ripple count sensing). As is also schematically shown in FIG. 2, swing door ECU 52 can be in communication with remote key fob 60 via a fob trans-receiver module 600 or an internal/external handle switch 63, 63*a*, or proximity sensor 61*c* for receiving a request from a user to open or close vehicle door 12. Put another way, swing door ECU 52 receives a command signal from either remote key fob 60 and/or internal/external handle switch 62, and/or proximity sensor 61*c* to initiate an opening or closing of vehicle door 12. It is also recognized that a body control module 72 (having memory with instructions for execution on a computer processor) mounted in vehicle body 14 of vehicle 10 can send the open or close request to swing door ECU 52 and electronic latch ECU 67. ECU 52 may be integrated with, for example share a common housing or enclosure, with latch 13. Power Supply 400 may also be directly coupled to the latch 13, presenter 21, and/or door actuator 22 for also providing power thereto.

It is recognized that other than outside handle switch 63, swing door ECU 52 can be in communication with a number of other sensors 71*a*, 71*b*, 71*c*, 99 in the vehicle including in power-operated swing door actuator 22, in power door presenter system 20, and in primary latch assembly 13. As mentioned, switches or the latch sensor 71*a* of primary latch assembly 13 can provide information to latch ECU 67 as well as swing door ECU 52 (i.e. the switches or latch sensor 71*a* provide positional information to swing door ECU 52 of the location/state of door 12 with respect to position at or between the fully closed or latched position, secondary or partially closed and the partially open or unlatched position). Again, the sensors 71*b* of door presenter assembly 21 can provide information to latch ECU 67 as well as swing door ECU 52 (i.e. the sensors provide positional/operational information to swing door ECU 52 of the location/state of extensible member 618 of the door presenter assembly 21 with respect to position at or between the fully deployed or retracted position, or there in between, or motor operation such as speed, current draw, etc.). Obviously, a single ECU can be used to integrate the functions of door ECU 52 and latch ECU 67 into a common control device located anywhere within door 12, or vehicle body 14.

Swing door ECU 52 can also receive an additional input from a proximity sensor 64 (e.g. ultrasonic or radar) positioned on a portion of vehicle door 12, such as on a door mirror 65, or the like, as shown in FIG. 1A. Proximity sensor 64 assesses if an obstacle, such as another car, tree, or post, is near or in close proximity to vehicle door 12. If such an obstacle is present, proximity sensor 64 will send a signal to swing door ECU 52, and swing door ECU 52 will proceed to turn off electric motor 24 and/or electric motor 652 to stop movement of vehicle door 12, and thus prevent vehicle door 12 from hitting the obstacle.

A non-limiting embodiment of power door presenter system 20 will now be described with reference to FIGS. 5 through 13 to generally include a power door presenter assembly 21. In general, power door presenter assembly 21 is adapted to be rigidly secured to vehicle body 14 or the vehicle door 12, such as by securing a housing 616 encapsulating the various components of the power presenter assembly 21 as will be further described herein below.

In FIGS. 6 to 10, a non-limiting embodiment of a power door presenter assembly 21 is shown. The power door presenter assembly 21 has a housing 616 defining a cylindrical chamber in which an extensible member 618 slides. The extensible member 618 can be configured having an external distal end as discussed for any of the above embodiments, and is shown, by way of example and without limitation, as having a bumper, such as an elastic bumper 622 for abutment with the vehicle body 14. The power swing door assembly 21 further includes an internally threaded cylindrical tube 624 which is rotatably connected to a lead screw 628 connected to a proximal end of the extensible member 618. The lead screw 628 is threadingly matable with the internally threaded cylindrical tube 624, also referred to as nut tube or nut 624, to permit relative rotation and translation between lead screw 628 and the nut tube 624. The extensible member 618 is non-rotatably and axially moveable on leadscrew 628 between a retracted position (FIGS. 8B and 10) and an extended position (FIGS. 8A and 12) relative to housing 616. When extensible member 618 is located in its extended position (FIGS. 8A and 12), door 12 is urged into a partially opened deployed or "presented" position. The configuration of the lead screw 628 and nut 624 i.e. the thread pitch angles and geartrain unit are such so as to provide a manual reversibility of extensible member 618 from the deployed position to its retracted position, for example by urging the extension member 618 towards its retracted position by a closing of the door 12 abutting the elastic bumper 622.

Figure 10:
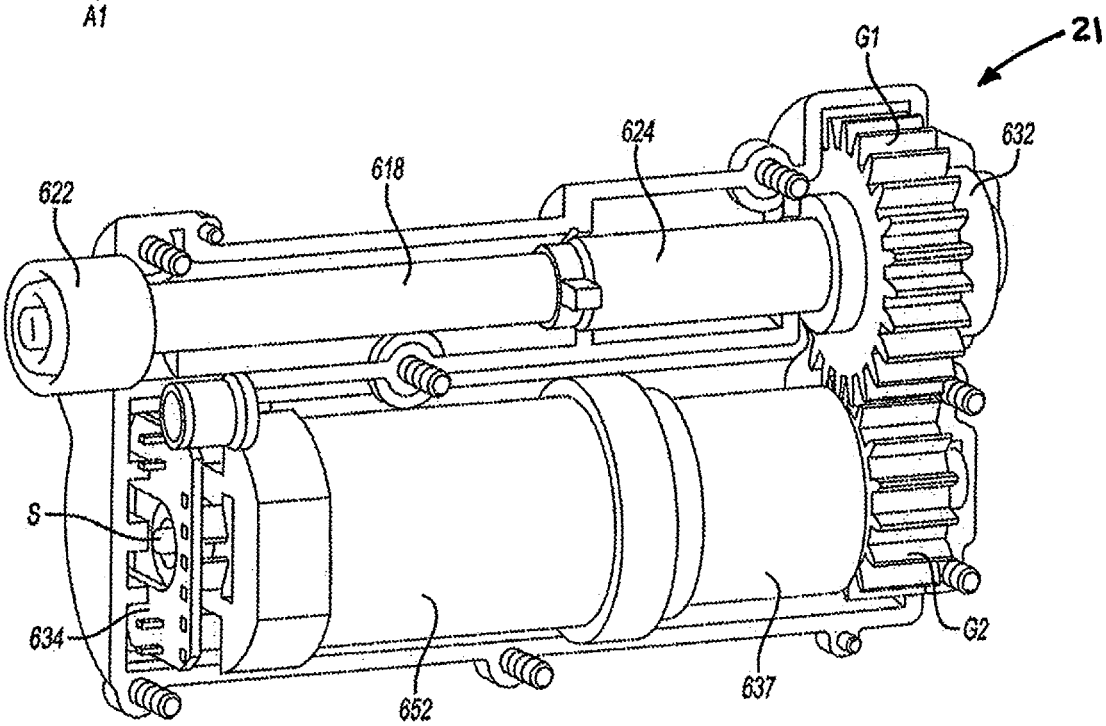
Figure 12:
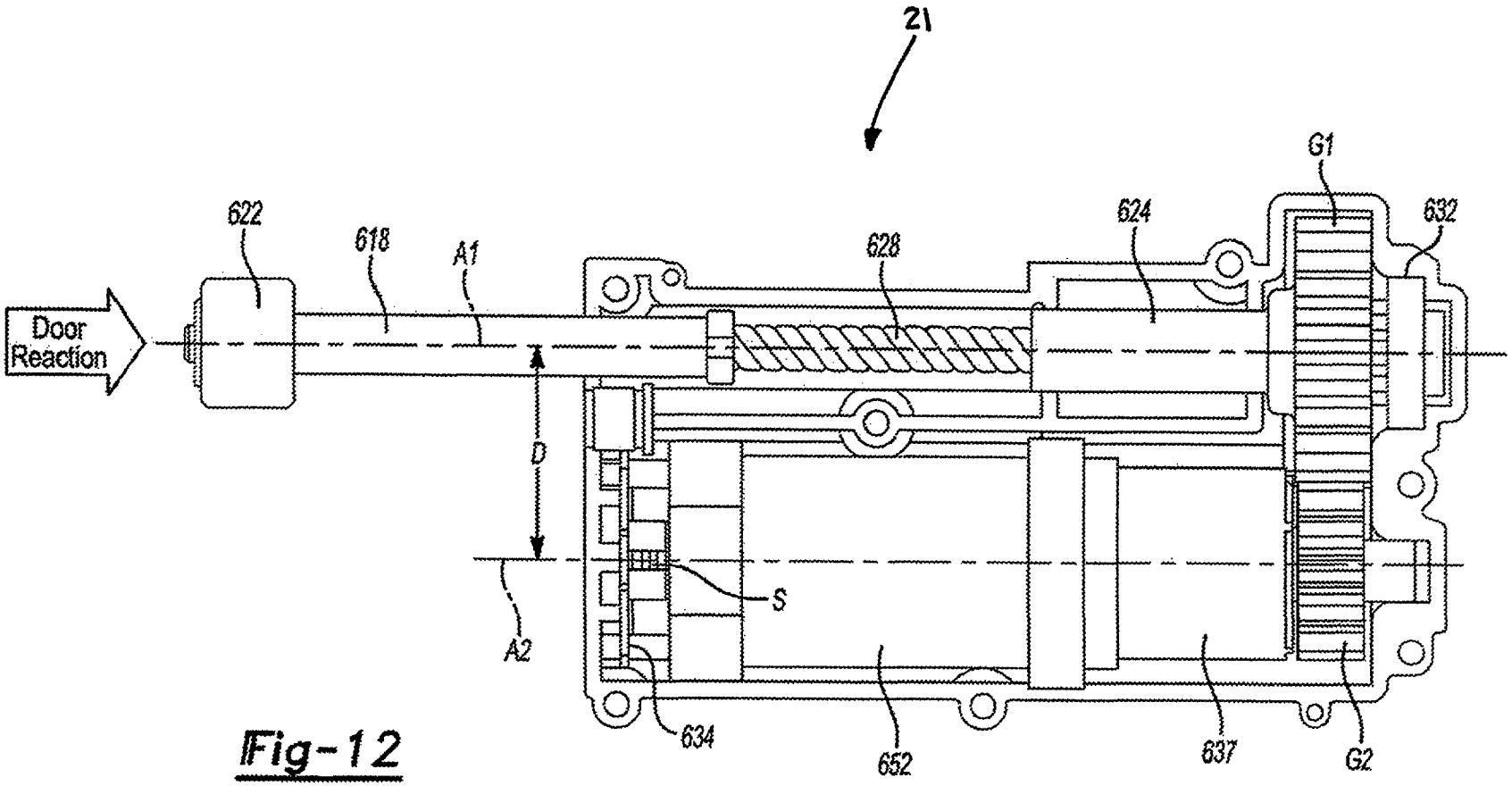
FIG. 12 is a view similar to FIG. 8A with the extensible member thereof shown in an extended state, illustrating the application of a force to return the extensible member to a retracted position.

In the embodiment shown in FIGS. 10 and 12, because the nut tube 624 is fixedly attached to a driven gear G1 for rotation in the housing 616 but is prevented from linear translation, as the driven gear G1 rotates in meshed engagement with a drive gear G2 in response to selective actuation of a motor 652, the nut tube 624 rotates, thereby causing the lead screw 628 and extensible member 618 fixed thereto to translate linearly along a first axis A1, causing the extensible member 618 to move with respect to the housing 616. Since the extensible member 618 is configured in this illustrated embodiment for abutment with the vehicle body 14 and the housing 616 is connected to the door 12, movement of the extensible member 618 causes the door 12 to pivot relative to the vehicle body 14. The lead screw 628 and the nut tube 624 thereby define a spindle-type rotary-to-linear conversion mechanism.

The lead screw 628 is rotatably connected to the nut tube 624 that is journaled in the housing 616 via any suitable bearing 632 that provides radial and linear support for the nut tube 624. A PCB 634 with sensor, such as a Hall-effect sensor 635, by way of example and without limitation, is mounted about a shaft S of the motor 652. The sensor 635 can detect motor shaft rotations and convert detected rotations into an absolute linear position electrical signal so that the linear position of the extensible member 618 is relatively known. In alternative embodiments, the sensor 635 can be provided as discussed above, such by a linear encoder which reads the travel between components that move relative to one another, so that the linear position of the extensible member 618 is known with certainty, even upon power up.

The motor shaft S is connected to a geartrain unit, also referred to as planetary gear box 637 for providing a gear reduction between the motor shaft S and the drive gear G2. The gear box 637 may be operably connected to a clutch unit that is normally engaged and can be energized to disengage to facilitate reversal of door presenter assembly. Further discussion here with regard to the clutch unit, given the discussion above, is believed unnecessary.

The motor 652 and the extensible member 618 are packaged within the housing 616 to provide a compact assembly having a minimal outer envelope, and in particular a minimized length (when compared to a configuration having the extensible member 618 and the motor 652 in a series arrangement having their longitudinal axes aligned), thereby requiring reduced space in which to mount the power swing door assembly 21. For example, in mounting positions in the vehicle door 12, the width of the door 12 can be correspondingly reduced due to the compact length of the power swing door assembly 21 (e.g. approximately half when compared to a series arrangement). In an illustrative embodiment, housing 616 may be integrally formed with the housing of latch assembly 13, such that integrated power door presenter assembly 21 is integrated within latch assembly 13 (e.g. share the same housing for easy installation into the vehicle door 12 as a single unit). To provide the minimal outer envelope of the housing 616, the motor shaft S is oriented to extend along a second axis A2 that is parallel or substantially parallel (meaning that the axes A1, A2 may be slightly off parallel, such as by a few degrees) with one another. Further, the motor 652 and extensible member 618 are immediately adjacent, that is side by side, one another in laterally aligned and spaced relation by a distance D equal to the sum of the radii of the driven gear G1 and drive gear G2. Providing the axis of the motor 652 not co-axial or not concentric with the axis of extensible member 618 in a configuration whereby the longitudinal length of the actuator would be the sum of the longitudinal lengths of the motor 652 together with the extensible member 618 as an example showing in FIG. 3A, results in the reduction of the longitudinal length of the power-operated door presenter assembly 21, allowing the power door presenter system 20 to be packaged in a widthwise direction within vehicle door 12 without requiring any vertical packaging space above or below the power door presenter system 20 when installed in the door, as a configuration in FIG. 4 would require. Providing the extensible member 618 and motor 652 in a non-concentric and adjacent arrangement results in a further reduction of the longitudinal length of the power-operated door presenter assembly 21.

With reference to FIG. 12, the motor shaft S extends away from the motor 652, for example to the right in FIG. 12, along the second axis in a first direction, illustrated as arrow D1, and the extensible member 618 is moveable from the retracted position to the extended along the first axis in a second direction illustrated as arrow D1 pointing towards the left, different than the first direction 1D. Illustratively, the motor 652 and the extensible member 618 are positioned adjacent one another in a side by side configuration on the same common side (e.g. on one side, that is the left side) of the gears G1, G2. Gears G1, G2 form a gear train or transmission train 631 configured to transmit torque from the motor shaft S to the extensible member. Optionally the gear train 631 may be configured to be back driveable to transmit torque from the extensible member to the motor shaft, for example via rotation of the nut tube 624 imparted by a linear movement of the extensible member, illustratively towards the right in FIG. 12.

Upon receiving a present command, swing door ECU 52 can provide a signal to electric motor 652 in the form of a pulse width modulated voltage (for speed control) to turn on motor 652 and initiate pivotal opening movement of vehicle door 12 towards its partially open deployed position (i.e. presented position) (recognizing that primary latch assembly 13 is already in its unlatched state as further discussed below) via extension of extensible member 618. While providing the signal, swing door ECU 52 can also obtain feedback from sensors 64,71 to ensure that contact with an obstacle has not occurred or occurring as would be the case if an object or person is leaning upon the vehicle door 12 or otherwise that the user is present (e.g. is manually in charge of door 12). If no obstacle is present, motor 652 will continue to generate a rotational force to actuate spindle drive mechanism and thus extension of extensible member 618 until certain door positions are reached (e.g. 50 mm open position) or otherwise indicate that the user is present (e.g. hand is on the presented door 12 at the handle regions 69*a* and 69*b* for example). Once vehicle door 12 is positioned at the desired location, motor 652 is turned off. The user may then take control of door 12, or the vehicle door 12 can be automatically opened by swing door ECU 52 commanding power-operated swing door actuator 22. Otherwise, upon signaling of manual control of door 12 by the user, the extensible member 618 may be retracted by door ECU 52 actuating the motor 652 in the reverse direction. In the case of a power failure, the extensible member 618 may be easily retracted by a user closing the door to urge the extensible member to its retracted position. Swing door ECU 52 may control both power-operated door presenter assembly 21 and power-operated swing door actuator 22 in a coordinated manner. For example, swing door ECU 52 may control power-operated door presenter assembly 21 over a first range of motion (e.g. from a fully closed to a presented position of the vehicle door 12), and then swing door ECU 52 may control power-operated swing door actuator 22 over a second range of motion during which power-operated door presenter assembly 21 is not powered. In another example swing door ECU 52 may control both power-operated door presenter assembly 21 and power-operated swing door actuator 22 over a first range of motion (e.g. from a fully closed to a presented position of the vehicle door 12) to provide for increased door moving force to overcome ice buildup 89, or to overcome the inherent high torque requirement for moving the door 12 from the closed position due to the small moment arm M22. As a result both the motor output, power requirements and therefore size of power-operated swing door actuator 22 and power-operated door presenter assembly 21 may be reduced, as both will be operating in tandem, and in particular since power-operated door presenter assembly 21 will be acting at leveraged position on vehicle door 12 away from the hinges 16, 18 thereby gaining mechanical advantage compared to the more closely coupled swing door actuator 22. The user may then take control of door 12, or the vehicle door 12 can be automatically opened by swing door ECU 52 commanding power-operated swing door actuator 22.

Figure 13:
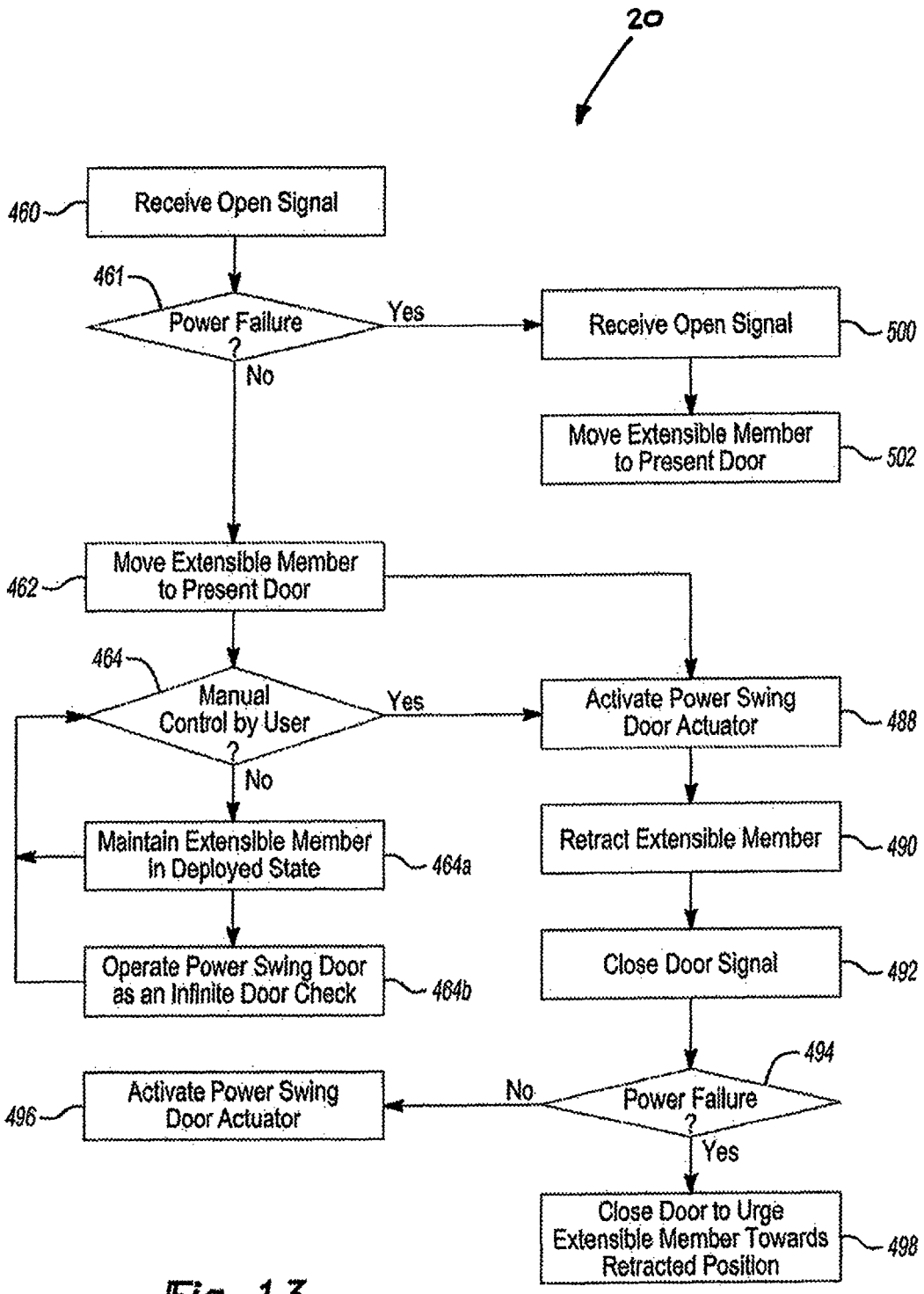
FIG. 13 is a flowchart for operation of the power door presenter system in accordance with an illustrative embodiment.

An example operation of the embodiment of power door presenter system 20 to present the door 12, which could include only operation of the power-operated door presenter assembly 21 operating to move the door 12 in lieu of power-operated swing door actuator 22, if desired, is shown in the flowchart of FIG. 13.

Specifically, at step 460, latch controller 67 or swing door ECU 52 (or by another vehicle control module—not shown) receives a signal for opening of door 12 e.g. via a door handle/button operation, key fob, or a proximity sensor activation). Latch controller 67 or swing door ECU 52 (or by another vehicle control module—not shown) sends a signal to the door presenter assembly 21 to cause actuation of the motor 652. The swing door ECU 52 (or other vehicle control module, ECU 67 for example) can also command release of the primary latch assembly 13 while holding primary latch assembly 13 in its unlatched state until resetting of the power door presenter system 20 once striker 37 leaves the fishmouth. Holding the primary latch assembly 13 in the unlatched state allows the striker 37 to remain disengaged from the ratchet 21 for movement from the fishmouth of primary latch assembly 13 when extensible member 618 pushes striker 37 out of the fishmouth of primary latch assembly 13 due to further extension of the extensible member 618 in subsequent steps. Optionally, the latch controller 67 or swing door ECU 52 (or by another vehicle control module—not shown) may send a signal to power-operated swing door actuator 22 to cause actuation of the motor 24 in tandem (e.g. simultaneously) with operation of the motor 652, as in step 488. Alternatively, the swing door ECU 52 (or other vehicle control module, ECU 67 for example) can also command release of the primary latch assembly 13 subsequent the next step 462 now described below. Delaying release of the primary latch assembly 13 may allow the extensible member 618 time to move from its retracted position to a partially presented position for immediate action upon the vehicle door 12 after a power release command is issued to the primary latch assembly 13. This may reduce the likelihood of the pawl 23 returning to a ratchet holding position after having been moved to the striker release position in response to a power release command, which may assist in the scenario where any seal load tending to pull the striker 37 out of the fishmouth is negated, for example as a result of an ice buildup 89 between the vehicle door 12 and the vehicle body 14, not resulting in the ratchet 26 moving out of its striker capture position and into a state where the pawl 23 is not able to reengage the ratchet 26 in the ratchet holding position under influence of the pawl biasing member 49. As a result, the pawl 23 would be reengaged with the ratchet 26 subsequent a power release such that upon actuation of the extensible member 618 to engage with the vehicle door 12, the door 12 will be secured to the vehicle body 14 by the latch assembly 13, resulting in the door not being moved to the presented position. Delaying release of the primary latch assembly 13 at a moment when the extensible member 618 has already moved from its retracted position to a partially deployed position (see FIG. 15) adjacent (e.g. at a subsequent moment), or in contact (e.g. at a simultaneous moment) with the vehicle door 12 will provide for the either an additional force on the ratchet 26 simulating a seal loading, or allow for the ice buildup 89 to be overcome by movement of the door 12 due to urging of the extensible member 618 thereupon to assist the seal load to subsequently act upon the striker 37 to disengage the ratchet 26 and prevent the pawl 23 from reengaging with the ratchet 26 subsequent a power release.

At step 462, and if no power failure of the main power supply 400 has been detected at step 461, the extensible member 618 may be deployed from its retracted position to move the door 12 to a presented position. It is recognized that at step 462, primary latch assembly 13 is released (e.g. via a powered or manual release) in order for door 12 to be moved by the power door presenter system 20. At step 462, the extensible member 618 will be deployed from its retracted position operable to "present" the door 12 by opening it (i.e. by contacting the bumper 622 on either the vehicle door 12 or the vehicle body 14 to impart a reactive opening force on the vehicle door 12) only by a predetermined amount (such as, for example, 30-50 mm) from a closed position to a partially-open, presented, position so as to allow subsequent manual movement of the door to its fully-open position. During the presentment operation, the power door presenter system 20 may also provide an ice breaker force to break through any ice build-up 89 around the door 12 and vehicle body 14 which may prevent the door 12 from moving away from its closed position and which may seize the door 12 shut and be difficult to overcome for a user within the passenger compartment 7.

Once presented, at step 464, swing door ECU 52 waits for a specified period of time to receive a signal from the sensors representing that the user has control (e.g. is manually moving) of door 12. Also, at this time and at step 464, swing door ECU 52 can start polling sensors (e.g. Adjustable Pressure Switch (APS) or other sensing technology) for a manual opening of door 12 by the user and thereby continue checking throughout the extension of extensible member 618. In this case, the sensors to detect manual control can be an anti-pinch strip type sensor that runs the periphery of the door 12 and is activated by contact when manually grabbing door 12, e.g. activation of a manual switch or pressure sensor or other sensing technology or via a capacitive, optical, ultrasonic, or other contact or non-contact sensor can also be used.

Further, once the extensible member 618 is deployed and the door 12 is in the open position, at step 464*a*, electric motor 652 is not actuated and power door presenter system 20 remains in the deployed state (i.e. door is presented), thus facilitating opening of door 12 manually by the user i.e. (the door 12 has been sufficiently moved so as to create a gap G (see FIG. 8A) between the door 12 and the vehicle body 14 to allow the users fingers sufficient space to insert and grasp handle regions 69*a* and 69*b* shown in FIG. 1B, to subsequently pull the door 12 to open it. Also, by maintaining the extensible member 618 in is deployed (e.g. operating the motor 652 in a stall condition, with continuous supply of power), the safety feature of ensuring the users fingers don't get pinched between the door 12 and the vehicle body 14 is provided (i.e. blocking action of the power door presenter system 20), in the case of a gust of wind, vehicle parked on a slope, or otherwise tending to urge the door 12 closed.

Further, at step 464*b*, and before detection that a user has control of the door 12, the swing door ECU 52 signals to power-operated swing door actuator 22 to operate as an infinite door check (e.g. to a first check link detent position measured at for example 50 mm from the pillar to the trailing edge of door 12). In this case, the extensible member 618 may be retracted, or its stall condition interrupted, since the door check will provide the safety feature.

At step 464, if the presence of the user is sensed by the sensors before the door 12 has reach its presented position (i.e. extensible member 618 not fully retracted), the user can manually open door 12 to a desired door check position and swing door ECU 52, at step 490, sends a signal to electric motor 652 to retract extensible member 618 back to its home position (e.g. retracted position), as the user is manually opening door 12, and optionally command power-operated swing door actuator 22 at the desired door check position to operate as an infinite door check at this position. During normal operation, the extensible member 618 returns to the retracted position prior to closing of the door 12 by the user (for example, extensible member 618 return time is less than the time for a user to enter the vehicle 10 and close the door 12) for ease of door closing. In the event that the extensible member 618 is not in the fully retracted position, and the user decides to close the door 12 before it has reached its deployed position, the system is easily back drivable as described above so as not allow a user to sense any impediment or obstacle of the extensible member 618 in the closing of the door 12. Providing an easily back drivable power door presenter system 20 also allows the door 12 to be manually closed (e.g. the extensible member 618 may be manually forced into its retracted position) in the event a power failure results in the extensible member 618 not being able to be powered back to its retracted position.

Optionally, as step 488, the swing door ECU 52 may send a signal to power-operated swing door actuator 22 to commence its power opening operation at step 488 to automatically open the door 12 without a further manual intervention of the door (i.e. an initial grasping of the door by a user activates further power opening), for example upon the sensors sensing that a brief manual control over the door 12 has been made.

Optionally, as step 488, the swing door ECU 52 may send a signal to power-operated swing door actuator 22 to stop its power opening operation to apply an infinite door check function at that position where a user releases his grasp of the door 12, for example upon the sensors sensing that a brief manual control over the door 12 has been terminated.

Upon closing of door 12 by the user (e.g. manually) at step 492, in order to close primary latch assembly 13, striker 37 would once again become engaged with ratchet 26 (i.e. reset ratchet 26 such that ratchet 26 is held by pawl 23 and striker 37 is retained by ratchet 26 in the fishmouth 436. Also, extensible member 618 would be in its retracted position so as not to impede the closing of the door 12. Accordingly, power door presenter system 20 is already in a state to be redeployed upon a subsequent Receive Open Signal 460 step. At Step 496, power operated swing actuator 22 may provide for a powered or automatic closing of the door 12. If a power failure presents such an automatic closing, the power door presenter system 20 is easily back drivable as described above so as to ensure the extensible member 618 does not prevent the door 12 from being closed.

If at step 461, a power source failure has been detected, for example as would be the case of an emergency crash condition, the power door presenter system 20 can be activated to allow the door to be presented using the backup emergency power source 404 to allow thereafter the user to gain manual control of door 12 once presented. As such, if at step 500 a door open signal is received, then swing door ECU 52 signals electric motor 526 to deploy extensible member 618 using the energy from the back up energy source 404 at step 502. Thus the door 12 can be opened under an emergency condition in the case a physical door handle, such as outside door handle 61, is not installed on the vehicle 10. Also, the power door presenter system 20 can assist a user (interior or exterior the vehicle 10) with overcoming any damage to the door 12 and/or vehicle body 14 sustained during the accident which would tend to bind the door 12 closed.

The power door presenter systems shown in FIGS. 5-12 thus demonstrates an arrangement for providing a door presenter functionality to move the door from its closed position to its partially-open deployed, or presented, position. The door may be subsequently grasped by a user to move the door from its deployed position to its fully-open position, either during a normal door opening request, an emergency crash situation, or a failure of the main vehicle power source. While not limited thereto, the power-operated door presenter assembly 21 is capable of providing a range of swinging deployment of about 30-50 mm to meet current door system requirements.

Figure 14:
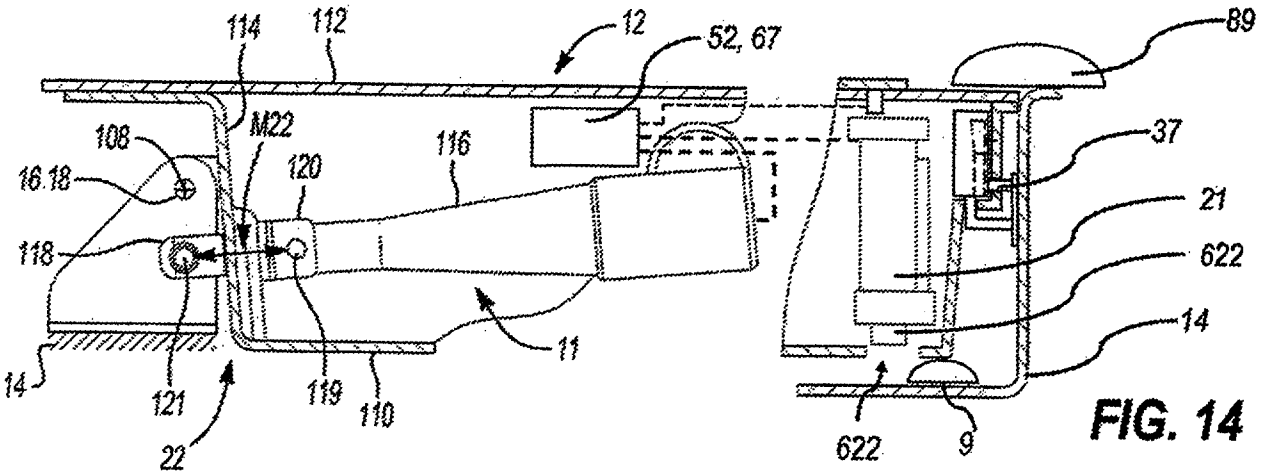
FIGS. 14 to 16 are schematic views illustrating the presentment of a vehicle door using a compact power door presenter assembly, alone or in conjunction with operation of a power swing door actuator, in accordance with an illustrative embodiment.
Figure 15:
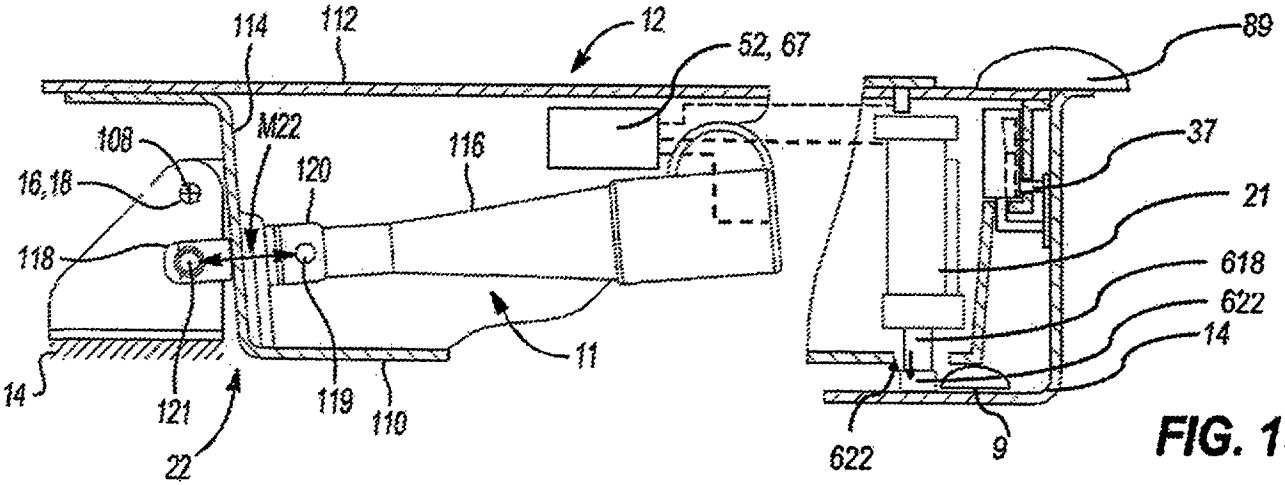
Figure 16:
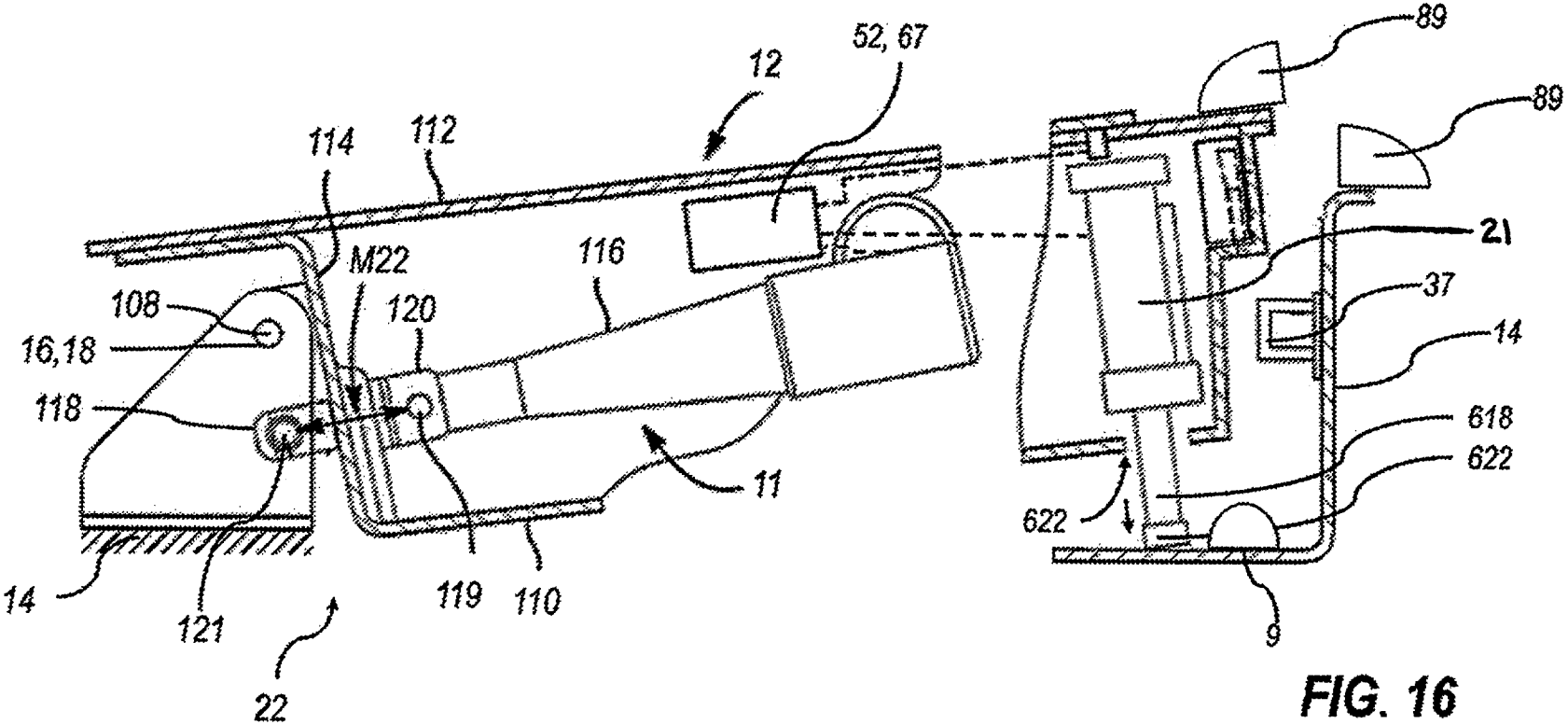
Figure 19:
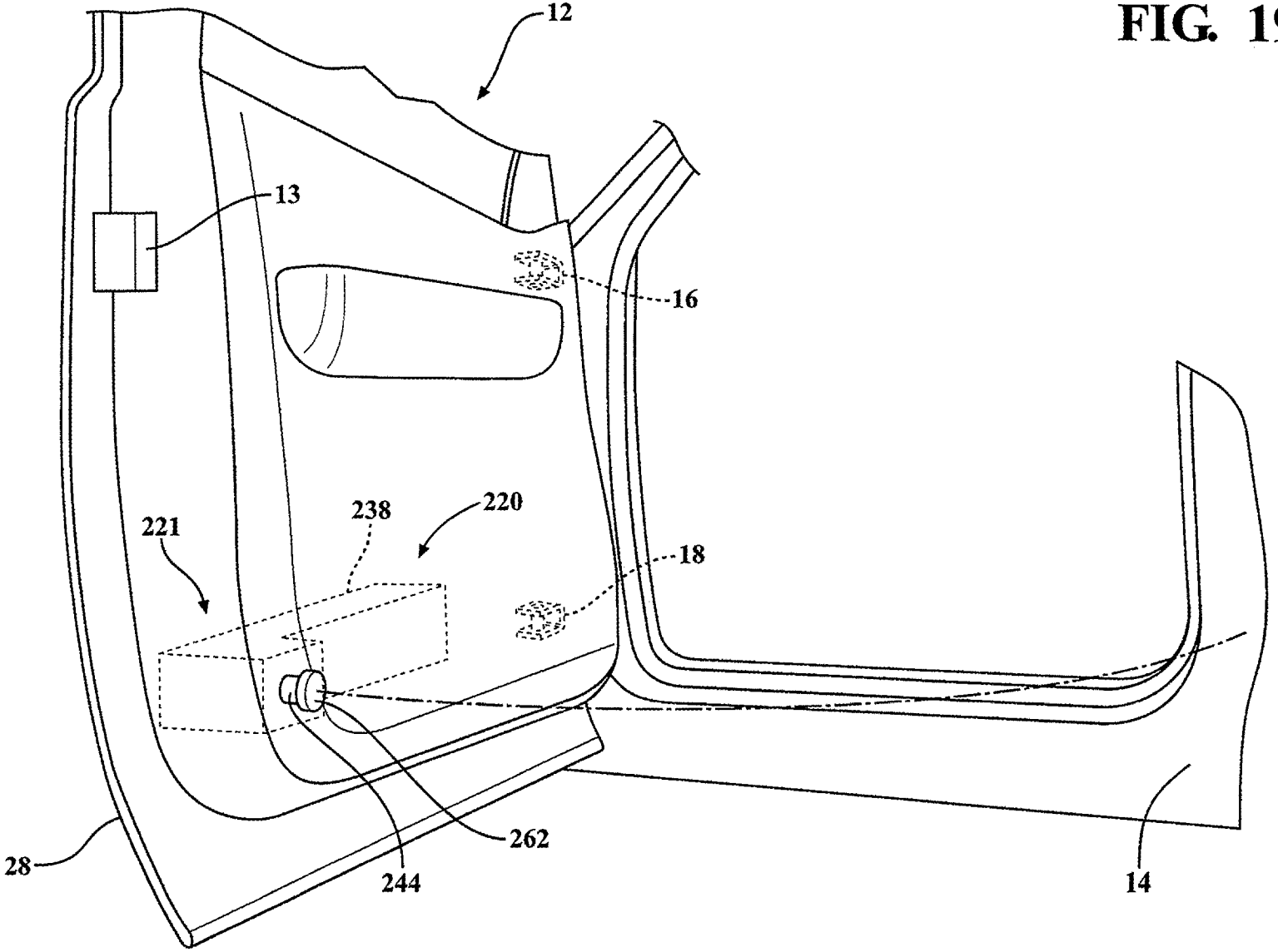
FIG. 19 illustrates a power-operated door presenter assembly constructed in accordance with another aspect of the disclosure mounted to the vehicle door, in accordance with an illustrative embodiment.
Figure 19A:
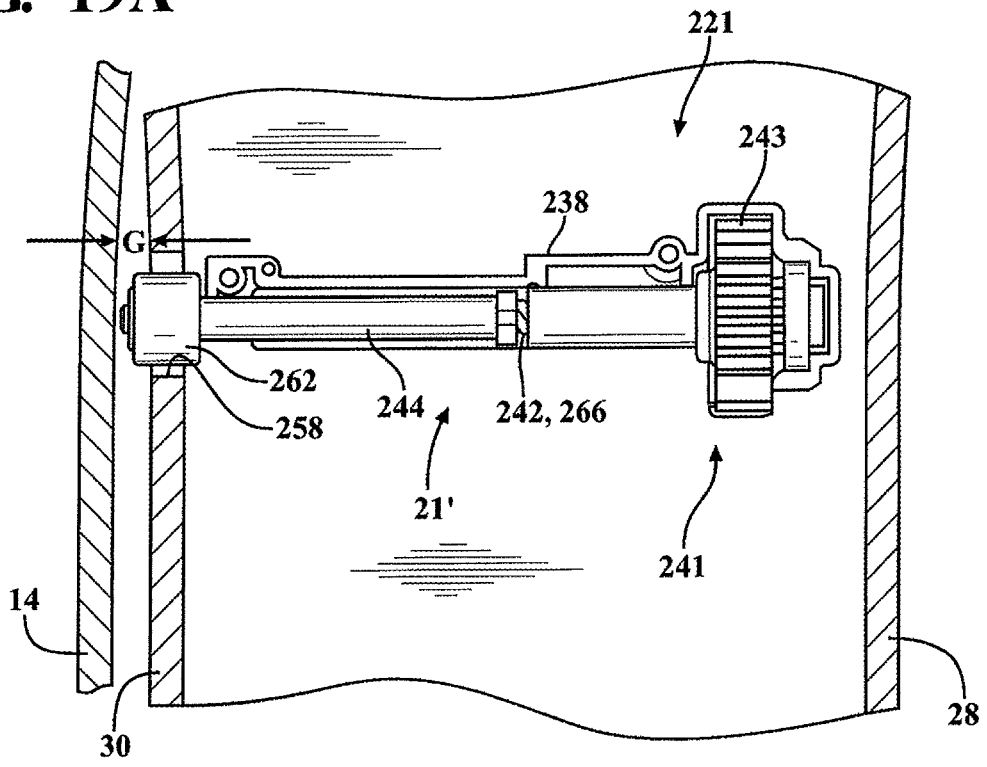
FIG. 19A is a fragmentary view of the power-operated door presenter assembly shown in a fully retracted, non-deployed position with the vehicle closure panel shown in a fully closed position.
Figure 19B:
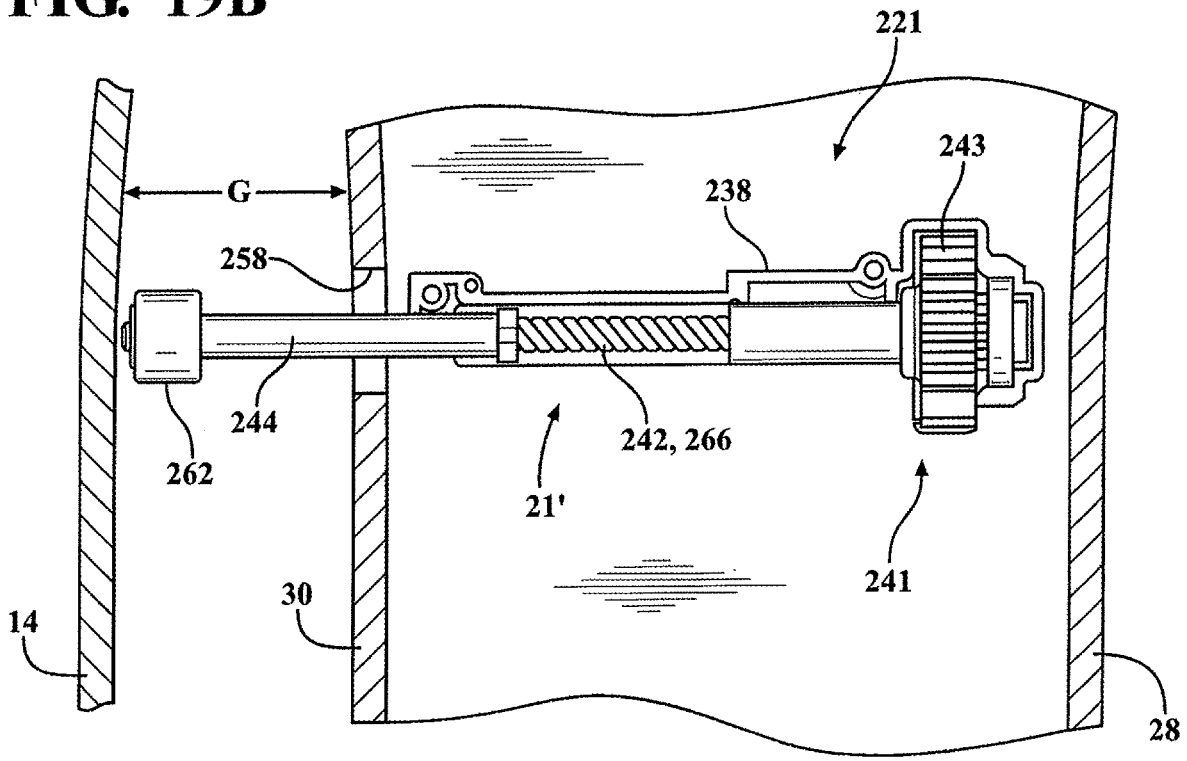
FIG. 19B is a view similar to FIG. 19A with the power-operated door presenter assembly shown in an extended, deployed position with the vehicle closure panel shown in a partially open, presented position.

Now referring to FIGS. 14 to 16, there is illustrated an operation of the power-operated presenter actuator 21 moving the door 12 from a closed position (FIG. 14) to a presented position (FIG. 19B). FIG. 14 illustrates the extensible member 618 in engagement with the vehicle body 14. Extensible member 618 is configured to a non-permanent, abutting contact with vehicle door 12. Powered swing door actuator 22 is illustrated to assist with moving the door 12 after the door 12 has been moved to the presented position, or may assist in a tandem operation with power-operated presenter actuator 21 to move the door 12 to the presented position, in a manner as described herein. It is recognize that door 12 may not be provided with powered swing door actuator 22, but solely being configured with power-operated presenter actuator 21 for subsequent manual movement.

Figure 17:
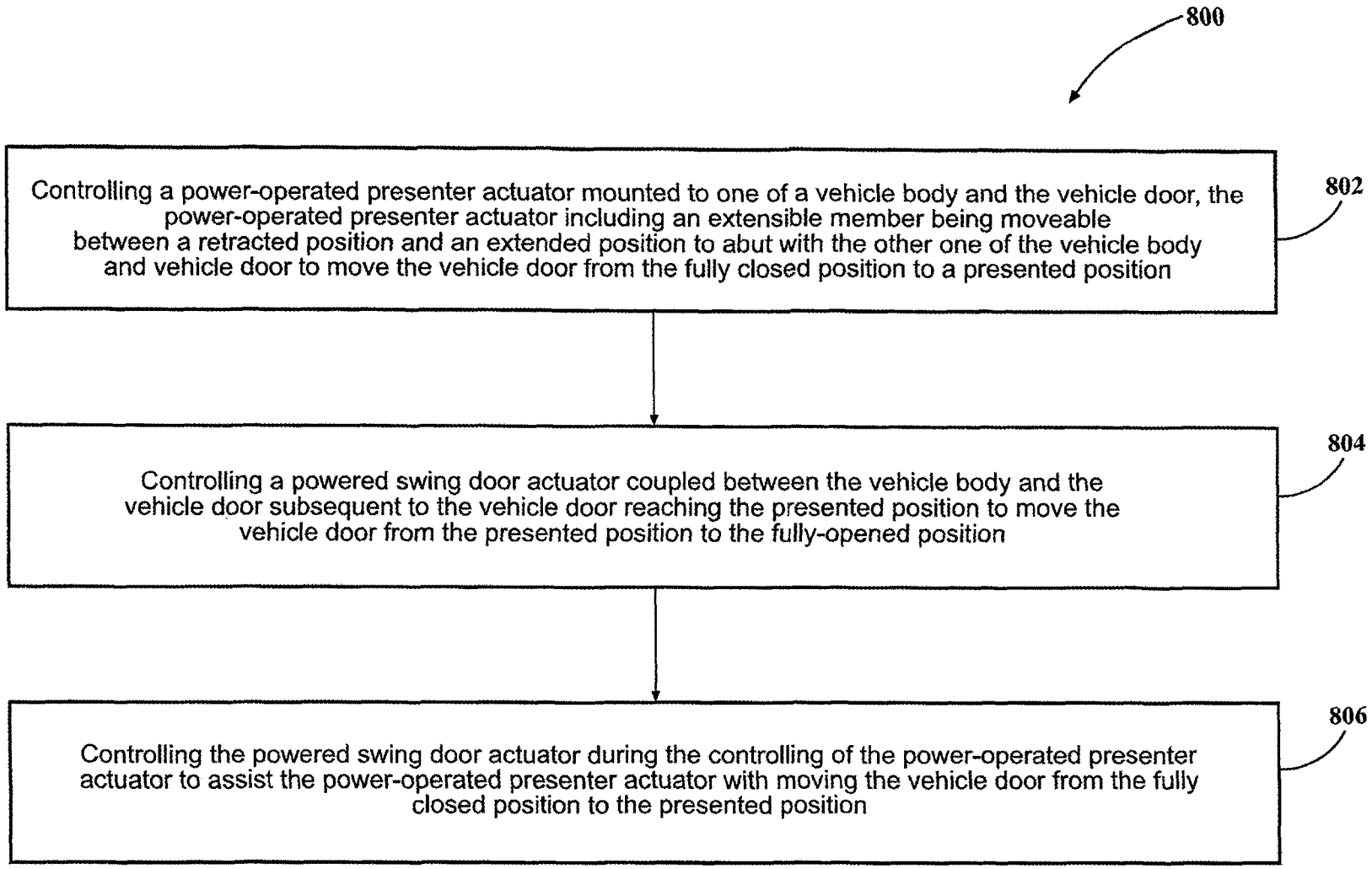
FIG. 17 is a flow chart illustrating a method of opening a vehicle door using the compact power door presenter assembly in conjunction with operation of a power swing door actuator of FIGS. 14 to 16, in accordance with an illustrative embodiment.

Now referring to FIG. 17, there is illustrated a method 800 of controlling movement of a vehicle door 12 from a fully closed position to a fully open position. The method 800 including the steps of 802 controlling a power-operated presenter actuator 21 mounted to one of a vehicle body 14 and the vehicle door 12, the power-operated presenter actuator 21 including an extensible member 618 being moveable between a retracted position and an extended position to abut (e.g. in non-permanent manner) with the other one of the vehicle body 14 and vehicle door 12 to move the vehicle door 12 from the fully closed position to a presented position, and 804 controlling a powered swing door actuator 22 coupled (e.g. in a permanent manner) between the vehicle body 14 and the vehicle door 12 subsequent to the vehicle door 12 reaching the presented position (e.g. see FIG. 16) to move the vehicle door 12 from the presented position to the fully-opened position (see FIG. 3C). The method 800 may also include the step of 806 controlling the powered swing door actuator 22 during the controlling of the power-operated presenter actuator 21 to assist the power-operated presenter actuator 21 with moving the vehicle door 12 from the fully closed position to the presented position. The method 800 may further include the step of controlling the power-operated presenter actuator 21 to move the extensible member 618 from the extended position to the retracted position in response to sensing the vehicle door 12 being moved to the presented position and a manual user having control of the vehicle door 12. The method 800 may further include the step of controlling the primary latch assembly 13 mounted to the vehicle door 12 to release a primary striker 37 mounted to the vehicle body 14 when the vehicle door 12 is located in its closed position simultaneously to powered movement of the extensible member 618 causing movement of the vehicle door 12 from its closed position to its presented position. The method 800 may further include the step of controlling the primary latch assembly 13 mounted to the vehicle door 12 to release a primary striker 37 mounted to the vehicle body 14 when the vehicle door 12 is located in its closed position subsequently to powered movement of the extensible member 618 causing movement of the vehicle door 12 from its closed position to its presented position. The method 800 may further include the step of maintaining the extensible member 618 in its extended position during the vehicle door 12 being between the presented position and the fully-open position. The method 800 may further include the step of retracting the extensible member 618 from its extended position to its retracted position in response to the vehicle door being sensed to be moving from its fully-opened position to the presented position.

As described above, the door system 20 can include the closure latch assembly 13 configured to selectively secure the vehicle door 12 relative to the vehicle body 14 in the latched state and release the vehicle door 12 in the unlatched state. The power-operated presenter actuator 21 of the system 20 is configured to move the vehicle door 12 between its closed position and it's presented position and may be used to break ice build-up 89 on the vehicle door 12. However, any attempt to break ice build-up 89 (e.g., with the power-operated presenter actuator 21) only needs to be enabled when ice build-up 89 is present resulting in the user needing some assistance opening the vehicle door 12. Limiting the operation of the ice breaker (e.g., the power-operated presenter actuator 21) can increase the life span of the power door actuation system 20, since the power-operated presenter actuator 21, for example, is not operated at every opening of the vehicle door 12 to break the ice build-up 89.

Thus, the electronic control unit 52, 67 that is coupled to the closure latch assembly 13 and the power-operated presenter actuator 21 is configured to receive a latch release command (e.g., from the outside door handle 61, inside door handle 61*a*, or when a person approaches vehicle 10 with the electronic key fob 60 (FIG. 2) and actuates a proximity sensor 61*c* or other touch/touchless based sensor) and operate the power-operated presenter actuator 21 as a function of the latch release command and a state of the motor vehicle 10. According to an aspect, the electronic control unit 52, 67 is further configured to determine that the vehicle door 12 is released by the closure latch assembly 13 (e.g., using sensors within the closure latch assembly 13 configured to monitor positions of the ratchet 26, pawl 23, etc.) and detect the vehicle door 12 not opening to the presented position (e.g., using the one or more sensors 71) in response to determining that the vehicle door 12 is released by the closure latch assembly 13. In other words, the state of the motor vehicle 10 can include the vehicle door 12 not opening to the presented position in response to determining that the vehicle door 12 is released by the closure latch assembly 13. Illustratively, the electronic control unit 52, 67 is shown as separate from the latch assembly 13 for example as enclosed within a housing of a door node module, but may be integrated into the latch assembly 13, for example enclosed within the housing of the closure latch assembly 13. Latch assembly 13 may be an electronic latch assembly as described in U.S. Pat. No. 10,378,251 entitled "Electronic latch of a motor-vehicle closure device, provided with an improved backup energy source", the entire contents of which are incorporated by reference herein. Temperature sensor 900 and crash sensor 902 may be also integrated into the closure latch assembly 13. Temperature sensor 900 and crash sensor 902 may be also integrated into the presenter 21, for example mounting within the housing of the presenter 21, such as mounted to PCB 634 for example. Alternatively temperature sensor 900 and crash sensor 902 may be also integrated with or in communication with the Body Control Module 72, and the electronic control unit 52, 67 is in communication with the Body Control Module 72 to receive signals representative of the output of the temperature sensor 900 and/or the crash sensor 902. A power-operated presenter actuator 21 is therefore provided which is mounted to one of the vehicle body and the vehicle door and configured to move the vehicle door between the closed position and the presented position, wherein the operate the power-operated presenter 21 actuator as a function of the state of the motor vehicle. As a result, the power operated presenter 21 may be operated to assist with moving the vehicle door 12. As a result, the power operated presenter 21 may be operated to assist with moving the vehicle door 12 when door actuator 22 is not able to move the vehicle door 12, such as a result of a crash causing damage to the door 12, or due to ice damage 12. A power-operated presenter actuator 21 is therefore provided which may be configured to move the vehicle door 12 between the closed position and the presented position in response to a sensed state of the motor vehicle which prevents the normal opening of the vehicle door 12, such as by a manual opening force from a user, or by the door actuator 22. The power-operated presenter actuator 21 may be operably connected to a sensor for determining the state of the motor vehicle, or door 12, such as a temperature sensor, or a crash sensor, either directly, or indirectly for determining when the power-operated presenter actuator 21 is required to open the vehicle door 12. A method of moving a vehicle door using a power-operated presenter actuator is also provided which includes the steps of determining a state of a motor vehicle, and controlling the power-operated presenter to move the vehicle door 12 from the closed position to the presented position in response to the state of the motor vehicle preventing the normal opening of the vehicle door 12.

Referring back to FIGS. 2 and 2A, at least one vehicle state sensor 71*a*, 71*b*, 71*c*, 99, 900, 902 is coupled to the electronic control unit 52, 67 for detecting the state of the motor vehicle 10 and outputting a vehicle state signal corresponding to the state of the motor vehicle 10. So, as an alternative to or in addition to determining that the vehicle door 12 is released by the closure latch assembly 13 and detect the vehicle door 12 not opening to the presented position in response to determining that the vehicle door 12 is released by the closure latch assembly 13, the electronic control unit 52, 67 is further configured to monitor the at least one vehicle state sensor 71*a*, 71*b*, 71*c*, 99, 900, 902. Therefore, the electronic control unit 52, 67 determines the state of the vehicle based on the vehicle state signal from the at least one vehicle state sensor 71*a*, 71*b*, 71*c*, 99, 900, 902. The at least one vehicle state sensor 71*a*, 71*b*, 71*c*, 99, 900, 902 can, for example, be chosen from the group consisting of a temperature sensor 900 for detecting a temperature of an environment of the motor vehicle 10 (e.g., freezing temperatures conducive to forming ice build-up 89) and a crash sensor 902 for detecting whether the motor vehicle 10 is involved in a crash.

As discussed, the door system 20 can further include the power-operated swing door actuator 22 configured to move the vehicle door 12 between the presented position and the fully-open position. Consequently, the electronic control unit 52, 67 is further configured to determine that the closure latch assembly 13 is in its unlatched state. The electronic control unit 52, 67 is also configured to command the power-operated swing door actuator 22 to move the vehicle door 12 toward the fully-open position in response to determining that the closure latch assembly 13 is in its unlatched state. The electronic control unit 52, 67 determines whether the vehicle door 12 is in the fully-open position within a predetermined open time from determining that the closure latch assembly 13 is in its unlatched state (e.g., using the one or more sensors 71). The electronic control unit 52, 67 is then configured to conclude that the vehicle door 12 is open in response to determining that the vehicle door 12 is in the fully-open position within the predetermined open time from determining that the closure latch assembly 13 is in its unlatched state. In addition, the electronic control unit 52, 67 concludes that the vehicle door 12 is obstructed in response to determining that the vehicle door 12 is not in the fully-open position within the predetermined open time from determining that the closure latch assembly 13 is in its unlatched state. Thus, the electronic control unit 52, 67 operates the power-operated presenter actuator 21 to compensate for the vehicle door 12 being obstructed (e.g., break ice build-up 89).

In more detail, because door system 20 can include the at least one vehicle state sensor 71*a*, 71*b*, 71*c*, 99, 900, 902 coupled to the electronic control unit 52, 67, the electronic control unit 52, 67 is further configured to monitor the at least one vehicle state sensor 71*a*, 71*b*, 71*c*, 99, 900, 902 and determine the state of the vehicle based on the vehicle state signal from the at least one vehicle state sensor 71*a*, 71*b*, 71*c*, 99, 900, 902. So, the electronic control unit 52, 67 is further configured to conclude that the vehicle door 12 is obstructed in response to determining that the vehicle door 12 is not in the fully-open position within the predetermined open time from determining that the closure latch assembly 13 is in its unlatched state and based on the state of the motor vehicle 10 determined using the vehicle state signal (e.g., freezing temperature or crash detected).

Figure 18:
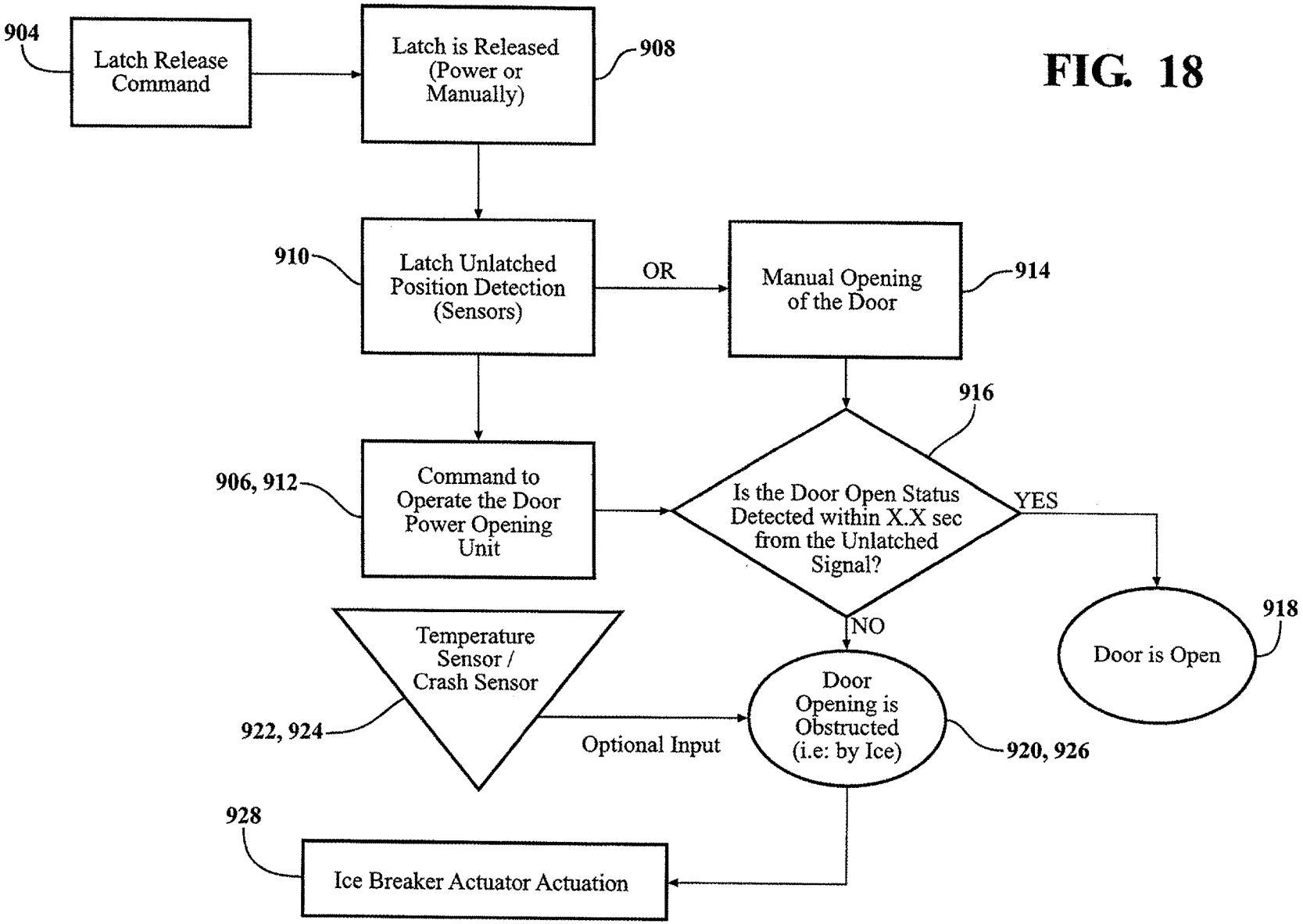
FIG. 18 is a flow chart illustrating another method of opening the vehicle door using the compact power door presenter assembly in conjunction with operation of a power swing door actuator of FIGS. 14 to 16 for breaking ice build-up impeding movement of the vehicle door.

Referring now to FIG. 18, another method of controlling movement of the vehicle door 12 between the closed position, the presented position, and the fully-open position is provided. The method includes the step of 904 receiving a latch release command (e.g., from the outside door handle 61, inside door handle 61*a*, or when a person approaches vehicle 10 with the electronic key fob 60 and actuates a proximity sensor 61*c* or other touch/touchless based sensor). The method continues with the step of 906 operating a power-operated presenter actuator 21 mounted to one of the vehicle body 14 and the vehicle door 12 to move the vehicle door 12 between the closed position and the presented position as a function of the latch release command and a state of the motor vehicle 10.

In general, the method can further include the step of determining that the vehicle door 12 is released by a closure latch assembly 13. Next, detecting the vehicle door 12 not opening to the presented position in response to determining that the vehicle door 12 is released by the closure latch assembly 13 (e.g., in this case, the state of the motor vehicle 10 includes the vehicle door 12 not opening to the presented position in response to determining that the vehicle door 12 is released by a closure latch assembly 13). Alternatively or in addition, the method can further include the step of detecting the state of the motor vehicle 10 and outputting a vehicle state signal corresponding to the state of the motor vehicle 10 using the at least one vehicle state sensor 71*a*, 71*b*, 71*c*, 99, 900, 902. The method can continue generally with the step of monitoring the at least one vehicle state sensor 71*a*, 71*b*, 71*c*, 99, 900, 902 to determine the state of the vehicle based on the vehicle state signal from the at least one vehicle state sensor 71*a*, 71*b*, 71*c*, 99, 900, 902.

The method proceeds with the step of 908 moving the closure latch assembly 13 to its unlatched state. The method continues with the step of 910 determining that the closure latch assembly 13 is in its unlatched state (e.g., using sensors within the closure latch assembly 13 configured to monitor positions of the ratchet 26, pawl 23, etc.). The next step of the method is 912 commanding a power-operated swing door actuator 22 coupled between the vehicle body 14 and the vehicle door 12 to move the vehicle door 12 toward the fully-open position subsequent to the vehicle door 12 reaching the presented position in response to determining that the closure latch assembly 13 is in its unlatched state. Alternatively, the method can include the step of 914 opening the vehicle door 12 manually (e.g., using outside door handle 61 or inside door handle 61*a*). Then, the method includes the step of 916 determining whether the vehicle door 12 is in the fully-open position within a predetermined open time from determining that the closure latch assembly 13 is in its unlatched state. The method continues by 918 concluding that the vehicle door 12 is open in response to determining that the vehicle door 12 is in the fully-open position (e.g., using the one or more sensors 71) within the predetermined open time from determining that the closure latch assembly 13 is in its unlatched state. The method also includes the step of 920 concluding that the vehicle door 12 is obstructed in response to determining that the vehicle door 12 is not in the fully-open position within the predetermined open time from determining that the closure latch assembly 13 is in its unlatched state.

The method can also include the step of 922 detecting the state of the motor vehicle 10 and outputting a vehicle state signal corresponding to the state of the motor vehicle 10 using the at least one vehicle state sensor 71*a*, 71*b*, 71*c*, 99, 900, 902. The method can then include the steps of 924 monitoring the at least one vehicle state sensor 71*a*, 71*b*, 71*c*, 99, 900, 902 to determine the state of the vehicle based on the vehicle state signal from the at least one vehicle state sensor 71*a*, 71*b*, 71*c*, 99, 900, 902 and 926 concluding that the vehicle door 12 is obstructed in response to determining that the vehicle door 12 is not in the fully-open position within the predetermined open time from determining that the closure latch assembly 13 is in its unlatched state and based on the state of the motor vehicle 10 determined using the vehicle state signal. The method then continues with the step of 928 operating the power-operated presenter actuator 21 to compensate for the vehicle door 12 being obstructed. Step 928 of operating the power-operated presenter actuator 21 may be performed until the door 12 is detected as being opened, is detected as being unblock or unfrozen, such as for example when a door ajar switch is detected indicating the ratchet has rotated to a position past secondary latched position, or until the door 12 has been moved to a presented position. In the event that at step 910 the latch has been operated to release e.g. the pawl is moved away from the ratchet, but does not allow the door 12 to move away from primary latched position, such that at step 916 the latch sensors do not detect the latch is unlatched, step 904 may be performed again or maintained during the steps 906, 912, 916, and 928 to ensure that the latch is not re-latched before the power-operated presenter actuator 21 has assisted to overcome the blocked or frozen condition of the door 12 due to ice or damage. Should the latch re-latch before the power-operated presenter actuator 21 has moved the door 12 by overcoming the frozen or blocked door state, the power-operated presenter actuator 21 may be rather acting against the latched state of the latch as opposed acting to overcome the frozen or damaged condition of the door 12.

Referring to FIGS. 19-22, in accordance with further preferred configurations, a power door presenter system 220 includes presenter assembly 221 constructed in accordance with another aspect of the disclosure. Presenter assembly 221 has a housing 238 secured within internal cavity 11. Presenter assembly 221 has an electric motor 240 driving a drive mechanism 241 including a driven member, shown by way of example as a toothed spur or helical gear 243, a presenter unit 21' including a presenter lead screw 242 and an extensible component, also referred to as extensible tube or member 244. Driven rotation of the drive mechanism 241 causes controlled translation of the extensible member 244 which, in turn, controls pivotal movement of passenger door 12 relative to vehicle body 14 from the closed position to the presented position. The presenter assembly 221 of power door system 220, as explained above for presenter assembly 21, can be located anywhere along the opening side of vehicle door 12, such as adjacent closure latch assembly 13 or below closure latch assembly 13 opposite to door hinges 16, 18. Alternatively, the housing 238 of presenter assembly 221 of power door system 220 can be mounted to vehicle body 14, for example at the base of the rear body pillar 151 (FIG. 1A) or sill/rocker panel 171 (FIG. 1B), which can provide increased packaging space for the presenter assembly 221. Power door system 220 and presenter assembly 221 thereof provides for coordinated and controlled presentment of vehicle door 12, such that the vehicle door 12 can be subsequently opened by the user. Further yet, as discussed further hereafter, upon being presented to the partially open position, as a result of automated return of extensible member 244 upon presentment, vehicle door 12 can be returned immediately to the closed position without concern of damage to presenter assembly 221.

Figure 20:
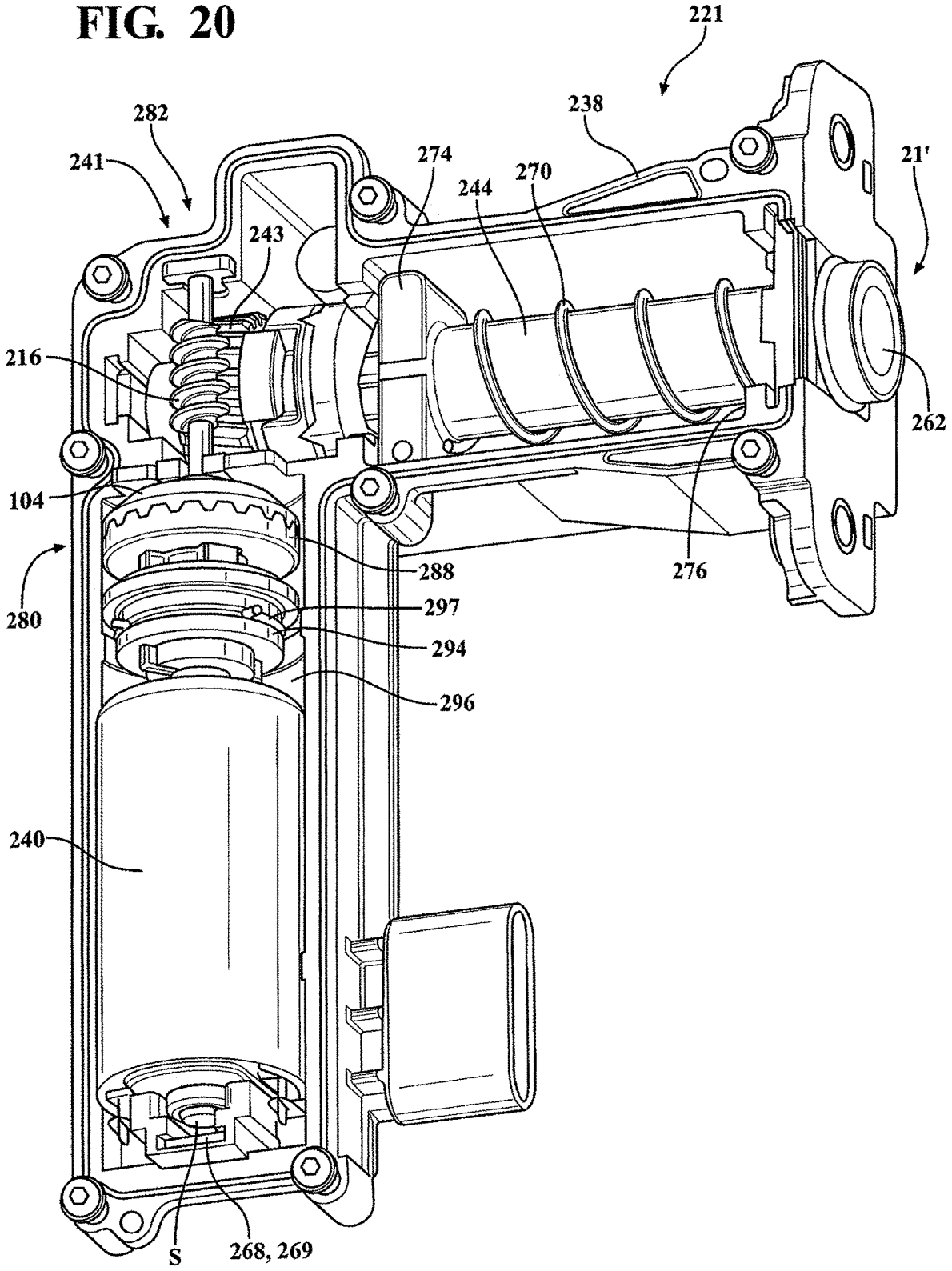
FIG. 20 is a perspective view of a presenter assembly constructed in accordance with an aspect of the disclosure shown in the fully retracted, non-deployed position.
Figure 21:
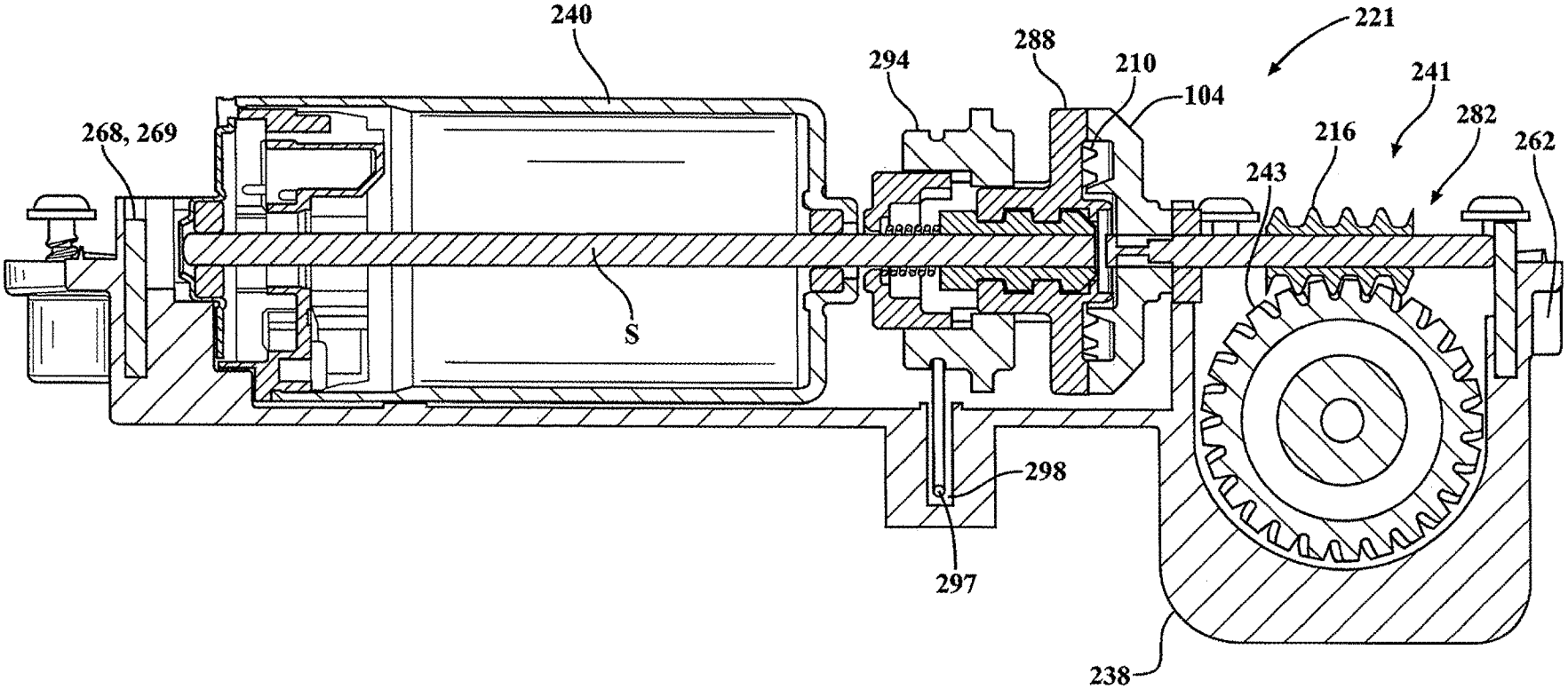
FIG. 21 is a side elevation view of the presenter assembly of FIG. 20 looking generally along the arrow 21-21 of FIG. 20A.
Figure 22:
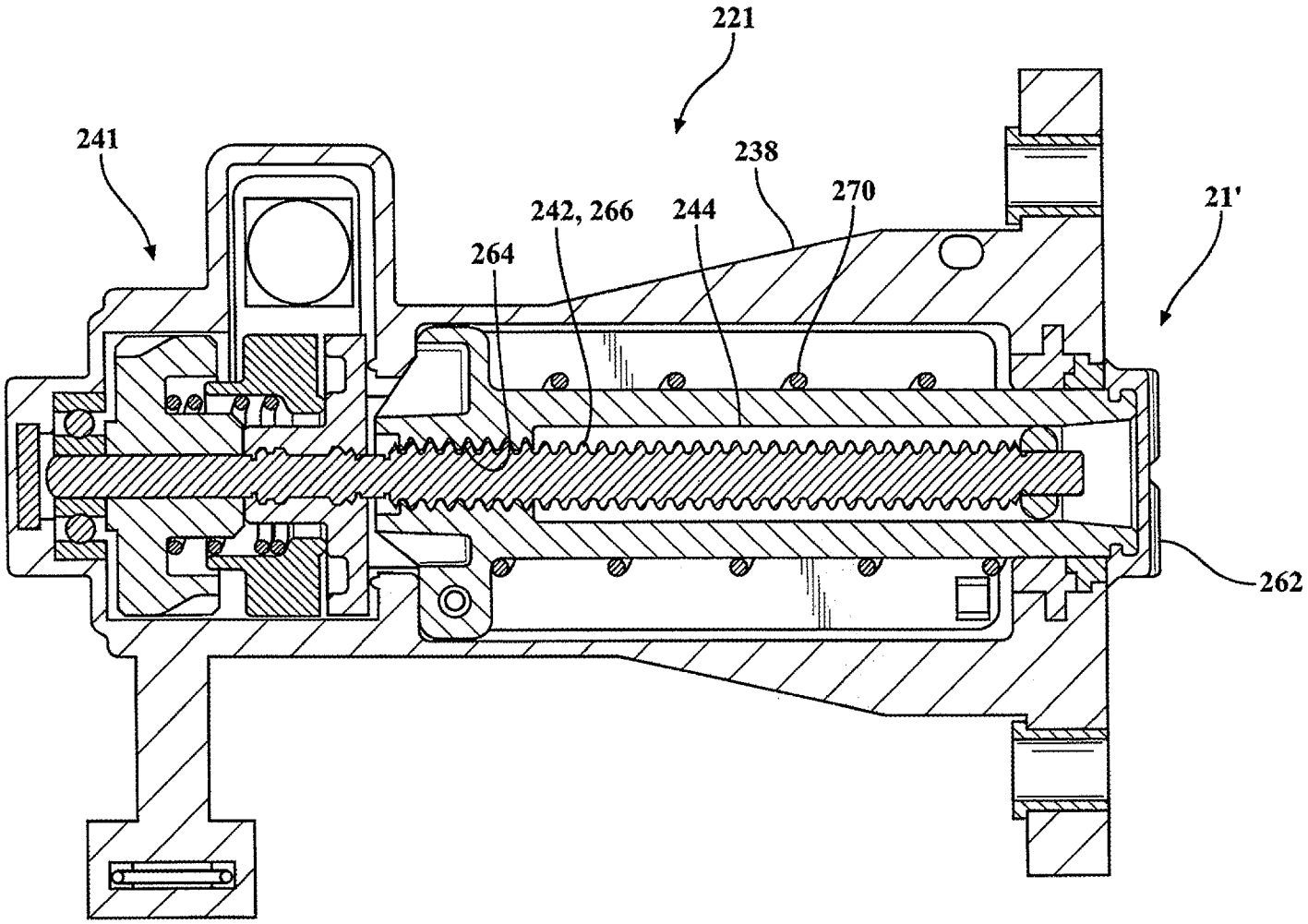
FIG. 22 is a cross-sectional view of the presenter assembly taken generally along the line 22-22 of FIG. 20A.

Now referring to FIGS. 20-22, in accordance with preferred non-limiting configurations, the presenter assembly 221 is configured to be secured within the internal cavity 11 (e.g. for example within or adjacent pillar 151 of vehicle body 14 as shown in FIG. 1A and therefore associated with vehicle body 14, or alternatively associated with vehicle door 12 as illustrated in FIG. 19) and including an actuator, such as electric motor 240, and drive mechanism 241 including extensible member 244 extendable through a port 258. Driven rotation of the drive mechanism 241 via energization of electric motor 240 causes controlled translation of the extensible member 244 which, in turn, controls pivotal movement of vehicle door 12 relative to vehicle body 14 as the extensible member 244 abuts against the vehicle body 14 in the exemplary configuration of the presenter assembly 221 being mounted to the vehicle door 12 as shown in FIG. 19, (or alternatively, the extensible member 244 abuts against the vehicle door 12 in the exemplary configuration wherein power door presenter assembly 221 is mounted within the vehicle body 14). The extensible member 244 abuts against the vehicle body 14 in the exemplary configuration in a non-permanent manner. As such, it is recognized that location of the power door presenter assembly 221 between vehicle body 14 and vehicle door 12 can be at any position, as desired.

Figure 20A:
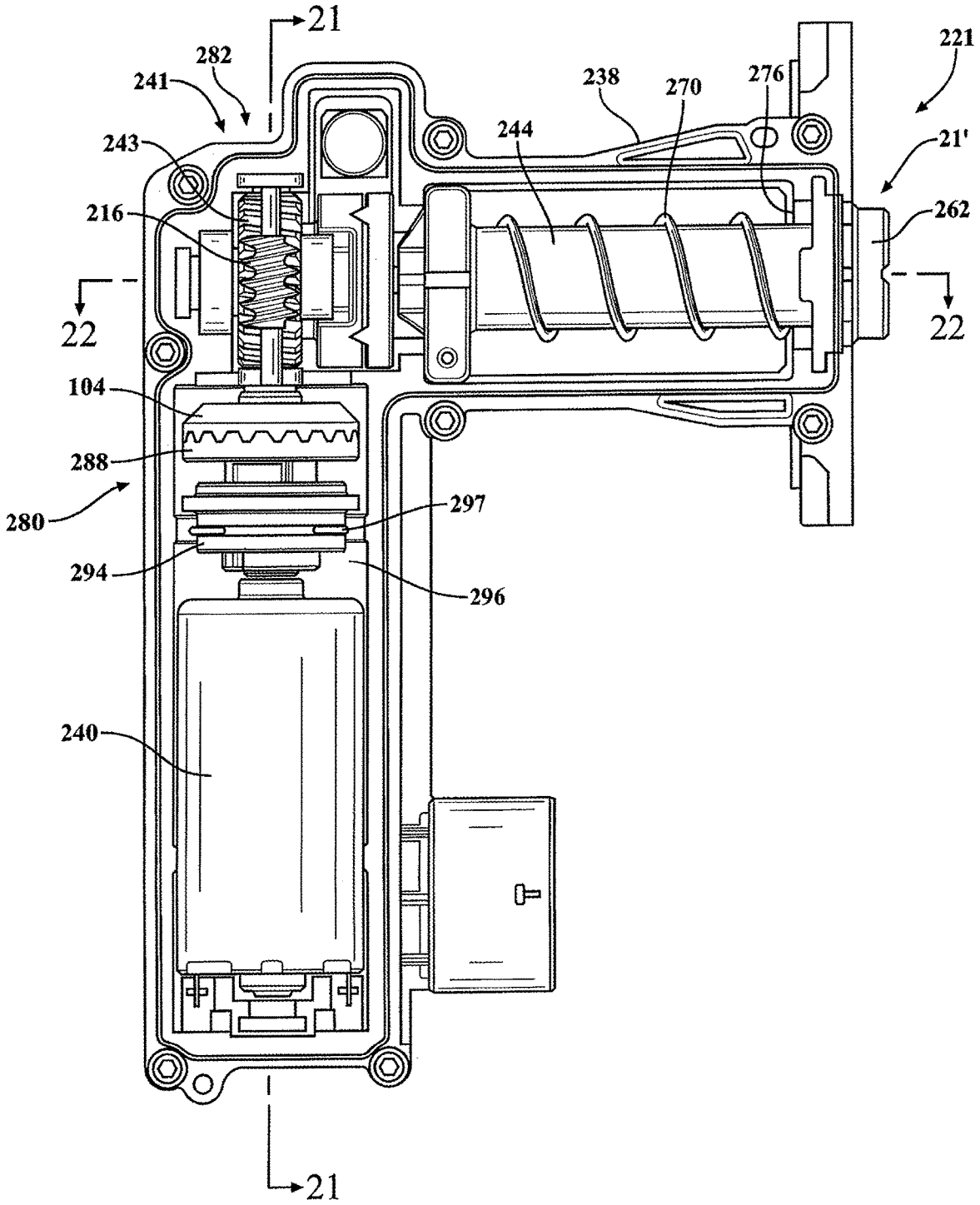
FIG. 20A is a plan view of the presenter assembly as shown in FIG. 20.
Figure 20B:
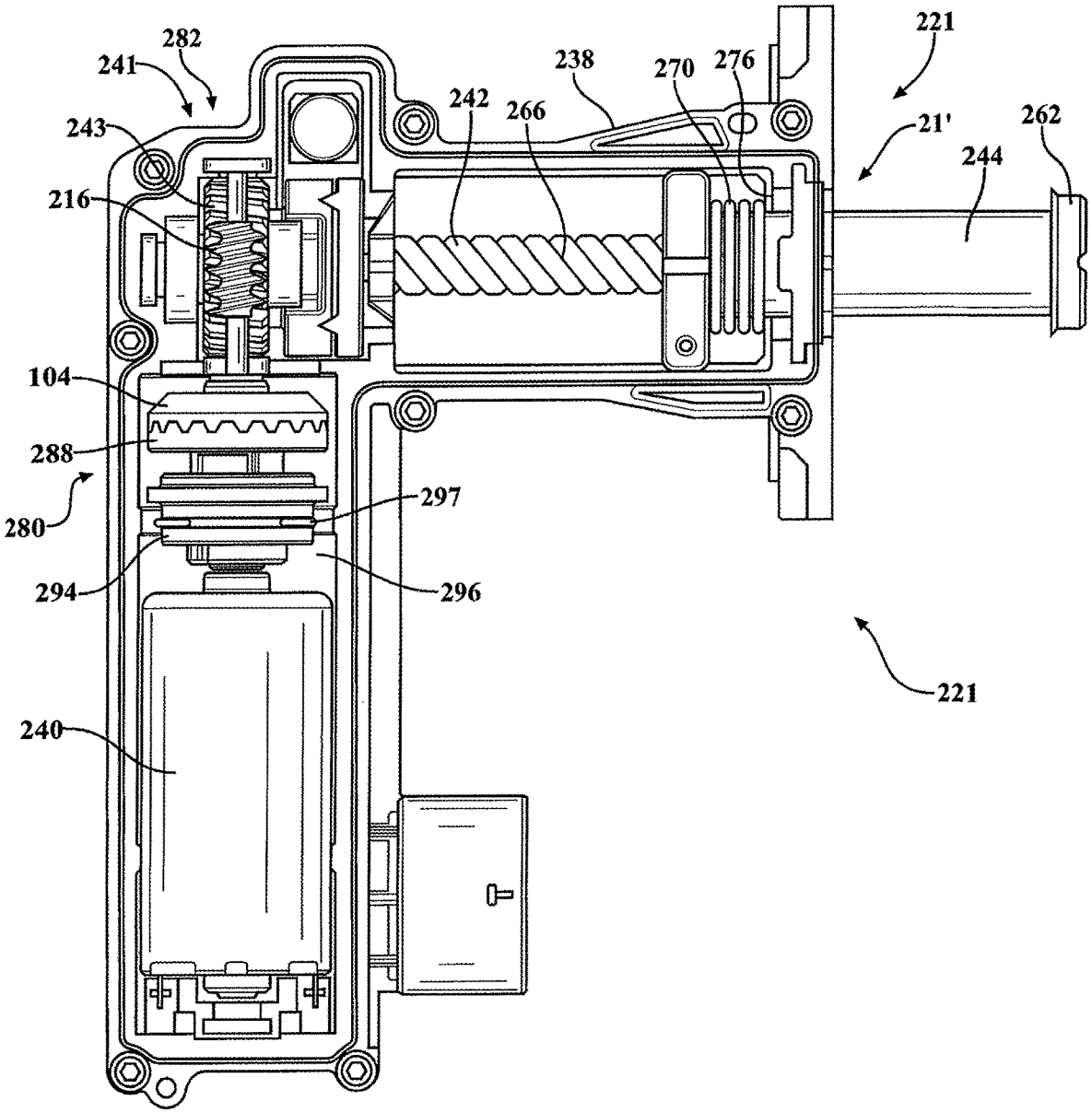
FIG. 20B is view similar to FIG. 20A with the presenter assembly shown in an extended, deployed position.

In general, as discussed above, presenter assembly 221 is adapted to be rigidly secured to vehicle body 14 or the vehicle door 12, such as by securing housing 238 encapsulating the various components of the presenter assembly 221 thereto. The housing 238 defines a tubular chamber in which the extensible member 244 translates. The extensible member 244 can be configured having an external distal end as discussed above, and is shown, by way of example and without limitation, as having a bumper, such as an elastic bumper 262 for abutment with the vehicle body 14. The extensible member 244 is threadingly engaged with presenter lead screw 242 in any known lead screw arrangement, such a via intermediate balls or rollers, as is known with ball screws, or via direct threaded engagement via internal female threads fixed to extensible member 244 and external male threads 266 fixed to presenter lead screw 242. It is to be recognized that female threads 264 can be formed as a monolithic piece of material with extensible member 244 or as a separated sleeve or member fixed thereto, and that male threads 266 can be formed as a monolithic piece of material with presenter lead screw 242 or as a separated sleeve or member fixed thereto. Accordingly, as one of the presenter lead screw 242 or extensible member 244 is rotated via operable driven engagement with electric motor 240, the other of presenter lead screw 242 or extensible member 244 is extended to move vehicle door 12 to the partially open, presented position. In the non-limiting embodiment illustrated in FIGS. 19-20B, presenter lead screw 242 is rotatably driven by motor 240 and extensible member 244 is translated along presenter lead screw 242 for engagement of bumper 262 with vehicle door 12 to move vehicle door 12 from the closed position to the presented position. Accordingly, the extensible member 244 is non-rotatably and axially moveable along presenter lead screw 242 between a retracted position (FIGS. 19A, 20 and 20A) and an extended position (FIGS. 19B and 20B) relative to housing 238. When extensible member 244 is located in its extended position (FIGS. 19B and 20B), vehicle door 12 is urged into the partially opened presented position.

A PCB 268 with sensor, such as a Hall-effect sensor 269, by way of example and without limitation, can be mounted in proximity to a motor shaft S of the electric motor 240. The sensor 269 can detect motor shaft S rotations and convert detected rotations into an absolute linear position electrical signal so that the linear position of the extensible member 244 is relatively known. In alternative embodiments, the sensor 269 can be provided as a linear encoder which reads the travel between components that move relative to one another, so that the linear position of the extensible member 244 is known with certainty, even upon power up.

Upon receiving a present command, vehicle door ECM 52 can provide a signal to electric motor 240, as discussed above for presenter assembly 21. Once vehicle door 12 is positioned at the desired presented position, electric motor 240 is turned off (de-energized), whereupon extensible member 244 is automatically returned to its retracted, non-deployed position (FIGS. 19A, 20 and 20A) under a bias of a biasing member, shown as a spring member, such as a coil spring 270, by way of example and without limitation. Spring member 270 is shown being axially compressible between an outwardly extending end flange 274 of extensible member 244 and an end wall 276 of housing 238, such that upon axial movement of extensible member 244 from the retracted, non-deployed position toward the extended, deployed position, spring member 270 is axially compressed, thereby building up a sufficient biasing forced within spring member 270 to automatically return extensible member 244 to the retracted, non-deployed position immediately upon de-energization of electric motor 240. Accordingly, immediately upon presentment of vehicle door 12 to the presented position and upon de-energization of electric motor 240, extensible member 244 is automatically and instantaneously returned under the bias of spring member 270 to its retracted, non-deployed position, thereby preventing damage from resulting to presenter assembly 221, such as upon the vehicle door 12 being suddenly slammed toward its closed position, as discussed further below.

Figure 23:
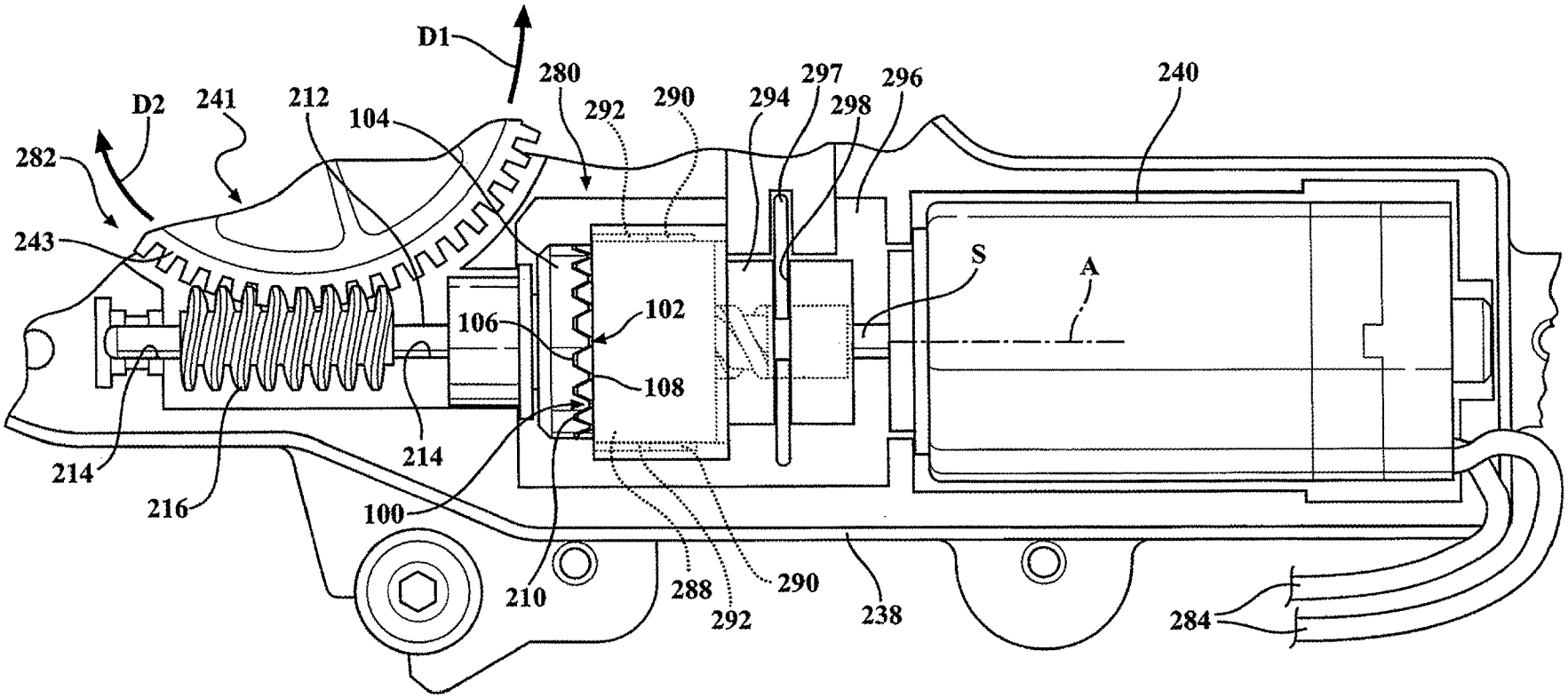
FIG. 23 is an enlarged partial view of a clutch assembly of the presenter assembly of FIG. 20.
Figure 24:
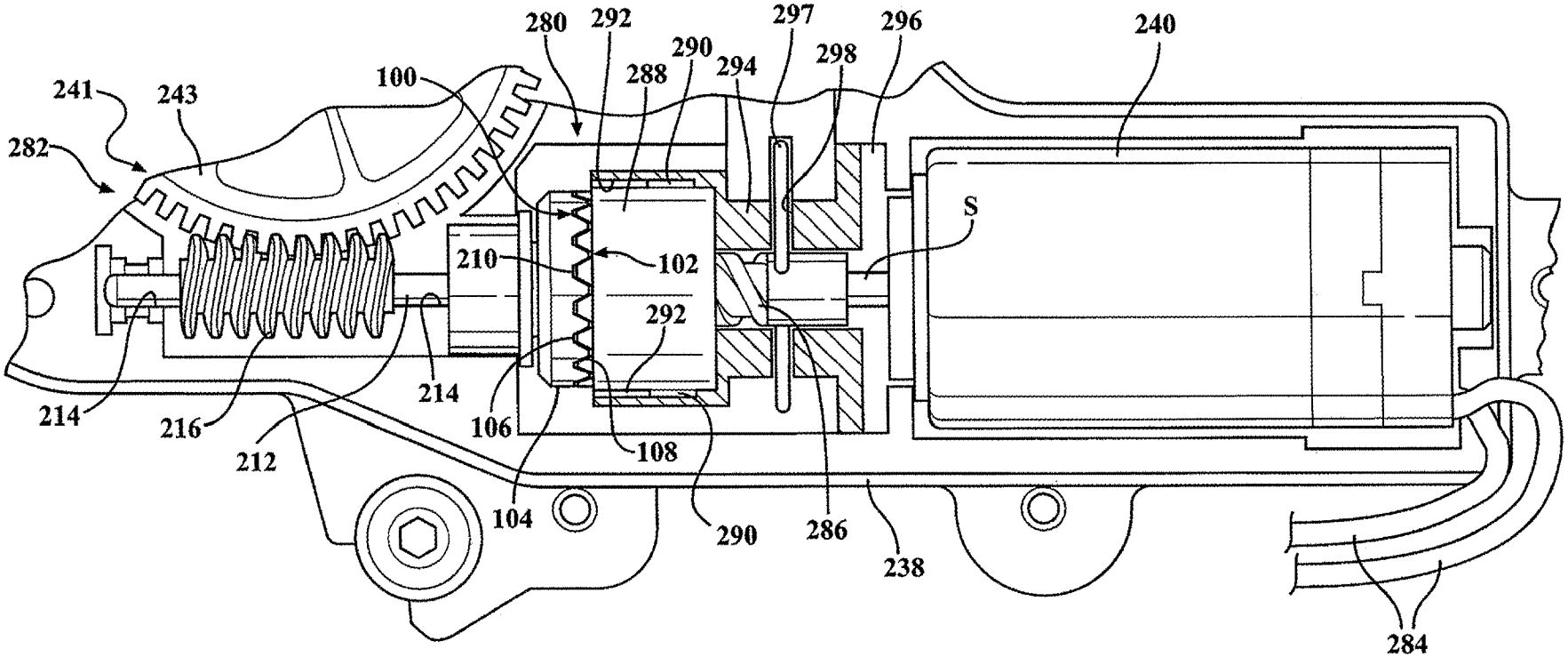
FIG. 24 is view similar to FIG. 23 with a carrier removed from the clutch assembly for clarity purposes only.
Figure 25:
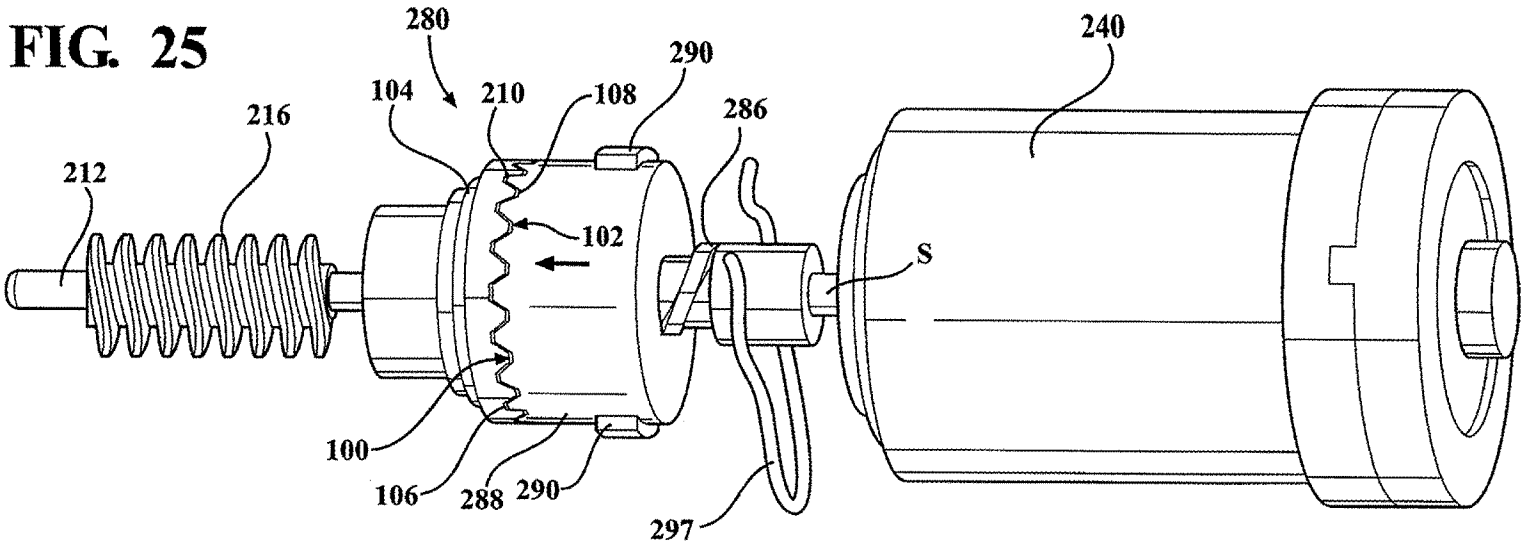
FIG. 25 is a perspective view of the clutch assembly as shown in FIG. 24.
Figure 25A:
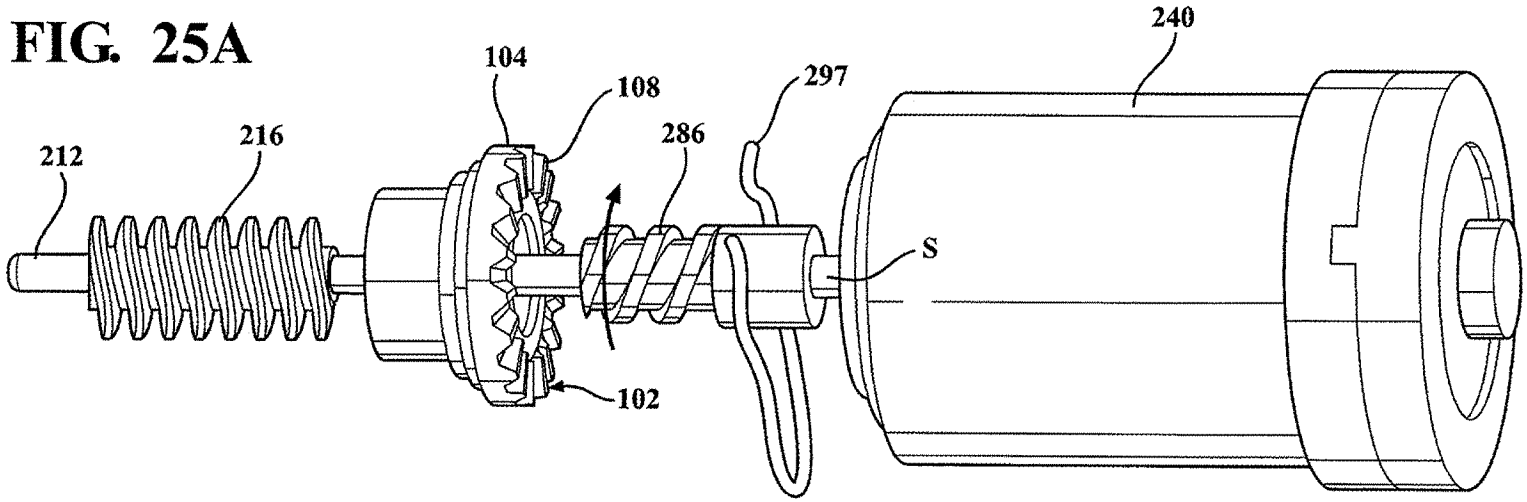
FIG. 25A is a view similar to FIG. 25 with a drive nut removed for clarity purposes only.
Figure 26:
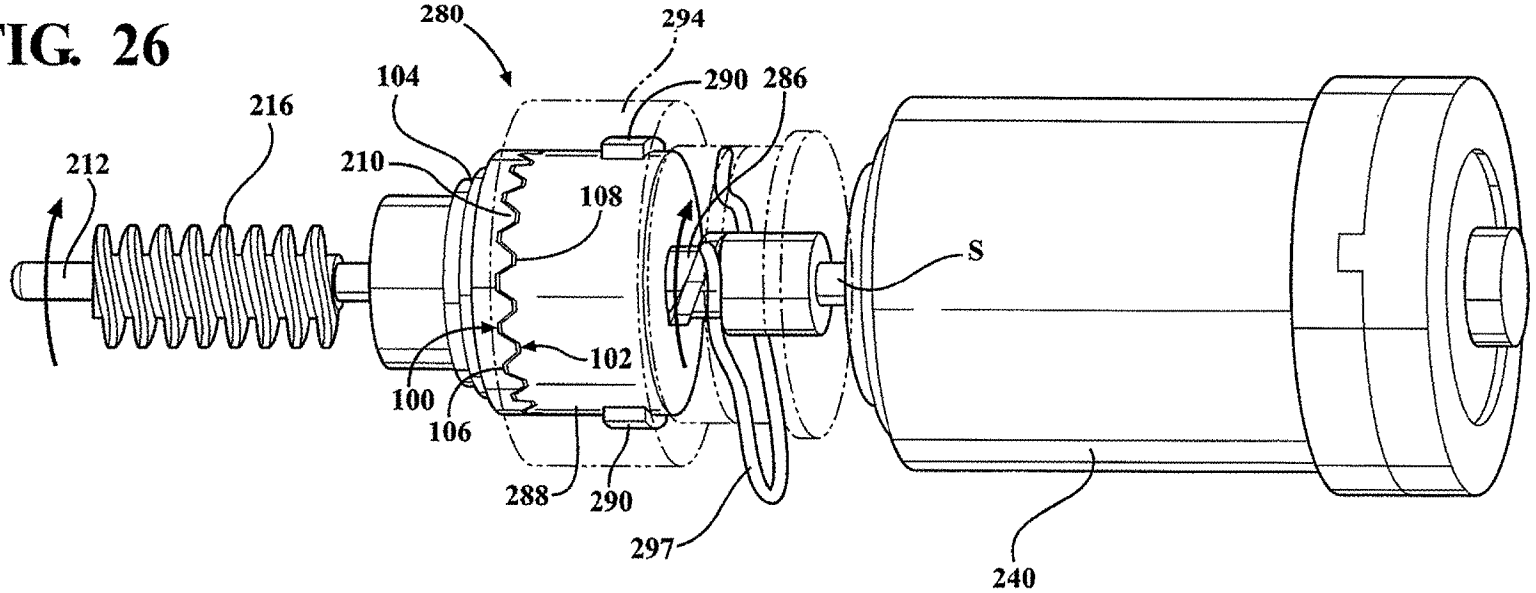
FIG. 26 is a perspective view of the clutch assembly as shown in FIG. 23 shown being driven in an engaged state.
Figure 26A:
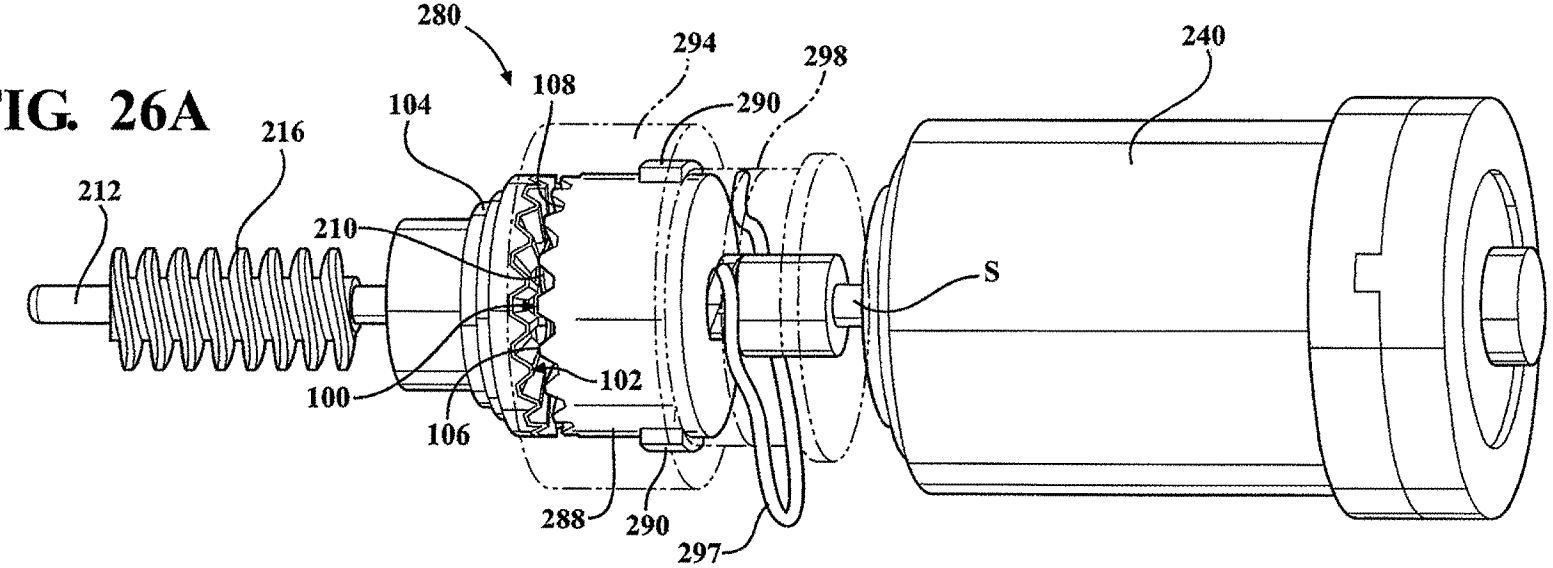
FIG. 26A is a view similar to FIG. 26 with the clutch assembly shown in an initial state of being disengaged.
Figure 26B:
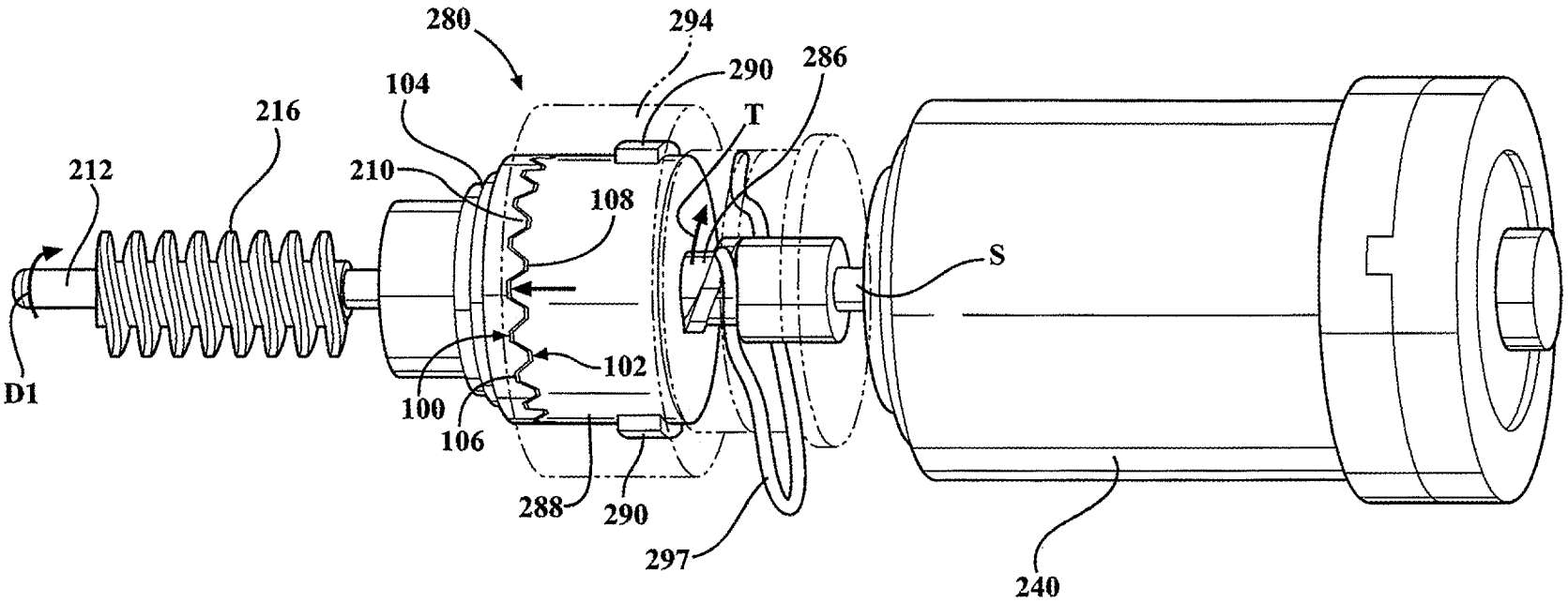
FIG. 26B is a view similar to FIG. 26 with the clutch assembly shown in a stall condition.

Presenter assembly 221 includes a clutch assembly 280 and a gear assembly 282 providing drive mechanism 241, configured for operable, selective communication with one another to move presenter unit 21' from driven operable communication with electric motor 240 when electric motor 240 is energized and out from operable communication with electric motor 240 when electric motor 240 is de-energized. Clutch assembly 280 and gear assembly 282 are received in housing 238. Gear assembly 282 can be provided as desired to attain the speed and torque output desired to act on, also referred to as drive, presenter lead screw 242. The gear assembly 282, upon being driven in a first direction of rotation D1 (FIG. 23) by engaged clutch assembly 280 in response to selective energization of motor 240, is configured to rotatably drive presenter lead screw 242 to move extensible member 244 to the extended, deployed position, and upon being allowed to return in a second direction of rotation D2 by disengaged clutch assembly 280 in response to de-energization of motor 242, is configured to allow spring member 270 to bias extensible member 244 back to its retracted, non-deployed position. Clutch assembly 280 is selectively actuatable (meaning intentionally actuated, whether via being manually actuated or via being automatically actuated, such as in response to a detected condition by a sensor and/or control module, for example) to move from a disengaged state, wherein the gear assembly 282 is out of operable driven communication with the clutch assembly 280 and from an electric motor 242, to an engaged state, wherein the gear assembly 282 is in operable driven communication with the clutch assembly 280 and with the electric motor 240. Actuation of the clutch assembly 280 from the disengaged state to the engaged state is caused via electrical energy from electrical current supplied to the electric motor 240 of the clutch assembly 280, such as via electrical connection of wires 284 to any suitable source of electrical power provided in the vehicle 11, including main power source 400 of the motor vehicle 10 and/or alternator/generator, by way of example and without limitation.

Motor 242 drives motor shaft S that extends along an axis A and is fixed to a drive member, shown as a screw, referred to hereafter as clutch lead screw 286. Clutch lead screw 286 has one or more helical threads or grooves configured for mating threaded receipt with a corresponding number of mating helical threads or grooves in a bore of a nut 288. As such, as will be understood by a person possessing ordinary skill in the art of linear actuators and the like, rotation of the clutch lead screw 286 causes linear translation of nut 288 therealong, as discussed further below. To facilitate driven translation of the nut 288 along clutch lead screw 286, the nut 288 has at least one, and shown as a pair of diametrically opposed drive lugs 290 configured for sliding translation within a corresponding number of recessed guide tracks, also referred to as channels 292, of a carrier member, referred to hereafter as carrier 294. The drive lugs 290 are configured for slightly loose, sliding receipt within the channels 292 to allow for low friction linear translation therein, though the fit is close in a radial, rotational direction to prevent or inhibit relative rotation between the nut 288 and the carrier 294, thereby avoiding radial play, also referred to as slop, between nut 288 and carrier 294. The carrier 294 is received and supported in a cavity 296 of housing 238 and fixed against axial movement therein, thereby preventing carrier 294 from moving axially along drive shaft S within cavity 296; however, carrier 294 is permitted for selective rotation within the cavity 296. To facilitate selective rotation of carrier 294, a damper member, also referred to as rotary damper or biasing member, shown as a spring member, such as a spring clip 297, by way of example and without limitation, fixed in housing 238, is disposed in frictional engagement within a circumferentially extending groove 298 in an outer surface of carrier 294. It is to be recognized that the radial and/or torsional biasing force applied by spring clip 297 against carrier 294 can be precisely controlled via the selected spring force applied by spring clip 297, such that the selective rotation of the carrier 294 within cavity 296 can be precisely controlled and regulated in response to engagement of an end face 100 of nut 288 with an end face, also referred to as clutch face 102 of a clutch plate 104. To facilitate selective conjoint driving interaction between end face 100 and clutch plate 104, end face 100 has a plurality of protrusions, also referred to as first teeth 106, configured for meshed driving operable interaction with protrusions, also referred to as second teeth 108, extending from clutch face 102 of clutch plate 104. A biasing member, such as a springy wave washer 210, such as those made of spring grade steel, is disposed between the end face 100 and clutch plate 104. The wave washer 210 acts to bias the end face 100 and first teeth 106 of nut 288 axially away from the clutch plate 104 and second teeth 108 thereof while electric motor 240 is de-energized, thereby allowing relative rotation between nut 288 and clutch plate 104 and the automatic return of extensible member 244 to its retracted, non-deployed position, and as discussed further below, while the wave washer 210 is axially compressed to allow the first and second teeth 106, 108 to be brought into operably engaged and/or driving relation with one another upon electric motor 240 being energized, wherein the wave washer 210 can be provided with a compressed contour to mate, also referred to as nest, with the first and second teeth 106, 108, thereby allowing extensible member 244 to be axially translated along lead screw 242 to its extended, deployed position.

Clutch plate 104 is fixed to an output shaft 112, with output shaft 212 being separate and detached from motor shaft S, with output shaft 212 being supported by bearing members 214 for driven rotation in response to clutch plate 104 being rotatably driven by nut 288. The output shaft 212 has a gear member, also referred to as output member or output gear, and shown as a helical worm gear 216, by way of example and without limitation, configured in driving coupled, such as meshed, relation with one of the gears of gear assembly 282. It will be understood that gear member 216 can be formed as a monolithic piece of material with output shaft 212, or formed separately from output shaft 212 and subsequently fixed thereto. As such, when clutch plate 104, output shaft 212 and worm gear 216 are conjointly rotated via driven interaction with end face 100 of nut 288, worm gear 216 drives the driven member 243 of gear assembly 282, wherein driven member 243 is fixed for conjoint rotation with presenter lead screw 242, thereby causing presenter lead screw 242 to rotate and drive extensible member 244 from its retracted, non-deployed position (FIGS. 19A, 20 and 20A) to its extended, deployed position (FIGS. 19B and 20B) to move vehicle door 12 from its closed position to it partially open, presented position.

In use, presenter assembly 221 is operable to move from its actuated, extended and deployed state, whereat electric motor 240 is energized, to its non-actuated, retracted and non-deployed state in automatic response to electric motor 240 being de-energized (no electrical current supplied to electric motor 240). While electrical motor 240 is in the no electrical power state, biasing member, such as wave washer 210, biases end face 100 and first teeth 106 thereon out of meshed, operable coupling with clutch plate 104 and second teeth 108 thereon, thereby automatically back-driving nut 288 axially away from engagement with clutch plate 104 without resistance from electrical motor 240, thereby allowing presenter assembly 221 to move to and/or remain in its non-actuated, retracted and non-deployed state, such as under the biasing influence from biasing member 270. Other types of biasing members and configurations for returning the presenter assembly 221 to a retracted state may be provided, for example a spring coupled to the presenter lead screw 242 may be furled about the shaft of the lead screw 242 to load an adjacent coil spring, and furled by the action of the release of energy stored in the loaded coil spring to impart a rotation of the presenter lead screw 242 in a direction opposite its actuation direction which extends the extensible member 244; a coil spring may be coupled between the presenter lead screw 242 and the housing 238 and compressed and uncompressed in a similar manner. Accordingly, when no electrical power is supplied to motor 240, such as can be controlled via ECM 52 during a routine actuation of presenter assembly 221 upon extensible member 244 reaching it fully extended, deployed position, thereby moving vehicle door 12 to the presented position, presenter assembly 221 and extensible member 244 thereof is automatically biased to its non-actuated, retracted and non-deployed state, wherein first and second teeth 106, 108 are decoupled and generally free to rotate relative with one another.

When desired to move presenter assembly 221 to its actuated, extended and deployed state to move vehicle door 12 to the partially open, presented position, electrical power is selectively provided to electric motor 240, whereupon motor drive shaft S and clutch lead screw 286 are rotated in a first driving direction, also referred to as actuating direction. Initial rotation of clutch lead screw 286 causes nut 288 to translate axially along clutch lead screw 286 with drive lugs 290 sliding axially within the recessed channels 292 of carrier 294. Up until the point where first and second teeth 106, 108 are operably coupled for driving engagement with one another, carrier 294 remains fixed against rotation under the radial/torsional bias of spring clip 297, thus, causing nut 288 to axially translate along a longitudinal axis of clutch lead screw 286. Then, as the nut 288 translates sufficiently to overcome the bias of wave washer 210, the first and second teeth 106, 108 are brought into operably coupled, intermeshed (nested) relation with one another, with axially compressed wave washer 210 being sandwiched between nut 288 and carrier 294. When first and second teeth 106, 108 are operably engaged with one another, and wave washer 210 is full or substantially compressed (substantially compressed is intended to mean compressed sufficiently to allow first and second teeth 106, 108 to become intermeshed with one another), nut 288 is prevented from further axial translation as a result of clutch plate 104 and output shaft 212 being fixed against axial movement, whereupon sufficient torque T is applied by drive lugs 290 of nut 288 to sidewalls of recessed channels 292 in carrier 294 to overcome the radial/torsional bias imparted by spring clip 297, thereby causing carrier 294 and first teeth 106 to co-rotate (rotate in releasably coupled relation with one another). While in their intermeshed, nested relation, rotation of the first teeth 106 causes conjoint rotation of the second teeth 108, thereby rotatably driving worm gear 216 and driven member 243 of gear assembly 240, which ultimately drives/ rotates presenter lead screw 242 and causes extensible member 244 to move along lead screw 242 from its retracted position to its extended position. Further, as long as electrical motor 240 is being powered by electrical energy, even in a stall condition, first and second teeth 106, 108 remain operably intermeshed with one another, thereby preventing a back-driving condition of nut 288 until electrical power supply to electrical motor 240 is interrupted, thus, preventing unintended return of extensible member 244 to its retracted position, which can facilitate preventing an undesired pinch condition between vehicle door 12 and vehicle body 14. Then, as discussed above, upon vehicle door 12 reaching the partially opened, presented position, electrical power is cut from electrical motor 240, whereupon extensible member 244 is suddenly returned to its retracted, non-deployed position such that, if desired, vehicle door 12 can be suddenly returned to its fully closed position without causing damaged to presenter assembly 21.

Figure 27:
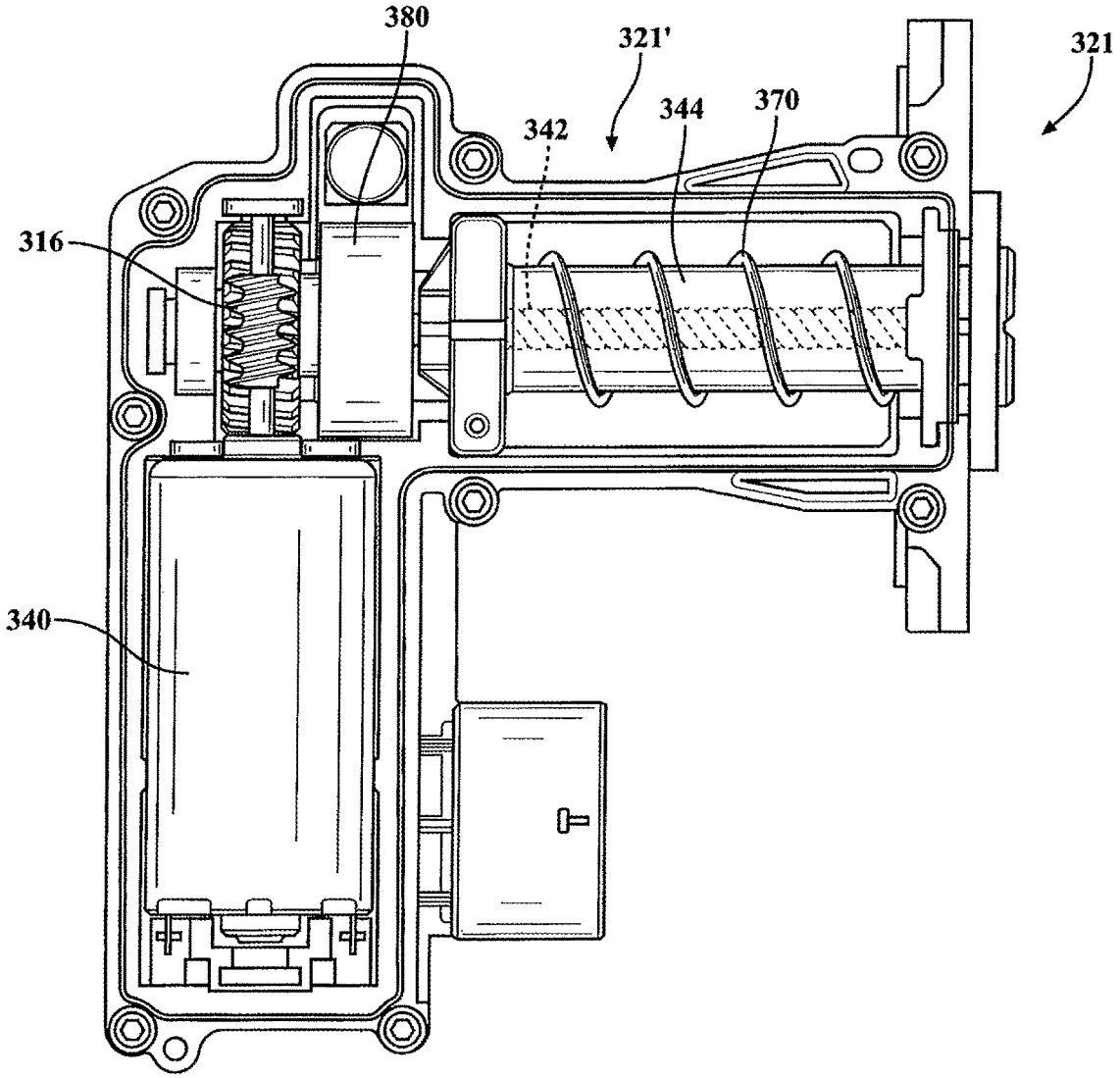
FIG. 27 is a plan view of a presenter assembly constructed in accordance with another aspect of the disclosure.

In FIG. 27, a presenter assembly 321 constructed in accordance with another aspect of the disclosure is shown, wherein the same reference numerals, offset by a factor of 300, are used to identify like features.

Presenter assembly 321 has a presenter unit 321' constructed as discussed above for presenter unit 21', having a presenter lead screw 342 and an extensible member 344, with a biasing member 370 configured to bias extensible member 344 to a retracted, non-deployed position. A clutch assembly 380 is disposed between an output member 316 and presenter leadscrew 342 to move presenter unit 321' from driven operable communication with an electric motor 340 when electric motor 340 is energized and out from operable communication with electric motor 340 when electric motor 340 is de-energized. Other than the location of clutch assembly 380, which can be provided as discussed above for clutch assembly 280, presenter assembly 321 is the same as discussed above for use in presenter system 220 and for presenter assembly 221, and thus, further discussion is unnecessary.

Figure 28:
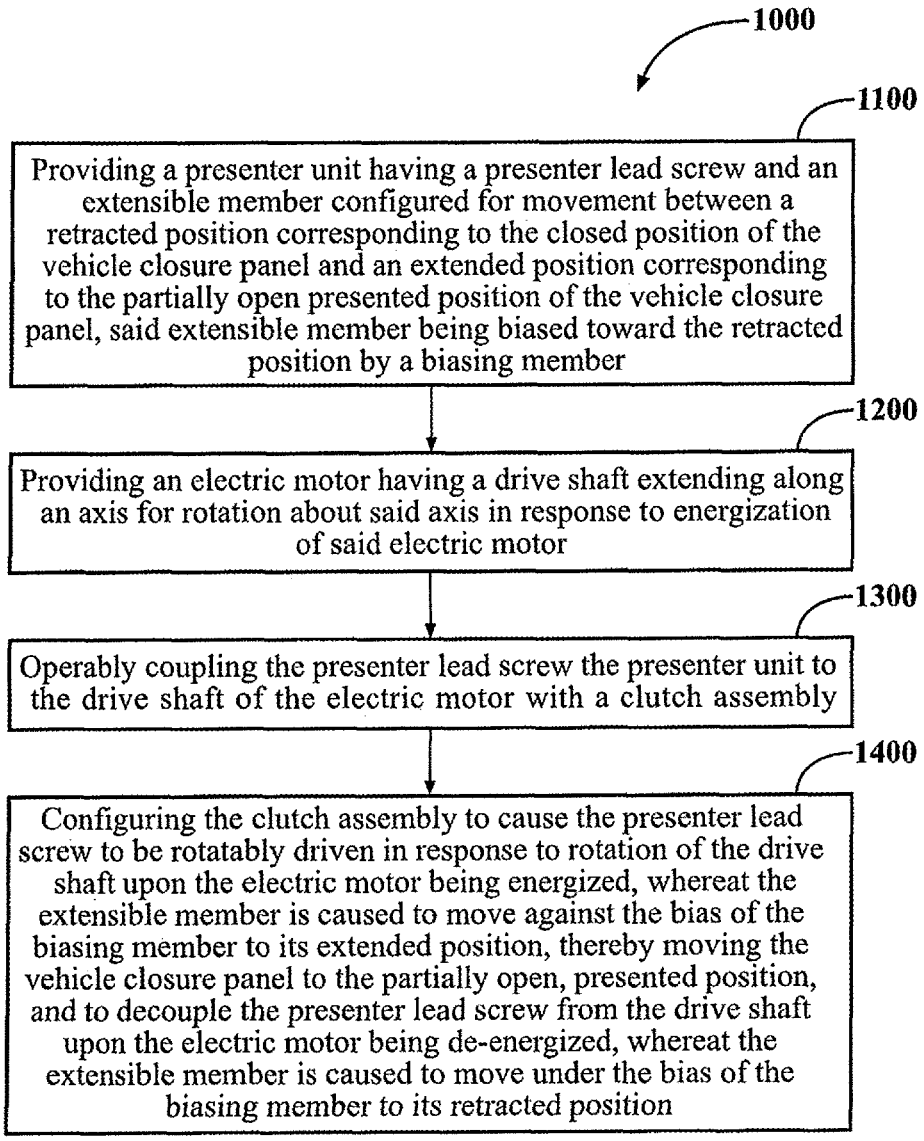
FIG. 28 is a flow diagram illustrating a method of presenting a motor vehicle closure panel from a closed position to a partially open, presented position.

In accordance with a further aspect of the disclosure, a method 1000 for presenting a vehicle closure panel 12 from a closed position to a partially open, presented position is provided, as shown in FIG. 28. The method includes a step 1100 of providing a presenter unit 21', 321' having a presenter lead screw 242, 342 and an extensible member 244, 344 configured for movement between a retracted position, corresponding to the closed position of the vehicle closure panel 12, and an extended position, corresponding to the partially open presented position of the vehicle closure panel 12, with the extensible member 244, 344 being biased toward the retracted position by a biasing member 270, 370. Further, a step 1200 of providing an electric motor 240, 340 having a drive shaft S extending along an axis A for rotation about the axis A in response to energization of the electric motor 240, 340. Further yet, a step 1300 of operably coupling the presenter lead screw 242, 342 of the presenter unit 21', 321' to the drive shaft S of the electric motor 240, 340 with a clutch assembly 280, 380. And, a step 1400 of configuring the clutch assembly 280, 380 to cause the presenter lead screw 242, 342 to be rotatably driven in response to rotation of the drive shaft S upon the electric motor 240, 340 being energized, whereat the extensible member 244, 344 is caused to move against the bias of the biasing member 270, 370 to its extended position, thereby moving the vehicle closure panel 12 to the partially open, presented position, and to decouple the presenter lead screw 242, 342 from the drive shaft S upon the electric motor 240, 340 being de-energized, whereat the extensible member 244, 344 is caused to move under the bias of the biasing member 270, 370 to its retracted position.

The method can further include a step of maintaining an end face 100 of a nut 288 and a clutch face 102 of a clutch plate 104 in driving engagement with one another when the electric motor 240, 340 is energized.

The method can further include a step of imparting a torsional bias on a carrier member 294 with a rotary dampener member 297 to fix the carrier member 294 and ultimately bias the nut 288 against rotation about the axis A with a clutch lead screw 286 when the end face 100 of the nut 288 and the clutch face 102 of the clutch plate 104 are biased out of driving engagement with one another and overcoming the torsional bias when the end face 100 of the nut 288 and the clutch face 102 of the clutch plate 104 are in driving engagement with one another to cause the carrier member 294 and the nut 288 to rotate about the axis A with the clutch lead screw 286.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A door system for a motor vehicle having a vehicle door moveable relative to a vehicle body between a closed position, a presented position, and a fully-open position, the system comprising:

a closure latch assembly configured to selectively secure the vehicle door relative to the vehicle body in a latched state and release the vehicle door in an unlatched state;

a power-operated presenter actuator mounted to one of the vehicle body and the vehicle door and configured to move the vehicle door between the closed position and the presented position; and an electronic control unit coupled to the closure latch assembly and the power-operated presenter actuator and configured to:

receive a latch release command, and operate the power-operated presenter actuator as a function of the latch release command and a state of the motor vehicle;

wherein the state of the motor vehicle is that the vehicle door is obstructed; and wherein the electronic control unit is configured to determine whether the vehicle door has moved away from the closed position within a predetermined open time from determining that the closure latch assembly is in its unlatched state;

the electronic control unit is configured to conclude that the vehicle door is obstructed in response to determining that the vehicle door has not moved away from the closed position within the predetermined open time from determining that the closure latch assembly is in its unlatched state; and the electronic control unit is configured to operate the power-operated presenter actuator to compensate for the vehicle door being obstructed.

2. The door system of claim 1, wherein the electronic control unit is configured to determine that the vehicle door is released by the closure latch assembly and the state of the motor vehicle includes the vehicle door not opening from the closed position.

3. The door system of claim 1, further including a power-operated swing door actuator configured to move the vehicle door between the closed position and the fully-open position wherein the electronic control unit is further configured to:

determine that the closure latch assembly is in its unlatched state, command the power-operated swing door actuator to move the vehicle door toward the fully-open position in response to determining that the closure latch assembly is in its unlatched state.

4. The door system of claim 1, wherein the power-operated presenter actuator has an extensible member configured for movement between a retracted position corresponding to the closed position of the vehicle door and an extended position corresponding to the presented position of the vehicle door, wherein the extensible member is biased toward the retracted position by a biasing member, the power-operated presenter actuator being configured to move the extensible member against the bias of the biasing member from the retracted position to the extended position in response to an electric motor of the power-operated presenter actuator being energized, the extensible member being automatically biased from the extended position to the retracted position by the biasing member upon the electric motor of the power-operated presenter actuator being de-energized.

5. The door system of claim 4, further including a clutch assembly having an engaged state when the electric motor of the power-operated presenter actuator is energized and a disengaged state when the electric motor of the power-operated presenter actuator is de-energized, wherein the extensible member is automatically biased from the extended position to the retracted position by the biasing member when the clutch assembly moves from the engaged state to the disengaged state.

6. The door system of claim 1, wherein the power-operated presenter actuator further including:

an extensible member configured for movement between a retracted position corresponding to the closed position of the vehicle door and an extended position corresponding to the presented position of the vehicle door, wherein the extensible member is biased toward the retracted position by a biasing member; and a clutch assembly having an engaged state when an electric motor of the power-operated presenter actuator is energized and a disengaged state when the electric motor of the power-operated presenter actuator is de-energized, wherein the extensible member is automatically biased from the extended position to the retracted position by the biasing member when the clutch assembly moves from the engaged state to the disengaged state.

7. The door system of claim 6, wherein the clutch assembly is between the electric motor and the power-operated presenter actuator.

8. The door system of claim 6, wherein the electric motor of the power-operated presenter actuator has a drive shaft extending along an axis and an output member operably coupled to said drive shaft and being driven by said electric motor when said electric motor is energized, wherein said output member is coupled with said drive shaft when said electric motor is energized and when said clutch assembly is in the engaged state and is decoupled from drive shaft when said electric motor is de-energized and when said clutch assembly is in the disengaged state.

9. The door system of claim 8, wherein said clutch assembly includes:

a clutch lead screw fixed to said drive shaft for rotation about said axis in response to energization of said electric motor;

a nut disposed about said clutch lead screw, said nut having an end face and being configured for selective translation along said clutch lead screw in response to rotation of said clutch lead screw;

a clutch plate having a clutch face and being configured for selective rotation about said axis;

a biasing member imparting a bias between said nut and said clutch plate, said bias tending to space said end face out of driving engagement with said clutch face;

a carrier member supported by said housing in coupled relation with said nut, said carrier member imparting a torsional bias on said nut sufficient to cause selective relative rotation between said nut and said clutch lead screw to cause said nut to translate along said clutch lead screw in response to rotation of said clutch lead screw when said end face of said nut and said clutch face of said clutch plate are biased out of driving relation with one another, said torsion bias being overcome upon said end face of said nut and said clutch face of said clutch plate being brought into driving relation with one another, thereby allowing said nut and said carrier member to rotate conjointly with said clutch lead screw; and a driven member fixed to said presenter lead screw and being drivingly coupled with said output member to move said extensible member to said extended position when said end face of said nut and said clutch face of said clutch plate are brought into driving relation with one another and when said clutch lead screw rotates about said axis in response to energization of said electric motor.

10. The door system of claim 9, wherein said end face of said nut and said clutch face of said clutch plate are maintained in driving relation with one another when electrical energy is supplied to said electric motor.

11. The door system of claim 10, further including a rotary damper member configured to impart a torsional bias on said carrier member, said torsional bias fixing said carrier member and said nut against rotation with said clutch lead screw when said end face of said nut and said clutch face of said clutch plate are biased out of driving relation with one another and allowing said carrier member and said nut to rotate with said clutch lead screw when said end face of said nut and said clutch face of said clutch plate are in driving relation with one another.

* * * * *